US009664009B2

(12) United States Patent
Lembcke et al.

(10) Patent No.: US 9,664,009 B2
(45) Date of Patent: May 30, 2017

(54) APPARATUSES, SYSTEMS, AND METHODS FOR FORMING IN-SITU GEL PILLS TO LIFT LIQUIDS FROM HORIZONTAL WELLS

(71) Applicant: WEATHERFORD/LAMB, INC., Houston, TX (US)

(72) Inventors: Jeffrey John Lembcke, Houston, TX (US); William Charles Lane, Houston, TX (US); Clayton S. Smith, Houston, TX (US)

(73) Assignee: Weatherford Technologies, LLC

( * ) Notice: Subject to any disclaimer, the term of this patent is extended or adjusted under 35 U.S.C. 154(b) by 566 days.

(21) Appl. No.: 13/856,513

(22) Filed: Apr. 4, 2013

(65) Prior Publication Data

US 2013/0312977 A1 Nov. 28, 2013

Related U.S. Application Data

(60) Provisional application No. 61/620,085, filed on Apr. 4, 2012.

(51) Int. Cl.
*E21B 37/04* (2006.01)
*E21B 43/12* (2006.01)

(52) U.S. Cl.
CPC ..... *E21B 37/04* (2013.01); *E21B 43/121* (2013.01)

(58) Field of Classification Search
CPC ..... E21B 21/001; E21B 2021/005; E21B 41/005; E21B 37/00; E21B 23/08; E21B 21/14; E21B 21/16; E21B 37/06; E21B 37/08; B08B 9/093; B08B 9/027; B08B 9/02

See application file for complete search history.

(56) References Cited

U.S. PATENT DOCUMENTS

| | | | | |
|---|---|---|---|---|
| 4,187,911 | A * | 2/1980 | Hutchison et al. | 166/312 |
| 4,473,408 | A * | 9/1984 | Purinton, Jr. | 134/8 |
| 5,346,339 | A * | 9/1994 | Himes | B08B 9/0555 134/8 |
| 6,164,380 | A * | 12/2000 | Davis | 166/312 |
| 7,278,488 | B2 * | 10/2007 | Leduc | 166/312 |
| 7,514,391 | B2 * | 4/2009 | Chan | 507/202 |
| 7,886,826 | B2 * | 2/2011 | Robinson et al. | 166/305.1 |
| 2008/0142224 | A1 * | 6/2008 | Wilson | 166/308.2 |
| 2011/0272160 | A1 * | 11/2011 | Arvie et al. | 166/311 |

* cited by examiner

*Primary Examiner* — Doug Hutton, Jr.
*Assistant Examiner* — Charles Nold
(74) *Attorney, Agent, or Firm* — Robert W Strozier

(57) ABSTRACT

Methods include the injection of a gelled, gelling or gellable composition into a horizontal section of a well at a location, where produced well gases or a combination of well gases and injected gases are sufficient to move the pill through the horizontal section into heal section, sweeping the horizontal section of accumulated liquids. Once in the heal section, the pill and the accumulated liquids are uplifted to the surface resulting in a cleaned well.

35 Claims, 23 Drawing Sheets

APPARATUSES, SYSTEMS, AND METHODS FOR FORMING IN-SITU GEL PILLS TO LIFT LIQUIDS FROM HORIZONTAL WELLS

RELATED APPLICATIONS

This application claims the benefit of and priority to U.S. Patent Application Ser. No. 61/620,085 filed Apr. 4, 2012.

BACKGROUND OF THE INVENTION

1. Field of the Invention

Embodiments of the present invention relate to methods, systems, and apparatuses for forming in situ gel pills or pigs to lift liquids from horizontal wells.

More particularly, embodiments of the present invention relate to methods, systems, and apparatuses for forming in situ gel pills or pigs to lift liquids from horizontal wells, where the methods include (1) injecting into a horizontal portion of a well a sufficient distance δ from a toe of the well a compositions capable of gelling under controlled conditions, (2) gelling the composition to form a gelled pill or pig, (3) using gas pressure from gas produced by the formation, from gas injected from the surface or a combination to gases from the formation or surface to push the pill or pig and accumulated liquids in front of the pill or pig through the horizontal portion of the well to the heal of the well, (4) breaking the gelled composition of the gelled pill or pig, and (5) lifting the composition and the liquids from a vertical portion of the well to facilitate gas production and reduce slugging. In certain, embodiments, the methods is repeated on a periodic, a semi-periodic, an intermittent, or an intermediate basis to keep the well in a desired non-slugging condition.

2. Description of the Related Art

To date there are a number of procedures to remove accumulated liquids (water, condensate, and/or oil) that accumulates in long substantially horizontal portion of a horizontal well. These methods include, for example, the use of velocity strings, foams, gas lifts, plunger lifts, hydraulic pistons, hydraulic jets, rod pumps, PC pumps, and ESP devices. However, all of these methods have definite disadvantages. The chemical foaming methods have difficulty assuring effective surfactant concentration across extended producing intervals. Gas lift methods become less effective as well pressures and flow velocities decline which often occurs rapidly in horizontal wells. Hydraulic jet methods and mechanical methods including rod pumps, progressing cavity pumps, electric submersible pumps, and hydraulic piston pumps all have single pump intakes which are inadequate in long horizontal runs which contain multiple liquid accumulation locations. Velocity strings are tuned to specific flow conditions and therefore must be replaced as the formation pressure and resulting flow velocities change.

Thus, there is a need in the art for methods, systems, and apparatuses that efficiently and effectively remove accumulated liquids from horizontal portions or sections of a well that is producing gas, where the methods are not based on gas lift, are not based on chemical foam, are not based on velocity, are not based on mechanical apparatuses, or are not based on hydraulic apparatuses.

SUMMARY OF THE INVENTION

Embodiments of the present invention provide methods for removing accumulated liquids from horizontal portions of a well. The methods include injecting a gelled or gellable composition into a horizontal portion of a well a sufficient distance δ from a toe end of the well, the toe section. After injection or during injection, the composition gels to form a gelled pill or pig at the start of the toe section—a sufficient distance δ from the toe of the well. After the gelled pill or pig is fully formed, gas pressure produced by the formation in the toe section, injected from the surface into the toe section, or a combination of produced and injected gases pushes the gelled pill or pig along the horizontal section sweeping accumulated liquids from the horizontal portion of the well into a heal section of the well. Once in the heal section, the composition and the accumulated liquids may be directly lifted to the surface under pressure sufficient to shear thin the gelled composition comprising the gelled pill or pig or the gelled composition comprising the gelled pill or pig may be broken to reduce its viscosity sufficient to lift the accumulated liquids and the broken gelled pill or pig. In certain, embodiments, the gelled compositions are either self-breaking (i.e., break over time) or have breaking agents in the composition that break the viscosity of the gelled composition as it traversed the horizontal section. After breaking, the broken composition and the accumulated liquids may be lifting from a vertical portion of the well to the surface. The methods are designed to clean horizontal section of the well of accumulating liquids to improve gas production, reduce slugging, and reduce accumulated liquids.

Embodiments of the present invention also provide systems for removing accumulated liquids from horizontal portions of a well. The systems include an injection system capable of injecting a gelled, gelling or gellable composition into a horizontal portion of a well a distance δ from a toe end of the well, the toe section. The distance δ from the toe end is a distance sufficiently removed from the toe of the well for either production gas, injected gas or a combination thereof to push the gelled compositions in the form of a pill or pig from the toe section along a horizontal section to the heal section for uplift to the surface along with any accumulated liquids in the horizontal section. In certain embodiments, the injection system may comprise a single tube capable of injecting a gelled, gelling or gellable composition into the toe section under controlled conditions. In other embodiments, the injection system includes a plurality of tubes, where one tube is used to inject a gellable composition and one tube is used to inject a crosslinking agent or a plurality of crosslinking agents. In other embodiments, the plurality of tubes also include a tube is used to inject a gas into the toe section to assist in pushing the gelled pill or pig through the horizontal section into the heal section of the well for uplift.

Embodiments of the present invention also provide compositions for forming gelled pills or pigs in horizontal sections of the well. The gellable compositions may be aqueous, non-aqueous or a mixture of aqueous and non-aqueous gellable compositions in the form of oil-in-water or water-in-oil emulsions or microemulsions. The compositions are designed to gel to produce a gelled pill or pig in a designated location in a horizontal portion of the well a sufficient distance δ from a toe end of the well so that the well produces sufficient gas to push the pill along the horizontal section to a heal portion of the well sweeping accumulated liquids or fluids in the horizontal portion into the heal portion, where the gelled pig or pill and the accumulated well fluids to the surface resulting in a cleaned horizontal section of the well may be lifted with or without breaking the gelled pill or pig. The compositions are designed to gel to form a gelled pill, where the pill may be homogeneously gelled using a gelling agent or a plurality of gelling agents uniformly distributed throughout the composition or heterogeneously gelled using a gelling agent or a plurality of gelling agents heterogeneously distributed throughout the composition.

BRIEF DESCRIPTION OF THE DRAWINGS

The invention can be better understood with reference to the following detailed description together with the appended illustrative drawings in which like elements are numbered the same.

DEFINITIONS USED IN THE INVENTION

Figure 1A:
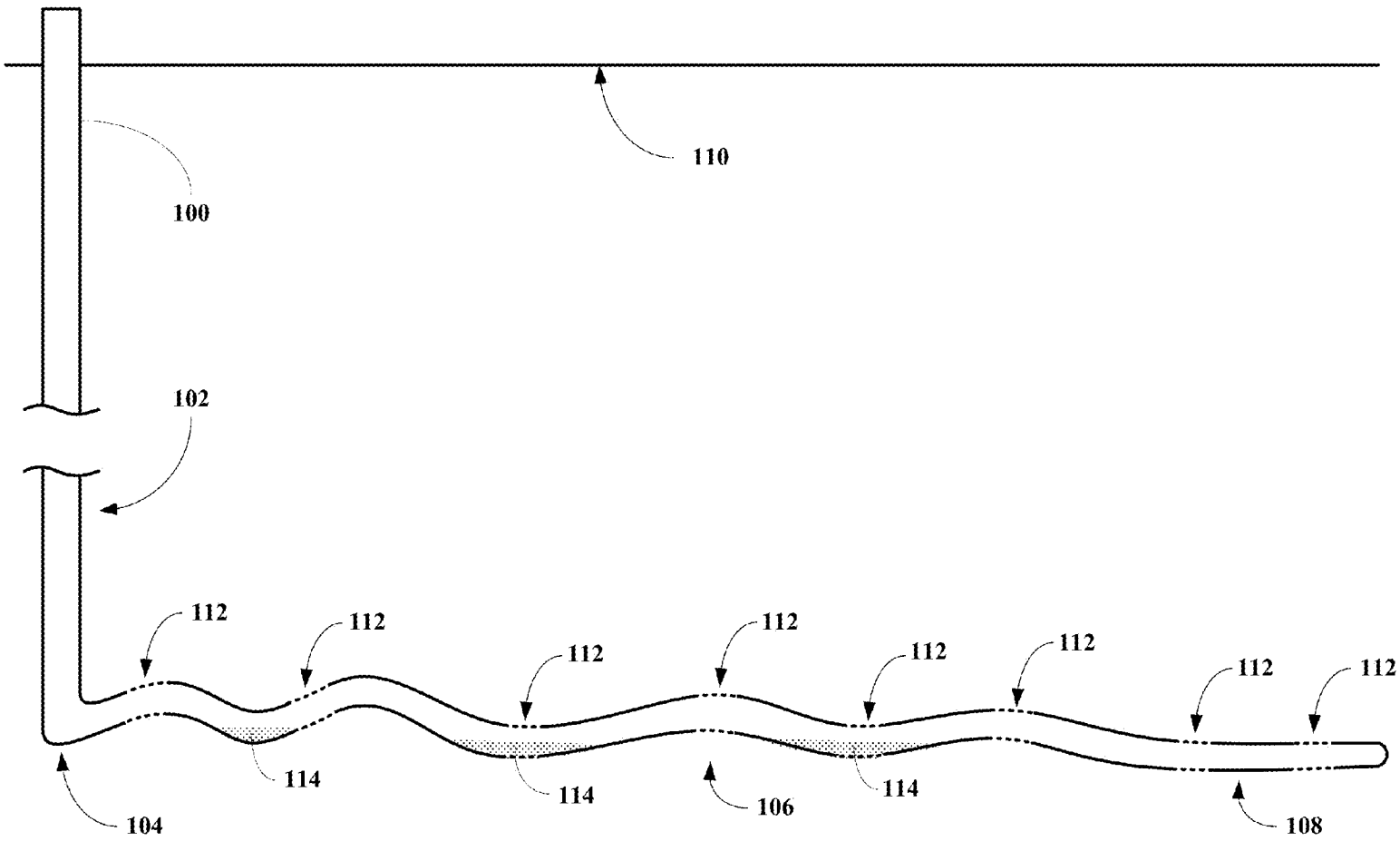
FIGS. 1A-H depict an embodiment of a method for clearing a horizontal section of a well of accumulated liquids using a gelled pill of this invention.

The term "substantially" means that the actual value is within about 5% of the actual desired value, particularly within about 2% of the actual desired value and especially within about 1% of the actual desired value of any variable, element or limit set forth herein.

The term "accumulated liquid or liquids, fluid or fluids" means water, condensate, and/or oil co-produced during gas production operations that accumulates in a horizontal section of a well extending through a producing formation, where the accumulated liquids or fluids reduce or inhibit gas production from the horizontal section of the well.

The term "gel" means compositions, aqueous or non-aqueous, including at least one gelled polymeric component.

The term "formate" means the salt of formic acid $HCOO^-$.

The term "metal ion formate salt" means the salt of formic acid $HCOOH^-$ $M^+$, where $M^+$ is a metal ion.

The term "gpt" means gallons per thousand gallons.

The term "ppt" means pounds per thousand gallons.

The term "HPG" means hydroxypropyl guar.

The term "CMHPG" means carboxymethylhydroxypropyl guar.

The term "horizontal" refers to lateral sections of a well which are at an angle of deviation equal to at least 45° from vertical.

The terms "produced and co-produced" refer to fluids, liquids and/or gases, that originate from the formation and/or which were injected from the surface and which are flowing back.

DETAILED DESCRIPTION OF THE INVENTION

The inventors have found that new methods for cleaning horizontal run sections of horizontal wells may be implemented by forming gelled pills or pigs in the horizontal sections a sufficient distance δ from a toe end of the well, called the toe section of the well, so that gases produced in this section will generate sufficient pressure to push the pill or pig along the horizontal section of the well into the heal section of the well. As the gelled pill or pig traverses the horizontal section of the well, it sweeps accumulated liquids in the horizontal section into the heal section in front of it. The gelled pill or pig and the accumulated liquids may then be directly uplifted from a vertical section of the well or the gelled pill or pig may be broken to decrease its viscosity for uplift from the well. The pills or pigs may have lengths of less than 1 foot up to 50 feet or more. The pills or pigs may be of any desired shape including substantially cylindrical to substantially spherical or any distortion thereof that is capable of being pushed down the horizontal portions of a well. The gelled compositions of the pills or pigs may be aqueous gelled compositions or non-aqueous gelled compositions or gelled water-in-oil emulsions or microemulsions or gelled oil-in-water emulsions or microemulsions. The compositions may be uniform or homogeneous or non-uniform or heterogeneous in viscosity and/or crosslink density.

Methods

Embodiments of the present invention broadly relate to methods for removing accumulated liquids from horizontal portions of a well. The methods include injecting a gelled or gellable composition into a horizontal portion of a well a sufficient distance δ from a toe end of the well, the toe section. After injection or during injection, the composition gels to form a gelled pill or pig at the start of the toe section. After the gelled pill or pig is fully formed, gas pressure produced by the formation in the toe section, injected from the surface into the toe section, or a combination of produced and injected gases pushes the gelled pill or pig along the horizontal section sweeping the accumulated liquids from the horizontal portion of the well into a heal section of the well. Once in the heal section, the composition and the accumulated liquids may be directly lifted to the surface under pressure sufficient to shear thin the gelled composition comprising the gelled pill or pig or the gelled composition may be broken to reduce its viscosity sufficient to lift the accumulated liquids and the broken gelled pill or pig. Alternatively, the gelled pill or pig does not shear thin, but remains as a gelled pill or pig in the vertical section of the well to act as a plunger lifting liquids to the surface, where it may then have a breaker added to reduce its viscosity. In certain, embodiments, the gelled compositions are either self-breaking (i.e., break over time) or have breaking agents in the composition that break the viscosity of the gelled composition as it traversed the horizontal section. After breaking, the broken composition and the accumulated liquids may be lifting from a vertical portion of the well to the surface. The methods are designed to clean horizontal sections of a wells to improve gas production, reduce slugging, and reduce accumulated liquids. In certain, embodiments, the methods is repeated on a periodic, semi-periodic or intermediate basis to keep the well at a desired non-slugging condition. In certain embodiments, the compositions are capable of being gelled under controlled conditions after injection into the toe section of the well. In other embodiments, the compositions are either partially or completely gelled as they are being injected into the toe section and completely gels in the well.

Systems

Embodiments of the present invention also broadly relates to systems for removing accumulated liquids from horizontal portions of a well. The systems include an injection system capable of injecting a gelled, gelling or gellable composition into a horizontal portion of a well a distance δ from a toe end of the well, the toe section. In certain embodiments, the distance δ from the toe end is sufficient for produced gas to push the gelled compositions from the toe section along a horizontal section to a heal section for uplift to the surface along with any accumulated liquids in the horizontal section. The exact measure of the distance δ will depend on the well and the production rate of gas in the toe section of the well. One of ordinary skill in the art will be able readily ascertain how far from the toe end of the well the gelled pill will need to be based on gas production rates from the toe section of the well. In certain embodiments, the injection system may comprise a single tube capable of injecting a gelled, gelling or gellable composition into under controlled conditions. In other embodiments, the injection system includes a plurality of tubes, where one tube is used to inject a gellable composition and one tube is used to inject a crosslinking agent or a plurality of crosslinking agents. In other embodiments, the plurality of tubes also include a tube used to inject a gas into the toe section to assist in pushing the gelled pill or pig through the horizontal section into the heal section of the well for uplift. In these gas assisted embodiments, the injected gas may include a small amount (less than 25%) of the total gas used to push the gelled pill or pig or it may represent a major portion (greater than 50%) of the total gas. In the gas assisted embodiments, the distance δ will not be dependent on produced gas and may therefore be a smaller distance than the distance δ would have to be if no gas is injected from the surface into the well such that the distance δ may be even zero—the composition is injected at the toe of the well. The type of gas injection into well may include production gas, natural gas, an inert gas (membrane nitrogen, argon, etc.) or other gases that would not adversely affect the well or production tubing. In other embodiments, the plurality of tubes may also include a tube used to inject a breaking agent into the gelled compositions. In these latter embodiments, the breaker line may be configured to inject breaking agents as the pill or pig traverses the horizontal section or the breaker line may be configured to inject the breaker only as the pill enters or approaches the heal section of the well. In other embodiments, the tubing may include ports that may be mechanically or electrically opened to permit material to be injected anywhere along the length of the tubing. In those systems where the tubing is permanent, the tubing will generally be capillary tubing. In those systems where the tubing in run into and tripped out of the well, the tubing may be capillary tubing or coiled tubing.

Pills or Pigs

Embodiments of the present invention also broadly relates to compositions for forming gelled pills or pigs in horizontal sections of the well. The gellable compositions may be aqueous, non-aqueous or a mixture of aqueous and non-aqueous gellable compositions in the form of oil-in-water or water-in-oil emulsions or microemulsions. The compositions are designed to gel to produce a gelled pill or pig in a designated location in a horizontal portion of the well a sufficient distance δ from the toe end of the well so that the well produces sufficient gas to push the pill along the horizontal section to the heal portion, where is may be directly lifted along with accumulated well fluids to the surface resulting in a cleaned horizontal section of the well. In certain embodiments, the gelled pills or pigs are broken using a breaking agent or they naturally break before uplift. The compositions are designed to gel to form a gelled pill or pig, where the pill or pig may be homogeneously gelled using a gelling agent or a plurality of gelling agents uniformly distributed throughout the composition or heterogeneously gelled using a gelling agent or a plurality of gelling agents heterogeneously distributed throughout the composition.

Embodiments of the present invention also broadly relates to gelled pills formed from the gelled compositions of this invention injected into the toe section of the well. The gelled pills or pigs of this invention will generally have a length or extent of tens of feet to less than a foot depending on the well and/or amount of accumulated liquids. In certain embodiments, the gelled pills or pigs will have a length of at foot or less. In certain embodiments, the gelled pills have a pill extent or length of at least 1 feet. In certain embodiments, the gelled pills have a pill extent or length of at least 5 feet. In other embodiments, the gelled pills have a pill extent or length of at least 10 feet. In other embodiments, the gelled pills have a pill extent or length of at least 15 feet. In other embodiments, the gelled pills have a pill extent or length of at least 20 feet. In other embodiments, the gelled pills have a pill extent or length of at least 25 feet. In other embodiments, the gelled pills have a pill extent or length of at least 30 feet. In other embodiments, the gelled pills have a pill extent or length of at least 35 feet. In other embodiments, the gelled pills have a pill extent or length of at least 40 feet. In other embodiments, the gelled pills have a pill extent or length of at least 45 feet. In other embodiments, the gelled pills have a pill extent or length of at least 50 feet.

In certain embodiments, the gelled pills are uniformly crosslinked gels, where the crosslinked gels have a viscosity of at least 200 cP at 40 $sec^{-1}$. In other embodiments, the crosslinked gels have a viscosity of at least 250 cP at 40 $sec^{-1}$. In other embodiments, the crosslinked gels have a viscosity of at least 300 cP at 40 $sec^{-1}$. In certain embodiments, the gelled pills are uniformly crosslinked gels, where the crosslinked gels have a viscosity of at least 350 cP at 40 $sec^{-1}$. In other embodiments, the crosslinked gels have a viscosity of at least 400 cP at 40 $sec^{-1}$. In other embodiments, the crosslinked gels have a viscosity of at least 450 cP at 40 $sec^{-1}$. In certain embodiments, the crosslinked gels have a viscosity of at least 500 cP at 40 $sec^{-1}$. In other embodiments, the crosslinked gels have a viscosity of at least 550 cP at 40 $sec^{-1}$. In other embodiments, the crosslinked gels have a viscosity of at least 600 cP at 40 $sec^{-1}$.

In certain embodiments, the gelled pills are heterogeneously crosslinked along the length of the pill, where the crosslink density is changed by changing the amount of crosslinking agents in the pill along its length. In other embodiments, the heterogeneity is such that the crosslink density decreases from a toe side of the pill to a heal side of the pill. In these heterogeneous gelled pills or pigs, a viscosity of a highest crosslinked portion of the heterogeneous gelled pill or pig is at least 200 cP at 40 $sec^{-1}$. In other embodiments, the viscosity of the highest crosslinked portion of the heterogeneous gelled pill is at least 250 cP at 40 $sec^{-1}$. In other embodiments, the viscosity of the highest crosslinked portion of the heterogeneous gelled pill is at least 300 cP at 40 $sec^{-1}$. In certain embodiments, the viscosity of the highest crosslinked portion of the heterogeneous gelled pill is at least 350 cP at 40 $sec^{-1}$. In other embodiments, the viscosity of the highest crosslinked portion of the heterogeneous gelled pill is at least 400 cP at 40 $sec^{-1}$. In other embodiments, the viscosity of the highest crosslinked portion of the heterogeneous gelled pill is at least 450 cP at 40 $sec^{-1}$. In certain embodiments, the viscosity of the highest crosslinked portion of the heterogeneous gelled pill is at least 500 cP at 40 $sec^{-1}$. In other embodiments, the viscosity of the highest crosslinked portion of the heterogeneous gelled pill is at least 550 cP at 40

$sec^{-1}$. In other embodiments, the viscosity of the highest crosslinked portion of the heterogeneous gelled pill is at least 600 cP at 40 $sec^{-1}$.

In certain embodiments, the pills or pigs comprise aqueous gels. In other embodiments, the pills or pigs comprise non-aqueous gels. In other embodiments, the pills or pigs comprise a blend of aqueous and non-aqueous gels. In wells that produce mainly water along with gas, the gelled pills will comprise aqueous gels comprising water, one or a plurality of hydratable polymers, and one or a plurality of hydratable polymer gelling agents. In wells that produce mainly hydrocarbon liquids along with the gas, the gelled pills will comprises non-aqueous gels comprising an organic solvent system, one or a plurality of organic soluble polymers and one or a plurality of crosslinking agents for the organic soluble polymer and/or one or a plurality of pre-crosslinked organically swellable polymers. In well the produce both water and hydrocarbon liquids along with gas, the gelled pills will comprises an oil-in-water emulsion/microemulsion including an aqueous gel distributed in an organic gel or a water-in-oil emulsion/microemulsion including an organic gel distributed in an aqueous gel. Again, the crosslinking density in the organic and aqueous gels may be varied as needed to achieve a desired viscosity in the gels or gel types. Of course, one of ordinary skill in the art will recognize that the pills or pigs may be aqueous, non-aqueous or oil-in-water or a water-in-oil emulsion/microemulsion depending on the well operator or on other considerations irrespective of the nature of the accumulated fluids.

Aqueous Systems

Water-base gelling systems are fluids including water-soluble polymers added to increase a viscosity of the fluid. Generally, the water-soluble polymers comprises guar gums, high-molecular weight polysaccharides composed of mannose and galactose sugars, or guar derivatives such as hydropropyl guar (HPG), hydroxypropylcellulose (HPC), carboxymethyl guar (CMG). carboxymethylhydropropyl guar (CMHPG). Although these viscosified aqueous fluids may be used as the pills, in many embodiments, the fluids generally will also include crosslinking agents based on boron, titanium, zirconium and/or aluminum complexes are typically used to increase the effective molecular weight of the polymer and make them better suited for use in high-temperature wells.

To a lesser extent, cellulose derivatives such as hydroxyethylcellulose (HEC) or hydroxypropylcellulose (HPC) and carboxymethylhydroxyethylcellulose (CMHEC) are also used, with or without crosslinkers. Xanthan and scleroglucan may also be used as well as polyacrylamide and polyacrylate polymers and copolymers. These latter polymers are particularly useful in high-temperature applications or as friction reducers at low concentrations for all temperatures.

The viscous pill fluids are generally composed of a polysaccharide or synthetic polymer in an aqueous solution which is crosslinked by an organometallic compound. The viscosity of certain pill fluids is generated from water-soluble polysaccharides, such as galactomannans or cellulose derivatives. Employing organometallic crosslinking agents, such as borate, titanate, or zirconium ions, can further increase the viscosity. The gelled fluids may include particulates that also act to increase fluid viscosity.

In other embodiments of gelled pills of this invention include a solvent, a polymer soluble or hydratable in the solvent, a crosslinking agent, an alkaline earth metal or a transition metal-based breaking agent, an optional ester of a carboxylic acid and choline carboxylate. The breaking agent may be magnesium peroxide, calcium peroxide, or zinc peroxide. The solvent may include water, and the polymer is hydratable in water. The solvent may be an aqueous potassium chloride solution. The hydratable polymer may be a polysaccharide.

In certain embodiments, the method comprises: formulating a gelling fluid comprising a solvent, a polymer soluble or hydratable in the solvent, a crosslinking agent, an inorganic breaking agent, a choline carboxylate and an optional ester compound; and injecting the gelling, gellable or gelled fluid into a horizontal section of the bore hole a sufficient distance δ from the toe, the section, to form a gelled pill. After gelled pill formation, gas pressure from gas produced in the toe section, from gas injected into the toe section from the surface or a combination of these gases will push the pill towards the heal of the borehole sweeping the accumulated fluids before the pill. Once the accumulated fluids and the pill arrive at the heal, the accumulated fluids and pill are then lifted to the surface. In certain, embodiments, the breaking agent is added to the pill once the pill arrives in the heal. In other embodiments, the breaking agent may be timed to being breaking the pill as it enters or after it enters the heal. The pill may have a pH greater than or equal to pH 7. In certain embodiments, the gelled pill has a pH in the range of about pH 8 to about pH 12. The inorganic breaking agent may be a metal-based oxidizing agent. The metal may be an alkaline earth metal or a transition metal. The inorganic breaking agent may be magnesium peroxide, calcium peroxide, or zinc peroxide. The optional ester compound may be an ester of an polycarboxylic acid, such as an ester of oxalate, citrate, or ethylene diamine tetraacetate. In other embodiments, the solvent includes water, and the polymer is a water soluble polysaccharide, such as galactomannan, cellulose, or derivatives thereof. The solvent may be an aqueous potassium chloride solution. The crosslinking agent may be a borate, titanate, or zirconium-containing compound. The gelled pill may further include sodium thiosulfate.

In other embodiments, the gellable fluids comprise a solvent (such as water), a polymer soluble or hydratable in the solvent, a crosslinking agent, an inorganic breaking agent, a choline carboxylate of and an optional ester compound. The gellable compositions may also include various other fluid additives, such as pH buffers, biocides, stabilizers, mutual solvents, and surfactants designed to prevent emulsion with formation fluids, to reduce surface tension, and/or to enhance load recovery. The well treatment fluid composition may also contain one or more salts, such as potassium chloride, magnesium chloride, sodium chloride, calcium chloride, tetramethyl ammonium chloride, and mixtures thereof. It is found that a gelled pills made in accordance with these embodiments exhibit reduced or minimal premature breaking and break completely or substantially completely after a well treatment is finished.

In other embodiments, aqueous gellable fluids may be prepared by blending a hydratable polymer with an aqueous base fluid. The base aqueous fluid may be, for example, water or brine. Any suitable mixing apparatus may be used for this procedure. In the case of batch mixing, the hydratable polymer and aqueous fluid are blended for a period of time which is sufficient to form a hydrated sol. This mixing may occur prior to introducing the fluid into the well, as the fluid is being introduced into the well, and/or after the fluid is introduced into the well.

The pH of an aqueous fluid which contains a hydratable polymer can be adjusted if necessary to render the fluid compatible with a crosslinking agent. Preferably, a pH adjusting material is added to the aqueous fluid after the addition of the polymer to the aqueous fluid. Typical materials for adjusting the pH are commonly used acids, acid buffers, and mixtures of acids and bases. For example, sodium bicarbonate, potassium carbonate, sodium hydroxide, potassium hydroxide, and sodium carbonate are typical pH adjusting agents. Acceptable pH values for the fluid may range from neutral to basic, i.e., from about 5 to about 14. Preferably, the pH is kept neutral or basic, i.e., from about 7 to about 14, more preferably between about 8 to about 12.

Generally, the temperature and the pH of the fluids affect the rate of hydrolysis of an ester. For downhole operations, the bottom hole static temperature ("BHST") cannot be easily controlled or changed. The pH of the fluids usually is adjusted to a level to assure proper fluid performance during the well cleaning or during the traversal of the gelled pills or pigs through the horizontal section. Therefore, the rate of hydrolysis of an ester is not be easily changed by altering BHST or the pH of the fluids. However, the rate of hydrolysis may be controlled by the amount of an ester used in the fluids. For higher temperature applications, the hydrolysis of an ester may be retarded or delayed by dissolving the ester in a hydrocarbon solvent. Moreover, the delay time may be adjusted by selecting esters that provide more or less water solubility. For example, for low temperature applications, polycarboxylic esters made from low molecular weight alcohols, such as methanol or ethanol, are recommended. The application temperature range for these esters could range from about 120° F. to about 250° F. (about 49° C. to about 121° C.). On the other hand, for higher temperature applications or longer injection times, esters made from higher molecular weight alcohols should preferably be used. The higher molecular weight alcohols include, but are not limited to, $C_3$-$C_6$ alcohols, e.g., n-propanol, hexanol, and cyclohexanol.

In some embodiments, esters of citric acid are used in formulating a well treatment fluid. A preferred ester of citric acid is acetyl triethyl citrate, which is available under the trade name Citraflex A2 from Morflex, Inc., Greensboro, N.C.

In certain embodiments, the fluid may include particulate materials added to the fluids prior to the addition of a crosslinking agent. However, particulate materials may be introduced in any manner which achieves the desired result. Any particulate material may be used in embodiments of the invention. Examples of suitable particulate materials include, but are not limited to, quartz sand grains, glass and ceramic beads, walnut shell fragments, aluminum pellets, nylon pellets, and the like. Particulate materials are typically used in concentrations between about 1 lb/gal to 8 lb/gal base on the fluid, although higher or lower concentrations may also be used as desired. The fluid may also contain other additives, such as surfactants, corrosion inhibitors, mutual solvents, stabilizers, paraffin inhibitors, tracers to monitor pill progress through the horizontal section and into the heal section of the well, and so on.

The methods include formulating a fluid comprising an aqueous solution, a hydratable polymer, a crosslinking agent, an inorganic breaking agent, and an ester compound; and injecting the fluid into a bore hole leaving a toe section having adequate length so that produced gases can push the fluid the length of the horizontal section. Initially, the viscosity of the fluids may be maintained above at least 200 cP at 40 $sec^{-1}$ during injection, traversal through the horizontal section of the well and, after arriving in the heal section of the well, the fluid's viscosity should be reduced to less than 200 cP at 40 $sec^{-1}$. After the viscosity of the fluid is lowered to an acceptable level, the fluid and the accumulated liquids may be lifted from the heal section to the surface resulting in a cleaned or substantially cleaned horizontal section. In certain embodiments, the fluids have a pH around or above about 7, and in other embodiments, the pH range is from about 8 to about 12. The pH of the fluid can generally be any pH compatible with downhole formations. The pH is presently preferred to be about 6.5 to about 10.0. The pH can be about the same as the formation pH.

The liquid carrier can generally be any liquid carrier suitable for use in oil and gas producing wells. A presently preferred liquid carrier is water. The liquid carrier may comprise water, may consist essentially of water, or may consist of water. Water will typically be a major component by weight of the aqueous fluids. The water may be potable or non-potable water. The water may be brackish or contain other materials typical of sources of water found in or near oil fields. For example, it is possible to use fresh water, brine, or even water to which any salt, such as an alkali metal, alkali earth metal salt ($NaCO_3$, NaCl, KCl, etc.), formates, phosphates, nitrogen or other salts may be added. The liquid carrier may be present in an amount of at least about 80% by weight. In other embodiments, the carriers may include amounts of liquid carrier from 80%, 85%, 90%, and 95% by weight. The carrier liquid may be a VAS gel.

The fluid can further comprise one or more additives. The fluid can further comprise a base. The fluid can further comprise a salt. The fluid can further comprise a buffer. The fluid can further comprise a relative permeability modifier. The fluid can further comprise methylethylamine, monoethanolamine, triethylamine, triethanolamine, sodium hydroxide, potassium hydroxide, potassium carbonate, sodium chloride, potassium chloride, potassium fluoride, $KH_2PO_4$, or $K_2HPO_4$. The fluid may further comprise a particulate materials such as sand, resin coated sand sintered bauxite and similar materials, where the particulate materials may be suspended in the fluid.

The fluids used as to form gelled pills or pigs may be aqueous based fluids that have been "viscosified" or thickened by the addition of a natural or synthetic polymer (cross-linked or uncross-linked). The carrier fluid is usually water or a brine (e.g., dilute aqueous solutions of sodium chloride and/or potassium chloride). The viscosifying polymer is typically a solvatable (or hydratable) polysaccharide, such as a galactomannan gum, a glycomannan gum, or a cellulose derivative. Examples of such polymers include guar, hydroxypropyl guar, carboxymethyl guar, carboxymethylhydroxyethyl guar, hydroxyethyl cellulose, carboxymethyl-hydroxyethyl cellulose, hydroxypropyl cellulose, xanthan, polyacrylamides and other synthetic polymers. Of these, guar, hydroxypropyl guar and carboxymethlyhydroxyethyl guar are typically preferred because of commercial availability and cost performance.

In many instances, if not most, the viscosifying polymer is crosslinked with a suitable crosslinking agent. The crosslinked polymer has an even higher viscosity and is even more effective in acting as gelled pills or pigs to remove accumulated liquids from horizontal sections of wells. The borate ion has been used extensively as a crosslinking agent, typically in high pH fluids, for guar, guar derivatives and other galactomannans. See, for example, U.S. Pat. No. 3,059,909, incorporated herein by reference and numerous other patents that describe this classic aqueous gel which may be used to prepare gelled pills or pigs for sweeping accumulated liquids from horizontal sections of wells. Other crosslinking agents include, for example, titanium crosslinkers (U.S. Pat. No. 3,888,312, incorporated herein by reference), chromium, iron, aluminum, and zirconium (U.S. Pat. No. 3,301,723, incorporated herein by reference). Of these, the titanium and zirconium crosslinking agents are typically preferred. Examples of commonly used zirconium crosslinking agents include zirconium triethanolamine complexes, zirconium acetylacetonate, zirconium lactate, zirconium carbonate, and chelants of organic alphahydroxycorboxylic acid and zirconium. Examples of commonly used titanium crosslinking agents include titanium triethanolamine complexes, titanium acetylacetonate, titanium lactate, and chelants of organic alphahydroxycorboxylic acid and titanium.

As mentioned, the pre-gel fluid suspension formed in the invention maybe foamed, normally by use of a suitable gas. Foaming procedures are well known, and per se form no part of the invention. In such instances, the fluids of the invention will preferably include a surfactant or surfactants. Preferred surfactants are water-soluble or dispersible and have sufficient foaming ability to enable the composition, when traversed or agitated by a gas, to foam. The selection of a suitable surface active agent or agents, is within the ability of those skilled in the art. Preferred surfactants are those which, when incorporated into water in a concentration of about 5 weight percent or less (based on the total weight of water and surfactant), meet the test described in the aforementioned U.S. Pat. No. 5,246,073, incorporated herein by reference.

The present invention provides a cross-linking composition for hydratable polymer including a reaction product of a transition metal alkoxide and a borate compound or a borate generating compound. The cross-linking system is designed to cross-link a hydratable polymer or mixture of hydratable polymers to produce a cross-linked polymeric material having improved cross-link uniformity, cross-link stability and rate of cross-link formation. The transition metal is selected from the group consisting of Ti, Zr, Hf and mixtures and combinations thereof. The reaction products can be designed with a desired cross-linking delay and at the same time improve cross-link uniformity and stability.

The present invention provides a gellable, gelling or gelled fluid including a hydratable polymer system and a cross-linking system having a reaction product of a transition metal alkoxide and a borate compound or a borate generating compound. The cross-linking system is designed to cross-link the hydratable polymer(s) in the hydratable polymer system to produce a cross-linked polymeric material having improved cross-link uniformity, cross-link stability and rate of cross-link formation.

The present invention provides a method for cross-linking a hydratable polymer system including the step of adding an effective amount of a cross-linking system including a borate generating compound and a transition metal alkoxide or alkanolate (these terms are used interchangeably and represent the group —OR, where R is a carbyl group). The effective amount is sufficient to cross-link the hydratable polymer in the hydratable polymer system to a desired degree, where the cross-linking system results in shorter viscosity build up times compared to other boron-zirconium cross-linking systems and has improved cross-link uniformity, cross-link stability and rate of cross-link formation. The transition metal is selected from the group consisting of Ti, Zr, Hf and mixtures and combinations thereof.

The present invention provides a method for sweeping accumulated liquids from horizontal section of a well including the step of injecting a gellable, gelling or gelled fluid including a hydratable polymer system and a cross-linking system having a reaction product of a transition metal alkoxide and a borate compound or a borate generating compound into a horizontal section fo a well so that gas pressures form the formation, from the surface or a combination thereof pushes the gelled pill or pig through the horizontal section of well sweeping the accumulated liquids to the heal section for uplift from the vertical section of the well.

The present invention provides a method for sweeping accumulated liquids from horizontal section of a well including the step of injecting a gellable, gelling or gelled fluid including a hydratable polymer system and a cross-linking system having a reaction product of a transition metal alkoxide and a borate compound or a borate generating compound into a horizontal section fo a well so that gas pressures form the formation, from the surface or a combination thereof pushes the gelled pill or pig through the horizontal section of well sweeping the accumulated liquids to the heal section for uplift from the vertical section of the well. A breaker may be injected into the gelled pill or pig as it traverses the horizontal section of the well, as it enters the heal section of the well, or once in the heal section of the well to break the cross-links in the gelled pill or pig.

The inventors have found that a new cross-linking system can be produced, where the cross-linking agent is a reaction product of a borate-generating compound and a zirconium alkoxide. The mole ratio of boron to zirconium can be tuned to afford a desired cross-link density and a desired cross-linking delay time. The inventors have found that the reaction products of this invention produce cross-linked polymeric systems that have improved uniformity of cross-linking at a given cross-link density and result in a faster cross-linking process compared to other boron-zirconium cross-linking systems. The inventors have found that these borate generating compound/zirconium alkoxide reaction products are ideally suited for use in gelled pills or pigs of this invention, where cross-linking rate and cross-linking uniformity are characteristic used to control the properties and efficiencies of the gelled pills or pigs. The cross-linking systems of this invention may be used in any gelled pills or pigs to sweep accumulated liquids from horizontal sections of wells. The inventors have found that the cross-linking systems of this invention are especially well suited for gelled pills or pigs in high pH environments.

The present invention broadly relates to a cross-linking composition for hydratable polymer including a reaction product of a transition metal alkoxide and a borate compound or a borate generating compound. The cross-linking system is designed to cross-link a hydratable polymer or mixture of hydratable polymers to produce a cross-linked polymeric material having improved cross-link uniformity, cross-link stability and rate of cross-link formation. The transition metal is selected from the group consisting of Ti, Zr Hf and mixtures and combinations thereof.

The present invention broadly relates to gelled pills or pigs of this invention including a hydratable polymer system and a cross-linking system of this invention and to method for sweeping accumulated liquids from horizontal sections of wells using a gellable, gelling or gelled fluids including a hydratable polymer system and a cross-linking system.

The inventor has found that a new surfactant water gellant may be prepared having a desired higher viscosity by the addition of a small amount of a phosphorus-containing compound, than in the absence of a phosphorus-containing compound. The phosphorus-containing compound can be added to adjust the gellation rate, to increase the build up of viscosity, to increase the final viscosity of the gelled system and to modify gellant properties. The inventor has also found that the phosphorus-containing compound increases the viscosity of the gellant at low dosages up to as much as 3 times the amount of viscosity as measured in centipoise as compared to the gellant in the absence of the phosphorus-containing compound.

The compositions of this invention relates broadly to a gelling composition: (a) a cationic or anionic polymer, (b) a lesser amount of an oppositely charged surfactant, in a ratio to provide a Zeta Potential of 20 millivolts or higher, or −20 millivolts or lower, (c) a small amount of a hydrophobic alcohol having 6 to 23 carbon atoms and (d) an effective amount of a phosphorus-containing compound sufficient to improve gel viscosity, to improve gel, reduce a gel time, and improve gel stability. In certain embodiments, the composition also includes a small amount of a gel promoter comprising one or more of (e) an amphoteric surfactant and/or (f) an amine oxide surfactant, while maintaining the same limits of Zeta Potential.

Viscoelastic Surfactant System

Polymer-free, water-base high viscosity fluids may also be obtained using viscoelastic surfactants. These fluids are normally prepared by mixing appropriate amounts of suitable surfactants such as anionic, cationic, nonionic and zwitterionic surfactants into an aqueous fluid. The viscosity of viscoelastic surfactant fluids is attributed to the three dimensional structure formed by the components in the fluids. When the concentration of surfactants in a viscoelastic fluid significantly exceeds a critical concentration, and in most cases in the presence of an electrolyte, surfactant molecules aggregate into species such as micelles, which can interact to form a network exhibiting viscous and elastic behavior.

In certain embodiments of gelled pills of this invention include a solvent, a polymer soluble or hydratable in the solvent, a crosslinking agent, an inorganic breaking agent, and other optional components such as ester compounds and choline carboxylates. In aqueous embodiments, the solvent includes water, and the polymers are hydratable in water. The solvent may be an aqueous potassium chloride solution. The inorganic breaking agent may be a metal-based oxidizing agent, such as an alkaline earth metal or a transition metal. The inorganic breaking agent may be magnesium peroxide, calcium peroxide, or zinc peroxide. The ester compound may be an ester of a polycarboxylic acid. For example, the ester compound may be an ester of oxalate, citrate, or ethylene diamine tetraacetate. The ester compound having hydroxyl groups can also be acetylated. An example of this is that citric acid can be acetylated to form acetyl triethyl citrate. A presently preferred ester is acetyl triethyl citrate. The hydratable polymer may be a water soluble polysaccharide, such as galactomannan, cellulose, or derivatives thereof. The crosslinking agent may be a borate, titanate, or zirconium-containing compound. For example, the crosslinking agent can be sodium borate×$H_2O$ (varying waters of hydration), boric acid, borate crosslinkers (a mixture of a titanate constituent, preferably an organotitanate constituent, with a boron constituent. The organotitanate constituent can be TYZOR® titanium chelate esters from E.I. du Pont de Nemours & Company. The organotitanate constituent can be a mixture of a first organotitanate compound having a lactate base and a second organotitanate compound having triethanolamine base. The boron constituent can be selected from the group consisting of boric acid, sodium tetraborate, and mixtures thereof. Certain crosslinking agents also include borate based ores such as ulexite and colemanite, Ti(IV) acetylacetonate, Ti(IV) triethanolamine, Zr lactate, Zr triethanolamine, Zr lactate-triethanolamine, or Zr lactate-triethanolamine-triisopropanolamine. In some embodiments, the well treatment fluid composition may further comprise a proppant.

Features of the Compositions

Although we prefer to use polymers of diallyl dimethyl ammonium chloride and particularly its homopolymers where cationic polymers are used in our invention, we may use any water soluble cationic polymer effective to viscosify water. Preferably the polymers will have a molecular weight of at least 10,000. Such polymers include homopolymers and copolymers made with cationic monomers (that is, at least 20% of the mer units contain cationic functional groups, while the balance may be nonfunctional or nonionic) such as diallyldimethylammonium chloride, methacrylamidopropyltrimethyl ammonium chloride, acryloyloloxyethyltrimet-hylammonium chloride, diallyl diethylammonium chloride, methacryloyoloxyethyltrimethyl ammonium chloride, vinyl pyridine, and vinyl benzyltrimethyl ammonium chloride.

In certain embodiments, the anions for association with the quaternized nitrogen atoms are halide anions, such as chloride ions, that readily dissociate in the aqueous drilling or other formation treatment fluid, but any anions, including formate anions, may be used which will not interfere with the purposes of the formation treatment. Persons skilled in the art may wish to review the various anions mentioned in the above incorporated patents.

Thus, it is seen that a cationic formation control additive useful in my invention is a material having from one to hundreds or thousands of cationic sites, generally either amines or quaternized amines, but may include other cationic or quaternized sites such as phosphonium or sulfonium groups.

In the present invention, the inventor employs a choline compound and an amine, phosphine or sulfide and/or a cationic formation control additive with or without a formate salt such as potassium formate. The choline compound and the formate compound may be added to the formation treating or drilling fluid before or after the amine, phosphine or sulfide and/or cationic formation control additive. The potassium formate maybe added to the formation treating or drilling fluid before or after the cationic formation control additive, or may be made in situ by the reaction of potassium hydroxide and formic acid. The potassium hydroxide and formic acid may be added in any order, separately or together, before or after the addition of the cationic formation control additive, and need not be added in exact molar proportions. Any effective amount of the combination of a choline compound and formation control additives (amines, phosphines, or sulfides and/or cationic formation control additives) may be used, but in certain embodiments, the ratios of a choline compound to formation control additive with or without potassium formate of 25:75 to 75:25 by weight in the solution, in combined concentrations of at least 0.001% by weight in the drilling or other formation treatment fluid. In certain embodiments, the additive package to the fluid is between about 0.05 wt. % and about 5 wt. %.

Cross-linking System Compositional Ranges

The cross-linking compositions of this invention generally have a mole ratio of a borate of a borate generating compound and a transition metal alkoxide between about 10:1 and about 1:10. In certain embodiments, the mole ratio is between about 5:1 and about 1:5. In other embodiments, the mole ratio is between about 4:1 and 1:4. In other embodiments, the mole ratio is between about 3:1 and 1:3. In other embodiments, the mole ratio is between about 2:1 and 1:2. And, in other embodiments, the mole ratio is about 1:1. The exact mole ratio of the reaction product will depend somewhat on the conditions and system to which the composition is to be used as will be made more clear herein. While the cross-linking systems of this invention includes at least one cross-linking agent of this invention, the systems can also include one or more conventional cross-linking agents many of which are listed herein below.

Fluid Compositional Ranges

The cross-linking system of this invention is generally used in and amount between about 0.1 GAL/MBAL (gallons per thousand gallons) and about 5.0 GAL/MGAL. In certain embodiments, the cross-linking system is used in an amount between about 0.5 GAL/MGAL and about 4.0 GAL/MGAL. In other embodiments, the cross-linking system is used in an amount between about 0.7 GAL/MGAL and about 3.0 GAL/MGAL. In other embodiments, the cross-linking system is used in an amount between about 0.8 GAL/MGAL and about 2.0 GAL/MGAL. In other embodiments, the cross-linking system is used in an amount between about 1.0 GAL/MGAL and about 5.0 GAL/MGAL. In other embodiments, the cross-linking system is used in an amount between about 1.0 GAL/MGAL and about 4.0 GAL/MGAL. In other embodiments, the cross-linking system is used in an amount between about 1.0 GAL/MGAL and about 3.0 GAL/MGAL. In other embodiments, the cross-linking system is used in an amount between about 1.0 GAL/MGAL and about 2.0 GAL/MGAL.

Breakers

The recovery of the viscosified fluids is accomplished by reducing the viscosity of the fluids to a lower value such that it flows naturally and may be lifted from the heal of the well to the surface. This viscosity reduction or conversion is referred to as "breaking" and can be accomplished by incorporating chemical agents, referred to as "breakers," into the gelled fluids or subsequently injecting a breaker into the gelled fluid to facilitate viscosity breaking.

Certain embodiments include gelled fluid based upon guar polymers, which undergo a natural break process without the intervention of a breaking agent. However, the breaking time for such gelled fluids generally is excessive and impractical, being somewhere in the range from greater than 24 hours to in excess of weeks, months, or years depending on reservoir conditions. Accordingly, to decrease the break time of gelled fluids, chemical agents are usually incorporated into the gelled fluids and become a part of the gelled fluids itself or make be added to the gelled fluids subsequently to break the viscosity of the gelled fluids. Typically, these agents are either oxidants or enzymes, which operate to degrade the polymeric gel structure. Most degradation or "breaking" is caused by oxidizing agents, such as persulfate salts (used either as is or encapsulated), chromous salts, organic peroxides or alkaline earth or zinc peroxide salts, or by enzymes.

In addition to the importance of providing a breaking mechanism for the gelled fluid to facilitate recovery of the fluid and to resume well production, the timing of the break is also of great importance. Gels, which break prematurely, may result in incomplete removal of accumulated liquids in horizontal sections of the well. Premature breaking may also lead to a premature reduction in the fluid viscosity, resulting in a less effective accumulated liquid removal.

On the other hand, gelled fluids which break too slowly may impair the removal of the accumulated liquids and the gelled pill from the heal of the well delaying gas and hydrocarbon production. In certain embodiments, the gelled pill should begin to break, when the pill has traversed the horizontal section and accumulated in the heal section of the well. Of course, the timing will depend on the length of the horizontal section, on the diameter of the tubing in the horizontal section, on the gas pressure on the toe side of the gelled pill and on the size of the heal section.

"Premature breaking" as used herein refers to a phenomenon in which a gel viscosity becomes diminished to an undesirable extent before all of the accumulated liquids are swept from the horizontal section of the borehole. Thus, to be satisfactory, the gel viscosity should preferably remain in the range from about 50% to about 75% of the initial viscosity of the gel for at least two hours of exposure to the expected operating temperature. In certain embodiments, the fluid should have a viscosity in excess of 100 centipoise (cP) at 100 $sec^{-1}$ measured on a Fann 50 C viscometer in the laboratory.

"Complete breaking" as used herein refers to a phenomenon in which the viscosity of a gel is reduced to such a level that the gel can be flushed from the formation by the flowing formation fluids or that it can be recovered by a swabbing operation. In laboratory settings, a completely broken, non-crosslinked gel is one whose viscosity is about 10 cP or less as measured on a Model 35 Fann viscometer having a R1B1 rotor and bob assembly rotating at 300 rpm.

The term "breaking agent" or "breaker" refers to any chemical that is capable of reducing the viscosity of a gelled fluid. As described above, after a fluid is formed and pumped into a horizontal section of the well, it is generally desirable to convert the highly viscous gel to a lower viscosity fluid. This allows the fluid to be easily and effectively removed from the formation and to allow desired material, such as oil or gas, to flow into the well bore. This reduction in viscosity of the treating fluid is commonly referred to as "breaking" Consequently, the chemicals used to break the viscosity of the fluid is referred to as a breaking agent or a breaker.

There are various methods available for breaking a gelled pill or pig. Typically, fluids break after the passage of time and/or prolonged exposure to high temperatures. However, it is desirable to be able to predict and control the breaking within relatively narrow limits. Mild oxidizing agents are useful as breakers when a fluid is used in a relatively high temperature formation, although formation temperatures of 300° F. (149° C.) or higher will generally break the fluid relatively quickly without the aid of an oxidizing agent.

Examples of inorganic breaking agents for use in this invention include, but are not limited to, persulfates, percarbonates, perborates, peroxides, perphosphates, permanganates, etc. Specific examples of inorganic breaking agents include, but are not limited to, alkaline earth metal persulfates, alkaline earth metal percarbonates, alkaline earth metal perborates, alkaline earth metal peroxides, alkaline earth metal perphosphates, zinc salts of peroxide, perphosphate, perborate, and percarbonate, and so on. Additional suitable breaking agents are disclosed in U.S. Pat. Nos. 5,877,127; 5,649,596; 5,669,447; 5,624,886; 5,106,518; 6,162,766; and 5,807,812, incorporated herein by reference. In some embodiments, an inorganic breaking agent is selected from alkaline earth metal or transition metal-based oxidizing agents, such as magnesium peroxides, zinc peroxides, and calcium peroxides.

In addition, enzymatic breakers may also be used in place of or in addition to a non-enzymatic breaker. Examples of suitable enzymatic breakers such as guar specific enzymes, alpha and beta amylases, amyloglucosidase, aligoglucosidase, invertase, maltase, cellulase, and hemi-cellulase are disclosed in U.S. Pat. Nos. 5,806,597 and 5,067,566, incorporated herein by reference.

A breaking agent or breaker may be used "as is" or be encapsulated and activated by a variety of mechanisms including crushing by formation closure or dissolution by formation fluids. Such techniques are disclosed, for example, in U.S. Pat. Nos. 4,506,734; 4,741,401; 5,110,486; and 3,163,219, incorporated herein by reference.

Suitable ester compounds include any ester which is capable of assisting the breaker in degrading the viscous fluid in a controlled manner, i.e., providing delayed breaking initially and substantially complete breaking after well treatment is completed. An ester compound is defined as a compound that includes one or more carboxylate groups: R—COO—, wherein R is phenyl, methoxyphenyl, alkylphenyl, $C_1$-$C_{11}$ alkyl, $C_1$-$C_{11}$ substituted alkyl, substituted phenyl, or other organic radicals. Suitable esters include, but are not limited to, diesters, triesters, etc.

An ester is typically formed by a condensation reaction between an alcohol and an acid by eliminating one or more water molecules. Preferably, the acid is an organic acid, such as a carboxylic acid. A carboxylic acid refers to any of a family of organic acids characterized as polycarboxylic acids and by the presence of more than one carboxyl group. In additional to carbon, hydrogen, and oxygen, a carboxylic acid may include heteroatoms, such as S, N, P, B, Si, F, Cl, Br, and I. In some embodiments, a suitable ester compound is an ester of oxalic, malonic, succinic, malic, tartaric, citrate, phthalic, ethylenediaminetetraacetic (EDTA), nitrilotriacetic, phosphoric acids, etc. Moreover, suitable esters also include the esters of glycolic acid. The alkyl group in an ester that comes from the corresponding alcohol includes any alkyl group, both substituted or unsubstituted. Preferably, the alkyl group has one to about ten carbon atoms per group. It was found that the number of carbon atoms on the alkyl group affects the water solubility of the resulting ester. For example, esters made from $C_1$-$C_2$ alcohols, such as methanol and ethanol, have relatively higher water solubility. Thus, application temperature range for these esters may range from about 120° F. to about 250° F. (about 49° C. to about 121° C.). For higher temperature applications, esters formed from $C_3$-$C_{10}$ alcohols, such as n-propanol, butanol, hexanol, and cyclohexanol, may be used. Of course, esters formed from $C_{11}$ or higher alcohols may also be used. In some embodiments, mixed esters, such as acetyl methyl dibutyl citrate, may be used for high temperature applications. Mixed esters refer to those esters made from polycarboxylic acid with two or more different alcohols in a single condensation reaction. For example, acetyl methyl dibutyl citrate may be prepared by condensing citric acid with both methanol and butanol and then followed by acylation.

Specific examples of the alkyl groups originating from an alcohol include, but are not limited to, methyl, ethyl, propyl, butyl, iso-butyl, 2-butyl, t-butyl, benzyl, p-methoxybenzyl, methoxybenxyl, chlorobenzyl, p-chlorobenzyl, phenyl, hexyl, pentyl, etc. Specific examples of suitable ester compounds include, but are not limited to, triethyl phosphate, diethyl oxalate, dimethyl phthalate, dibutyl phthalate, diethyl maleate, diethyl tartrate, 2-ethoxyethyl acetate, ethyl acetylacetate, triethyl citrate, acetyl triethyl citrate, tetracyclohexyl EDTA, tetra-1-octyl EDTA, tetra-n-butyl EDTA, tetrabenzyl EDTA, tetramethyl EDTA, etc. Additional suitable ester compounds are described, for example, in the following U.S. Pat. Nos. 3,990,978; 3,960,736; 5,067,556; 5,224,546; 4,795,574; 5,693,837; 6,054,417; 6,069,118; 6,060,436; 6,035,936; 6,147,034; and 6,133,205, incorporated herein by reference.

When an ester of a polycarboxylic acid is used, total esterification of the acid functionality is preferred, although a partially esterified compound may also be used in place of or in addition to a totally esterified compound. In these embodiments, phosphate esters are not used alone. A phosphate ester refers to a condensation product between an alcohol and a phosphorus acid or a phosphoric acid and metal salts thereof. However, in these embodiments, combination of a polycarboxylic acid ester with a phosphate ester may be used to assist the degradation of a viscous gel.

When esters of polycarboxylic acids, such as esters of oxalic, malonic, succinic, malic, tartaric, citrate, phthalic, ethylenediaminetetraacetic (EDTA), nitrilotriacetic, and other carboxylic acids are used, it was observed that these esters assist metal based oxidizing agents (such as alkaline earth metal or zinc peroxide) in the degradation of gelled pills or pigs. It was found that the addition of 0.1 gal/Mgal (0.1 $l/m^3$) to 5 gal/Mgal (5 $l/m^3$) of these esters significantly improves the degradation of the gelled pills or pigs. More importantly, the degradation response is delayed, allowing the gelled pills or pigs ample time to traverse the horizontal section prior to the degradation reactions. The delayed reduction in viscosity is likely due to the relatively slow hydrolysis of the ester, which forms polycarboxylate anions as hydrolysis products. These polycarboxylate anions, in turn, improve the solubility of metal based oxidizing agents by sequestering the metal associated with the oxidizing agents. This may have promoted a relatively rapid decomposition of the oxidizing agent and caused the gelled pill or pig degradation.

Suitable Reagents

Alkoxides or Alkanolates

Suitable alkoxides used in the metal alkoxides that are reacted with the borate or borate forming reagent include, without limitation, a linear or branched, saturated or unsaturated carbyl group bonded to an oxygen atom of the general formula OR, where R is the carbyl group. The carbyl group includes from 1 to 40 carbon atoms and sufficient hydrogen atoms to satisfy the valence requirement, where one or more carbon atom can be replaced by B, N, O, Si, S, P, Ge, Ga or the like, and one or more hydrogen atoms are replaced with monovalent atoms or group including F, Cl, Br, I, OH, SH, $NH_2$, NR'H, $NR'_2$, COOR, CHO, $CONH_2$, CONR'H, $CONR'_2$, or the like. Exemplary alkoxides include, without limitation, methoxide, ethoxide, propoxide, isopropoxide, butoxide, isobutoxide, t-butoxide, pentoxide, isopentoxide, neo-pentoxide, six carbon atom alkoxides, seven carbon atom alkoxides, eight carbon atom alkoxides, up to forty carbon atom alkoxides.

Suitable metal alkoxide for use in this invention include, without limitation, MOR, where M is selected from the group consisting of Ti, Zr, Hf and mixtures and combinations thereof and R a carbyl group as defined above.

Hydratable Polymers

Suitable hydratable polymers that may be used in embodiments of the invention include any of the hydratable polysaccharides which are capable of forming a gel in the presence of at least one cross-linking agent of this invention and any other polymer that hydrates upon exposure to water or an aqueous solution capable of forming a gel in the presence of at least one cross-linking agent of this invention. For instance, suitable hydratable polysaccharides include, but are not limited to, galactomannan gums, glucomannan gums, guars, derived guars, and cellulose derivatives. Specific examples are guar gum, guar gum derivatives, locust bean gum, Karaya gum, carboxymethyl cellulose, carboxymethyl hydroxyethyl cellulose, and hydroxyethyl cellulose. Presently preferred gelling agents include, but are not limited to, guar gums, hydroxypropyl guar, carboxymethyl hydroxypropyl guar, carboxymethyl guar, and carboxymethyl hydroxyethyl cellulose. Suitable hydratable polymers may also include synthetic polymers, such as polyvinyl alcohol, polyacrylamides, poly-2-amino-2-methyl propane sulfonic acid, and various other synthetic polymers and copolymers. Other suitable polymers are known to those skilled in the art. Other examples of such polymer include, without limitation, guar gums, high-molecular weight polysaccharides composed of mannose and galactose sugars, or guar derivatives such as hydropropyl guar (HPG), carboxymethyl guar (CMG). carboxymethylhydropropyl guar (CMHPG), hydroxyethylcellulose (HEC), hydroxypropylcellulose (HPC), carboxymethylhydroxyethylcellulose (CMHEC), xanthan, scleroglucan, polyacrylamide, polyacrylate polymers and copolymers. Other examples of suitable hydratable polymers are set forth herein.

Suitable hydratable polymers that may be used in embodiments of the invention include any of the hydratable polysaccharides which are capable of forming a gel in the presence of a crosslinking agent. For instance, suitable hydratable polysaccharides include, but are not limited to, galactomannan gums, glucomannan gums, guars, derived guars, and cellulose derivatives. Specific examples are guar gum, guar gum derivatives, locust bean gum, Karaya gum, carboxymethyl cellulose, carboxymethyl hydroxyethyl cellulose, and hydroxyethyl cellulose. In certain embodiments, the gelling agents include, but are not limited to, guar gums, hydroxypropyl guar, carboxymethyl hydroxypropyl guar, carboxymethyl guar, and carboxymethyl hydroxyethyl cellulose. Suitable hydratable polymers may also include synthetic polymers, such as polyvinyl alcohol, polyacrylamides, poly-2-amino-2-methyl propane sulfonic acid, and various other synthetic polymers and copolymers. Other suitable polymers are known to those skilled in the art.

The hydratable polymer may be present in the fluid in concentrations ranging from about 0.10% to about 5.0% by weight of the aqueous fluid. A preferred range for the hydratable polymer is about 0.20% to about 0.80% by weight.

pH Modifiers

Suitable pH modifiers for use in this invention include, without limitation, alkali hydroxides, alkali carbonates, alkali bicarbonates, alkaline earth metal hydroxides, alkaline earth metal carbonates, alkaline earth metal bicarbonates, rare earth metal carbonates, rare earth metal bicarbonates, rare earth metal hydroxides, amines, hydroxylamines ($NH_2OH$), alkylated hydroxyl amines ($NH_2OR$, where R is a carbyl group having from 1 to about 30 carbon atoms or heteroatoms—O or N), and mixtures or combinations thereof. Preferred pH modifiers include NaOH, KOH, $Ca(OH)_2$, CaO, $Na_2CO_3$, $KHCO_3$, $K_2CO_3$, $NaHCO_3$, MgO, $Mg(OH)_2$ and mixtures or combinations thereof. Preferred amines include triethylamine, triproplyamine, other trialkylamines, bis hydroxyl ethyl ethylenediamine (DGA), bis hydroxyethyl diamine 1-2 dimethylcyclohexane, or the like or mixtures or combinations thereof.

Corrosion Inhibitors

Suitable corrosion inhibitor for use in this invention include, without limitation: quaternary ammonium salts e.g., chloride, bromides, iodides, dimethylsulfates, diethylsulfates, nitrites, bicarbonates, carbonates, hydroxides, alkoxides, or the like, or mixtures or combinations thereof; salts of nitrogen bases; or mixtures or combinations thereof. Exemplary quaternary ammonium salts include, without limitation, quaternary ammonium salts from an amine and a quaternarization agent, e.g., alkylchlorides, alkylbromide, alkyl iodides, alkyl sulfates such as dimethyl sulfate, diethyl sulfate, etc., dihalogenated alkanes such as dichloroethane, dichloropropane, dichloroethyl ether, epichlorohydrin adducts of alcohols, ethoxylates, or the like; or mixtures or combinations thereof and an amine agent, e.g., alkylpyridines, especially, highly alkylated alkylpyridines, alkyl quinolines, C6 to C24 synthetic tertiary amines, amines derived from natural products such as coconuts, or the like, dialkylsubstituted methyl amines, amines derived from the reaction of fatty acids or oils and polyamines, amidoimidazolines of DETA and fatty acids, imidazolines of ethylenediamine, imidazolines of diaminocyclohexane, imidazolines of aminoethylethylenediamine, pyrimidine of propane diamine and alkylated propene diamine, oxyalkylated mono and polyamines sufficient to convert all labile hydrogen atoms in the amines to oxygen containing groups, or the like or mixtures or combinations thereof. Exemplary examples of salts ofnitrogen bases, include, without limitation, salts of nitrogen bases derived from a salt, e.g.: C1 to C8 monocarboxylic acids such as formic acid, acetic acid, propanoic acid, butanoic acid, pentanoic acid, hexanoic acid, heptanoic acid, octanoic acid, 2-ethylhexanoic acid, or the like; C2 to C12 dicarboxylic acids, C2 to C12 unsaturated carboxylic acids and anhydrides, or the like; polyacids such as diglycolic acid, aspartic acid, citric acid, or the like; hydroxy acids such as lactic acid, itaconic acid, or the like; aryl and hydroxy aryl acids; naturally or synthetic amino acids; thioacids such as thioglycolic acid (TGA); free acid forms of phosphoric acid derivatives of glycol, ethoxylates, ethoxylated amine, or the like, and aminosulfonic acids; or mixtures or combinations thereof and an amine, e.g.: high molecular weight fatty acid amines such as cocoamine, tallow amines, or the like; oxyalkylated fatty acid amines; high molecular weight fatty acid polyamines (di, tri, tetra, or higher); oxyalkylated fatty acid polyamines; amino amides such as reaction products of carboxylic acid with polyamines where the equivalents of carboxylic acid is less than the equivalents of reactive amines and oxyalkylated derivatives thereof; fatty acid pyrimidines; monoimidazolines of EDA, DETA or higher ethylene amines, hexamethylene diamine (HMDA), tetramethylenediamine (TMDA), and higher analogs thereof; bisimidazolines, imidazolines ofmono and polyorganic acids; oxazolines derived from monoethanol amine and fatty acids or oils, fatty acid ether amines, mono and bis amides of aminoethylpiperazine; GAA and TGA salts of the reaction products of crude tall oil or distilled tall oil with diethylene triamine; GAA and TGA salts of reaction products of dimer acids with mixtures of poly amines such as TMDA, HMDA and 1,2-diaminocyclohexane; TGA salt of imidazoline derived from DETA with tall oil fatty acids or soy bean oil, canola oil, or the like; or mixtures or combinations thereof.

Other Additives

The drilling fluids of this invention can also include other additives as well such as scale inhibitors, carbon dioxide control additives, paraffin control additives, oxygen control additives, or other additives.

Scale Control

Suitable additives for Scale Control and useful in the compositions of this invention include, without limitation: Chelating agents, e.g., Na, K or $NH_4^+$ salts of EDTA; Na, K or $NH_4^+$ salts of NTA; Na, K or $NH_4^+$ salts of Erythorbic acid; Na, K or $NH_4^+$ salts of thioglycolic acid (TGA); Na, K or $NH_4^+$ salts of Hydroxy acetic acid; Na, K or $NH_4^+$ salts of Citric acid; Na, K or $NH_4^+$ salts of Tartaric acid or other similar salts or mixtures or combinations thereof. Suitable additives that work on threshold effects, sequestrants, include, without limitation: Phosphates, e.g., sodium hexamethylphosphate, linear phosphate salts, salts of polyphosphoric acid, Phosphonates, e.g., nonionic such as HEDP (hydroxythylidene diphosphoric acid), PBTC (phosphoisobutane, tricarboxylic acid), Amino phosphonates of: MEA (monoethanolamine), $NH_3$, EDA (ethylene diamine), Bishydroxyethylene diamine, Bisaminoethylether, DETA (diethylenetriamine), HMDA (hexamethylene diamine), Hyper homologues and isomers of HMDA, Polyamines of EDA and DETA, Diglycolamine and homologues, or similar polyamines or mixtures or combinations thereof; Phosphate esters, e.g., polyphosphoric acid esters or phosphorus pentoxide ($P_2O_5$) esters of: alkanol amines such as MEA, DEA, triethanol amine (TEA), Bishydroxyethylethylene diamine; ethoxylated alcohols, glycerin, glycols such as EG (ethylene glycol), propylene glycol, butylene glycol, hexylene glycol, trimethylol propane, pentaeryithrol, neopentyl glycol or the like; Tris & Tetra hydroxy amines; ethoxylated alkyl phenols (limited use due to toxicity problems), Ethoxylated amines such as monoamines such as MDEA and higher amines from 2 to 24 carbons atoms, diamines 2 to 24 carbons carbon atoms, or the like; Polymers, e.g., homopolymers of aspartic acid, soluble homopolymers of acrylic acid, copolymers of acrylic acid and methacrylic acid, terpolymers of acylates, AMPS, etc., hydrolyzed polyacrylamides, poly malic anhydride (PMA); or the like; or mixtures or combinations thereof.

Carbon Dioxide Neutralization

Suitable additives for $CO_2$ neutralization and for use in the compositions of this invention include, without limitation, MEA, DEA, isopropylamine, cyclohexylamine, morpholine, diamines, dimethylaminopropylamine (DMAPA), ethylene diamine, methoxy proplyamine (MOPA), dimethylethanol amine, methyldiethanolamine (MDEA) & oligomers, imidazolines of EDA and homologues and higher adducts, imidazolines of aminoethylethanolamine (AEEA), aminoethylpiperazine, aminoethylethanol amine, di-isopropanol amine, DOW AMP-90™, Angus AMP-95, dialkylamines (of methyl, ethyl, isopropyl), mono alkylamines (methyl, ethyl, isopropyl), trialkyl amines (methyl, ethyl, isopropyl), bishydroxyethylethylene diamine (THEED), or the like or mixtures or combinations thereof.

Paraffin Control

Suitable additives for Paraffin Removal, Dispersion, and/or paraffin Crystal Distribution include, without limitation: Cellosolves available from DOW Chemicals Company; Cellosolve acetates; Ketones; Acetate and Formate salts and esters; surfactants composed of ethoxylated or propoxylated alcohols, alkyl phenols, and/or amines; methylesters such as coconate, laurate, soyate or other naturally occurring methylesters of fatty acids; sulfonated methylesters such as sulfonated coconate, sulfonated laurate, sulfonated soyate or other sulfonated naturally occurring methylesters of fatty acids; low molecular weight quaternary ammonium chlorides of coconut oils soy oils or C10 to C24 amines or monohalogenated alkyl and aryl chlorides; quanternary ammonium salts composed of disubstituted (e.g., dicoco, etc.) and lower molecular weight halogenated alkyl and/or aryl chlorides; gemini quaternary salts of dialkyl (methyl, ethyl, propyl, mixed, etc.) tertiary amines and dihalogenated ethanes, propanes, etc. or dihalogenated ethers such as dichloroethyl ether (DCEE), or the like; gemini quaternary salts of alkyl amines or amidopropyl amines, such as cocoamidopropyldimethyl, bis quaternary ammonium salts of DCEE; or mixtures or combinations thereof. Suitable alcohols used in preparation of the surfactants include, without limitation, linear or branched alcohols, specially mixtures of alcohols reacted with ethylene oxide, propylene oxide or higher alkyleneoxide, where the resulting surfactants have a range of HLBs. Suitable alkylphenols used in preparation of the surfactants include, without limitation, nonylphenol, decylphenol, dodecylphenol or other alkylphenols where the alkyl group has between about 4 and about 30 carbon atoms. Suitable amines used in preparation of the surfactants include, without limitation, ethylene diamine (EDA), diethylenetriamine (DETA), or other polyamines. Exemplary examples include Quadrols, Tetrols, Pentrols available from BASF. Suitable alkanolamines include, without limitation, monoethanolamine (MEA), diethanolamine (DEA), reactions products of MEA and/or DEA with coconut oils and acids.

Oxygen Control

The introduction of water downhole often is accompanied by an increase in the oxygen content of downhole fluids due to oxygen dissolved in the introduced water. Thus, the materials introduced downhole must work in oxygen environments or must work sufficiently well until the oxygen content has been depleted by natural reactions. For system that cannot tolerate oxygen, then oxygen must be removed or controlled in any material introduced downhole. The problem is exacerbated during the winter when the injected materials include winterizers such as water, alcohols, glycols, Cellosolves, formates, acetates, or the like and because oxygen solubility is higher to a range of about 14-15 ppm in very cold water. Oxygen can also increase corrosion and scaling. In CCT (capillary coiled tubing) applications using dilute solutions, the injected solutions result in injecting an oxidizing environment ($O_2$) into a reducing environment ($CO_2$, $H_2S$, organic acids, etc.).

Options for controlling oxygen content includes: (1) deaeration of the fluid prior to downhole injection, (2) addition of normal sulfides to product sulfur oxides, but such sulfur oxides can accelerate acid attack on metal surfaces, (3) addition of erythorbates, ascorbates, diethylhydroxyamine or other oxygen reactive compounds that are added to the fluid prior to downhole injection; and (4) addition of corrosion inhibitors or metal passivation agents such as potassium (alkali) salts of esters of glycols, polyhydric alcohol ethyloxylates or other similar corrosion inhibitors. Exemplary examples oxygen and corrosion inhibiting agents include mixtures of tetramethylene diamines, hexamethylene diamines, 1,2-diaminecyclohexane, amine heads, or reaction products of such amines with partial molar equivalents of aldehydes. Other oxygen control agents include salicylic and benzoic amides of polyamines, used especially in alkaline conditions, short chain acetylene diols or similar compounds, phosphate esters, borate glycerols, urea and thiourea salts of bisoxalidines or other compound that either absorb oxygen, react with oxygen or otherwise reduce or eliminate oxygen.

Salt Inhibitors

Suitable salt inhibitors for use in the fluids of this invention include, without limitation, Na Minus—Nitrilotriacetamide available from Clearwater International, LLC of Houston, Tex.

Viscoelastic Surfactants

Cationic viscoelastic surfactants—typically consisting of long-chain quaternary ammonium salts such as cetyltrimethylammonium bromide (CTAB)—have been so far of primarily commercial interest in wellbore fluid. Common reagents that generate viscoelasticity in the surfactant solutions are salts such as ammonium chloride, potassium chloride, sodium chloride, sodium salicylate and sodium isocyanate and non-ionic organic molecules such as chloroform. The electrolyte content of surfactant solutions is also an important control on their viscoelastic behavior. Reference is made for example to U.S. Pat. Nos. 4,695,389, 4,725,372, 5,551,516, 5,964,295, and 5,979,557, incorporated herein by reference. However, fluids comprising this type of cationic viscoelastic surfactants usually tend to lose viscosity at high brine concentration (10 pounds per gallon or more). Anionic viscoelastic surfactants are also used.

Viscoelastic surfactant system properties using amphoteric/zwitterionic surfactants and an organic acid, salt and/or inorganic salt. The surfactants are for instance dihydroxyl alkyl glycinate, alkyl ampho acetate or propionate, alkyl betaine, alkyl amidopropyl betaine and alkylamino mono- or di-propionates derived from certain waxes, fats and oils. The surfactants are used in conjunction with an inorganic water-soluble salt or organic additives such as phthalic acid, salicylic acid or their salts. Amphoteric/zwitterionic surfactants, in particular those comprising a betaine moiety are useful at temperature up to about 150° C. and are therefore of particular interest for medium to high temperature wells. However, like the cationic viscoelastic surfactants mentioned above, they are usually not compatible with high brine concentration.

Crosslinking Agents

A suitable crosslinking agent can be any compound that increases the viscosity of the fluid by chemical crosslinking, physical crosslinking, or any other mechanisms. For example, the gellation of a hydratable polymer can be achieved by crosslinking the polymer with metal ions including boron, zirconium, and titanium containing compounds, or mixtures thereof. One class of suitable crosslinking agents is organotitanates. Another class of suitable crosslinking agents is borates. The selection of an appropriate crosslinking agent depends upon the type of treatment to be performed and the hydratable polymer to be used. The amount of the crosslinking agent used also depends upon the well conditions and the type of treatment to be effected, but is generally in the range of from about 10 ppm to about 1000 ppm of metal ion of the crosslinking agent in the hydratable polymer fluid. In some applications, the aqueous polymer solution is crosslinked immediately upon addition of the crosslinking agent to form a highly viscous gel. In other applications, the reaction of the crosslinking agent can be retarded so that viscous gel formation does not occur until the desired time.

Surfactants

The surfactant can generally be any surfactant. The surfactant is preferably viscoelastic. The surfactant is preferably anionic. The anionic surfactant can be an alkyl sarcosinate. The alkyl sarcosinate can generally have any number of carbon atoms. Presently preferred alkyl sarcosinates have about 12 to about 24 carbon atoms. The alkyl sarcosinate can have about 14 to about 18 carbon atoms. Specific examples of the number of carbon atoms include 12, 14, 16, 18, 20, 22, and 24 carbon atoms.

The anionic surfactant can have the chemical formula $R_1CON(R_2)CH_2X$, wherein $R_1$ is a hydrophobic chain having about 12 to about 24 carbon atoms, $R_2$ is hydrogen, methyl, ethyl, propyl, or butyl, and X is carboxyl or sulfonyl. The hydrophobic chain can be an alkyl group, an alkenyl group, an alkylarylalkyl group, or an alkoxyalkyl group. Specific examples of the hydrophobic chain include a tetradecyl group, a hexadecyl group, an octadecentyl group, an octadecyl group, and a docosenoic group.

The surfactant can generally be present in any weight percent concentration. Presently preferred concentrations of surfactant are about 0.1% to about 15% by weight. A presently more preferred concentration is about 0.5% to about 6% by weight. Laboratory procedures can be employed to determine the optimum concentrations for any particular situation.

Amphoteric Polymers

The amphoteric polymer can generally be any amphoteric polymer. The amphoteric polymer can be a nonionic water-soluble homopolysaccharide or an anionic water-soluble polysaccharide. The polymer can generally have any molecular weight, and is presently preferred to have a molecular weight of at least about 500,000.

The polymer can be a hydrolyzed polyacrylamide polymer. The polymer can be a scleroglucan, a modified scleroglucan, or a scleroglucan modified by contact with glyoxal or glutaraldehyde. The scleroglucans are nonionic water-soluble homopolysaccharides, or water-soluble anionic polysaccharides, having molecular weights in excess of about 500,000, the molecules of which consist of a main straight chain formed of D-glucose units which are bonded by β-1,3-bonds and one in three of which is bonded to a side D-glucose unit by means of a β-1,6 bond. These polysaccharides can be obtained by any of the known methods in the art, such as fermentation of a medium based on sugar and inorganic salts under the action of a microorganism of Sclerotium type A. A more complete description of such scleroglucans and their preparations may be found, for example, in U.S. Pat. Nos. 3,301,848 and 4,561,985, incorporated herein by reference. In aqueous solutions, the scleroglucan chains are combined in a triple helix, which explains the rigidity of the biopolymer, and consequently its features of high viscosity-increasing power and resistance to shearing stress.

It is possible to use, as source of scleroglucan, the scleroglucan which is isolated from a fermentation medium, the product being in the form of a powder or of a more or less concentrated solution in an aqueous and/or aqueous-alcoholic solvent. Scleroglucans customarily used in applications in the petroleum field are also preferred according to the present invention, such as those which are white powders obtained by alcoholic precipitation of a fermentation broth in order to remove residues of the producing organism (mycelium, for example). Additionally, it is possible to use the liquid reaction mixture resulting from the fermentation and containing the scleroglucan in solution. According to the present invention, further suitable scleroglucans are the modified scleroglucan which result from the treatment of scleroglucans with a dialdehyde reagent (glyoxal, glutaraldehyde, and the like), as well as those described in U.S. Pat. No. 6,162,449, incorporated herein by reference, (β-1,3-scleroglucans with a cross-linked 3-dimensional structure produced by Sclerotium rolfsii).

The polymer can be Aquatrol V (a synthetic compound which reduces water production problems in well production; described in U.S. Pat. No. 5,465,792, incorporated herein by reference), AquaCon (a moderate molecular weight hydrophilic terpolymer based on polyacrylamide capable of binding to formation surfaces to enhance hydrocarbon production; described in U.S. Pat. No. 6,228,812, incorporated herein by reference) and Aquatrol C (an amphoteric polymeric material). Aquatrol V, Aquatrol C, and AquaCon are commercially available from BJ Services Company.

The polymer can be a terpolymer synthesized from an anionic monomer, a cationic monomer, and a neutral monomer. The monomers used preferably have similar reactivities so that the resultant amphoteric polymeric material has a random distribution of monomers. The anionic monomer can generally be any anionic monomer. Presently preferred anionic monomers include acrylic acid, methacrylic acid, 2-acrylamide-2-methylpropane sulfonic acid, and maleic anhydride. The cationic monomer can generally be any cationic monomer. Presently preferred cationic monomers include dimethyl-diallyl ammonium chloride, dimethylamino-ethyl methacrylate, and allyltrimethyl ammonium chloride. The neutral monomer can generally be any neutral monomer. Presently preferred neutral monomers include butadiene, N-vinyl-2-pyrrolidone, methyl vinyl ether, methyl acrylate, maleic anhydride, styrene, vinyl acetate, acrylamide, methyl methacrylate, and acrylonitrile. The polymer can be a terpolymer synthesized from acrylic acid (AA), dimethyl diallyl ammonium chloride (DMDAC) or diallyl dimethyl ammonium chloride (DADMAC), and acrylamide (AM). The ratio of monomers in the terpolymer can generally be any ratio. A presently preferred ratio is about 1:1:1.

Another presently preferred amphoteric polymeric material (hereinafter "polymer 1") includes approximately 30% polymerized AA, 40% polymerized AM, and 10% polymerized DMDAC or DADMAC with approximately 20% free residual DMDAC or DADMAC which is not polymerized due to lower relative reactivity of the DMDAC or DADMAC monomer.

Crosslinked Compositions

Any suitable polymeric gel forming material or gellant, preferably water soluble, used by those skilled in the art to treat subterranean formations and form stable or stabilized gels of the fluid suspension may be employed in the invention. For simplicity hereinafter, included in the phrase "water soluble", as applied to the gellant, are those suitable polymeric materials which are dispersible or suspendable in water or aqueous liquid. Suitable gellants also include crosslinkable polymers or monomers for forming such polymers under the conditions extant. Such cross-linkable polymeric and polymer forming materials are well known, and the crosslinked polymer or polymers which produce the stable or stabilized gel are preferably formed by reacting or contacting appropriate proportions of the crosslinkable polymer with a crosslinking agent or agents. Similarly, procedures for preparing gelable compositions or fluids and conditions under which such compositions form stable gels in subterranean formations are well known to those skilled in the art. As indicated, gel-forming compositions according to the invention may be formed by mixing, in water, the water soluble crosslinkable polymer and the crosslinking agent.

In forming the gel, the crosslinkable polymer(s) and crosslinking agent and concentrations thereof are normally selected to assure (a) gel formation or presence at subterranean (i.e., formation or reservoir) conditions and (b) suitable time allotment for injection of the composition prior to the completion of gelation, or sufficient fluidity of the gelled composition to allow pumping down well. The polymer (or monomers used to form the polymer) and the crosslinking agent are generally selected and supplied in amounts effective to achieve these objectives. By "effective" amounts of the polymer or polymers (or monomers) and crosslinking agents is meant amounts sufficient to provide crosslinked polymers and form the desired stable gel under the conditions extant. Generally, a water soluble crosslinkable polymer concentration in the aqueous liquid of from about 0.05 to about 40 percent, preferably from about 0.1 percent to about 10 percent, and, most preferably, from about 0.2 percent to about 7 percent, may be employed (or sufficient monomer(s) to form these amounts of polymer). Typically, the crosslinking agent is employed in the aqueous liquid in a concentration of from about 0.001 percent to about 2 percent, preferably from about 0.005 percent to about 1.5 percent, and, most preferably, from about 0.01 percent to about 1.0 percent.

However, if a crosslinked polymer is to be used, the fluids of the invention need not contain both the crosslinkable polymer and the crosslinking agent at the surface. The crosslinkable polymer or the crosslinking agent may be omitted from the fluid sent downhole, the omitted material being introduced into the subterranean formation as a separate slug, either before, after, or simultaneously with the introduction of the fluid. In such cases, concentrations of the slugs will be adjusted to insure the required ratios of the components for proper gel formation at the desired location. Preferably, the surface formulated composition or fluid comprises at least the crosslinkable polymeric material (e.g., acrylamide, vinyl acetate, acrylic acid, vinyl alcohol, methacrylamide, ethylene oxide, or propylene oxide). More preferably, the composition comprises both (a) the crosslinking agent and (b) either (i) the crosslinkable polymer or (ii) the polymerizable monomers capable of forming a crosslinkable polymer. The gellable formulations of this invention may be allowed to gel or begin gelation before entering the horizontal section of the well.

As indicated, mixtures of polymeric gel forming material or gellants may be used. Materials which maybe used include water soluble crosslinkable polymers, copolymers, and terpolymers, such as polyvinyl polymers, polyacrylamides, cellulose ethers, polysaccharides, lignosulfonates, ammonium salts thereof, alkali metal salts thereof, alkaline earth salts of lignosulfonates, and mixtures thereof. Specific polymers are acrylic acid-acrylamide copolymers, acrylic acid-methacrylamide copolymers, polyacrylamides, partially hydrolyzed polyacrylamides, partially hydrolyzed polymethacrylamides, polyvinyl alcohol, polyvinyl acetate, polyalkyleneoxides, carboxycelluloses, carboxyalkylhydroxyethyl celluloses, hydroxyethylcellulose, galactomannans (e.g., guar gum), substituted galactomannans (e.g., hydroxypropyl guar), heteropolysaccharides obtained by the fermentation of starch-derived sugar (e.g., xanthan gum), ammonium and alkali metal salts thereof, and mixtures thereof. Preferred water soluble crosslinkable polymers include hydroxypropyl guar, carboxymethylhydroxypropyl guar, partially hydrolyzed polyacrylamides, xanthan gum, polyvinyl alcohol, the ammonium and alkali metal salts thereof, and mixtures thereof.

Similarly, the crosslinking agent(s) may be selected from those organic and inorganic compounds well known to those skilled in the art useful for such purpose, and the phrase "crosslinking agent", as used herein, includes mixtures of such compounds. Exemplary organic crosslinking agents include, but are not limited to, aldehydes, dialdehydes, phenols, substituted phenols, ethers, and mixtures thereof. Phenol, resorcinol, catechol, phloroglucinol, gallic acid, pyrogallol, 4,4'-diphenol, 1,3-dihydroxynaphthalene, 1,4-benzoquinone, hydroquinone, quinhydrone, tannin, phenyl acetate, phenyl benzoate, 1-naphthyl acetate, 2-naphthyl acetate, phenyl chloracetate, hydroxyphenylalkanols, formaldehyde, paraformaldehyde, acetaldehyde, propanaldehyde, butyraldehyde, isobutyraldehyde, valeraldehyde, heptaldehyde, decanal, glyoxal, glutaraldehyde, terephthaldehyde, hexamethyl-enetetramine, trioxane, tetraoxane, polyoxymethylene, and divinylether may be used.

Typical inorganic crosslinking agents are polyvalent metals, chelated polyvalent metals, and compounds capable of yielding polyvalent metals, including organometallic compounds as well as borates and boron complexes, and mixtures thereof. Preferred inorganic crosslinking agents include chromium salts, complexes, or chelates, such as chromium nitrate, chromium citrate, chromium acetate, chromium propionate, chromium malonate, chromium lactate, etc.; aluminum salts, such as aluminum citrate, aluminates, and aluminum complexes and chelates; titanium salts, complexes, and chelates; zirconium salts, complexes or chelates, such as zirconium lactate; and boron containing compounds such as boric acid, borates, and boron complexes. Fluids containing additives such as those described in U.S. Pat. Nos. 4,683,068 and 5,082,579 may be used.

Charged Coupled System

The surfactant which is oppositely charged from the polymer is sometimes called herein the "counterionic surfactant." By this we mean a surfactant having a charge opposite that of the polymer.

Suitable cationic polymers include polyamines, quaternary derivatives of cellulose ethers, quaternary derivatives of guar, homopolymers and copolymers of at least 20 mole percent dimethyl diallyl ammonium chloride (DMDAAC), homopolymers and copolymers of methacrylamidopropyl trimethyl ammonium chloride (MAPTAC), homopolymers and copolymers of acrylamidopropyl trimethyl ammonium chloride (APTAC), homopolymers and copolymers of methacryloyloxyethyl trimethyl ammponium chloride (METAC), homopolymers and copolymers of acryloyloxyethyl trimethyl ammonium chloride (AETAC), homopolymers and copolymers of methacryloyloxyethyl trimethyl ammonium methyl sulfate (METAMS), and quaternary derivatives of starch.

Suitable anionic polymers include homopolymers and copolymers of acrylic acid (AA), homopolymers and copolymers of methacrylic acid (MAA), homopolymers and copolymers of 2-acrylamido-2-methylpropane sulfonic acid (AMPSA), homopolymers and copolymers of N-methacrylamidopropyl N,N-dimethyl amino acetic acid, N-acrylamidopropyl N,N-dimethyl amino acetic acid, N-methacryloyloxyethyl N,N-dimethyl amino acetic acid, and N-acryloyloxyethyl N,N-dimethyl amino acetic acid.

Anionic surfactants suitable for use with the cationic polymers include alkyl, aryl or alkyl aryl sulfates, alkyl, aryl or alkyl aryl carboxylates or alkyl, aryl or alkyl aryl sulfonates. Preferably, the alkyl moieties have about 1 to about 18 carbons, the aryl moieties have about 6 to about 12 carbons, and the alkyl aryl moieties have about 7 to about 30 carbons. Exemplary groups would be propyl, butyl, hexyl, decyl, dodecyl, phenyl, benzyl and linear or branched alkyl benzene derivatives of the carboxylates, sulfates and sulfonates. Included are alkyl ether sulphates, alkaryl sulphonates, alkyl succinates, alkyl sulphosuccinates, N-alkoyl sarcosinates, alkyl phosphates, alkyl ether phosphates, alkyl ether carboxylates, alpha-olefin sulphonates and acyl methyl taurates, especially their sodium, magnesium ammonium and mono-, di- and triethanolamine salts. The alkyl and acyl groups generally contain from 8 to 18 carbon atoms and may be unsaturated. The alkyl ether sulphates, alkyl ether phosphates and alkyl ether carboxylates may contain from one to 10 ethylene oxide or propylene oxide units per molecule, and preferably contain 2 to 3 ethylene oxide units per molecule. Examples of suitable anionic surfactants include sodium lauryl sulphate, sodium lauryl ether sulphate, ammonium lauryl sulphosuccinate, ammonium lauryl sulphate, ammonium lauryl ether sulphate, sodium dodecylbenzene sulphonate, triethanolamine dodecylbenzene sulphonate, sodium cocoyl isethionate, sodium lauryl isethionate, and sodium N-lauryl sarcosinate.

Cationic surfactants suitable for use with the anionic polymers include quaternary ammonium surfactants of the formula $X^-N^+R^1R^2R^3$ where $R^1$, $R^2$, and $R^3$ are independently selected from hydrogen, an aliphatic group of from about 1 to about 22 carbon atoms, or aromatic, aryl, an alkoxy, polyoxyalkylene, alkylamido, hydroxyalkyl, or alkylaryl group having from about 1 to about 22 carbon atoms; and X is an anion selected from halogen, acetate, phosphate, nitrate, sulfate, alkylsulfate radicals (e.g., methyl sulfate and ethyl sulfate), tosylate, lactate, citrate, and glycolate. The aliphatic groups may contain, in addition to carbon and hydrogen atoms, ether linkages, and other groups such as hydroxy or amino group substituents (e.g., the alkyl groups can contain polyethylene glycol and polypropylene glycol moieties). The longer chain aliphatic groups, e.g., those of about 12 carbons, or higher, can be saturated or unsaturated. More preferably, $R^1$ is an alkyl group having from about 12 to about 18 carbon atoms; $R^2$ is selected from H or an alkyl group having from about 1 to about 18 carbon atoms; $R^3$ and $R^4$ are independently selected from H or an alkyl group having from about 1 to about 3 carbon atoms; and X is as described above.

Suitable hydrophobic alcohols having 6-23 carbon atoms are linear or branched alkyl alcohols of the general formula $C_MH_{2M+2-N}(OH)_N$, where M is a number from 6-23, and N is 1 when M is 6-12, but where M is 13-23, N may be a number from 1 to 3. Our most preferred hydrophobic alcohol is lauryl alcohol, but any linear monohydroxy alcohol having 8-15 carbon atoms is also preferable to an alcohol with more or fewer carbon atoms.

By a gel promoter we mean a betaine, a sultaine or hydroxysultaine, or an amine oxide. Examples of betaines include the higher alkyl betaines such as coco dimethyl carboxymethyl betaine, lauryl dimethyl carboxymethyl betaine, lauryl dimethyl alphacarboxyethyl betaine, cetyl dimethyl carboxymethyl betaine, cetyl dimethyl betaine, lauryl bis-(2-hydroxyethyl)carboxymethyl betaine, oleyl dimethyl gamma-carboxypropyl betaine, lauryl bis-(2-hydroxypropyl)alpha-carboxyeth-yl betaine, coco dimethyl sulfopropyl betaine, lauryl dimethyl sulfoethyl betaine, lauryl bis-(2-hydroxyethyl)sulfopropyl betaine, amidobetaines and amidosulfobetaines (wherein the $RCONH(CH_2)_3$ radical is attached to the nitrogen atom of the betaine, oleyl betaine, and cocamidopropyl betaine. Examples of sultaines and hydroxysultaines include materials such as cocamidopropyl hydroxysultaine.

By a Zeta potential having an absolute value of at least 20 we mean a Zeta potential having a value of +20 of higher or −20 or lower.

Amphoteric surfactants suitable for use with either cationic polymers or anionic polymers include those surfactants broadly described as derivatives of aliphatic secondary and tertiary amines in which the aliphatic radical can be straight or branched chain and wherein one of the aliphatic substituents contains from about 8 to about 18 carbon atoms and one contains an anionic water solubilizing group such as carboxy, sulfonate, sulfate, phosphate, or phosphonate. Suitable amphoteric surfactants include derivatives of aliphatic secondary and tertiary amines in which the aliphatic radical can be straight or branched chain and wherein one of the aliphatic substituents contains from about 8 to about 18 carbon atoms and one contains an anionic water solubilizing group, e.g., carboxy, sulfonate, sulfate, phosphate, or phosphonate. Examples of compounds falling within this definition are sodium 3-dodecylaminopropionate, and sodium 3-dodecylaminopropane sulfonate.

Suitable amine oxides include cocoamidopropyl dimethyl amine oxide and other compounds of the formula $R^1R^2R^3N \rightarrow O$ wherein $R^3$ is a hydrocarbyl or substituted hydrocarbyl having from about 8 to about 30 carbon atoms, and $R^1$ and $R^2$ are independently hydrogen, a hydrocarbyl or substituted hydrocarbyl having up to 30 carbon atoms. Preferably, $R^3$ is an aliphatic or substituted aliphatic hydrocarbyl having at least about 12 and up to about 24 carbon atoms. More preferably $R^3$ is an aliphatic group having at least about 12 carbon atoms and having up to about 22, and most preferably an aliphatic group having at least about 18 and no more than about 22 carbon atoms.

Phosphate Ester Salts

Suitable phosphorus-containing compounds suitable for use in the invention include, without limitation, phosphates or phosphate equivalents or mixtures or combinations thereof. Suitable phosphates include, without limitation, mono-alkali metal phosphates (PO(OH)(OM), where M is Li, Na, K, Rd, or Cs), di-alkali metal phosphates $(PO(OH)(OM)_2$, where each M is the same or different and is Li, Na, K, Rd, or Cs) such as dipotassium phosphate $(PO(OH)(OK)_2)$ and disodium phosphate,$(PO(OH)(ONa)_2)$, tri-alkali metal phosphates $(PO(OM)_3$, where each M is the same or different and is Li, Na, K, Rd, or Cs) such as trisodium phosphate $(PO(ONa)_3)$ and tripotassium phosphate $(PO(OK)_3)$, carbyl phosphates $(PO(OR^1)(OM)_2$, where $R^1$ is a carbyl group and M is H, Li, Na, K, Rd, and/or Cs), dicarbyl phosphates $(PO(OR^1)(OR^2)(OM)$, where $R^1$ and $R^2$ are the same or different carbyl groups and M is H, Li, Na, K, Rd, or Cs), tricarbyl phosphates $(PO(OR^1)(OR^2)(OR^3)$, where $R^1$, $R^2$, and $R^3$ are the same or different carbyl groups), or mixtures or combinations thereof.

Suitable phosphate ester salts for use in this invention include, without limitation, alkali, alkaline earth metal, or transition metal salts of alkyl phosphate ester, alkoxy phosphate esters, glycols phosphate esters, alkypolyol phosphate esters or the like or mixture or combinations thereof. Exemplary examples of glycol phosphate esters include, without limitation, ethylene glycol (EG), propylene glycol, butylene glycol, hexylene glycol, trimethylol propane, pentaeryithrol, neopentyl glycol or the like or mixtures or combinations thereof.

Suitable carbyl group include, without limitations, carbyl group having between about 3 and 40 carbon atoms, where one or more of the carbon atoms can be replaced with a hetero atom selected from the group consisting of oxygen and nitrogen, with the remainder of valences comprising hydrogen or a mono-valent group such as a halogen, an amide (—NHCOR), an alkoxide (—OR), or the like, where R is a carbyl group. The carbyl group can be an alkyl group, an alkenyl group, an aryl group, an alkaaryl group, an arylalkyl group, or mixtures or combinations thereof, i.e., each carbyl group in the phosphate can be the same or different. In certain embodiments, the carbyl group has between about 3 and about 20, where one or more of the carbon atoms can be replaced with a hetero atom selected from the group consisting of oxygen and nitrogen, with the remainder of valences comprising hydrogen or a mono-valent group such as a halogen, an amide (—NHCOR), an alkoxide (—OR), or the like, where R is a carbyl group. In certain embodiments, the carbyl group has between about 3 and about 16, where one or more of the carbon atoms can be replaced with a hetero atom selected from the group consisting of oxygen and nitrogen, with the remainder of valences comprising hydrogen or a mono-valent group such as a halogen, an amide (—NHCOR), an alkoxide (—OR), or the like, where R is a carbyl group. In certain embodiments, the carbyl group has between about 3 and about 12, where one or more of the carbon atoms can be replaced with a hetero atom selected from the group consisting of oxygen and nitrogen, with the remainder of valences comprising hydrogen or a mono-valent group such as a halogen, an amide (—NHCOR), an alkoxide (—OR), or the like, where R is a carbyl group. In certain embodiments, the carbyl group has between about 4 and about 8, where one or more of the carbon atoms can be replaced with a hetero atom selected from the group consisting of oxygen and nitrogen, with the remainder of valences comprising hydrogen or a mono-valent group such as a halogen, an amide (—NHCOR), an alkoxide (—OR), or the like, where R is a carbyl group.

Suitable tri-alkyl phosphates include, without limitations, alkyl group having from about 3 to about 20 carbon atoms, where one or more of the carbon atoms can be replaced with a hetero atom selected from the group consisting of oxygen and nitrogen, with the remainder of valences comprising hydrogen or a mono-valent group such as a halogen, an amide (—NHCOR), an alkoxide (—OR), or the like, where R is a carbyl group. In certain embodiments, the tri-alkyl phosphate includes alkyl groups having from about 4 to about 12 carbon atoms, where one or more of the carbon atoms can be replaced with a hetero atom selected from the group consisting of oxygen and nitrogen, with the remainder of valences comprising hydrogen or a mono-valent group such as a halogen, an amide (—NHCOR), an alkoxide (—OR), or the like, where R is a carbyl group. In other embodiments, the tri-alkyl phosphate includes alkyl groups having from about 4 to about 8 carbon atoms, where one or more of the carbon atoms can be replaced with a hetero atom selected from the group consisting of oxygen and nitrogen, with the remainder of valences comprising hydrogen or a mono-valent group such as a halogen, an amide (—NHCOR), an alkoxide (—OR), or the like, where R is a carbyl group. Such phosphates can be produced by reacting a phosphate donor such as phosphorus pentoxide and a mixture of alcohols in desired proportions.

Hydrocarbon Base Fluids

Suitable hydrocarbon base fluids for use in this invention includes, without limitation, synthetic hydrocarbon fluids, petroleum based hydrocarbon fluids, natural hydrocarbon (non-aqueous) fluids, those fluids described in U.S. Published Application No. 20050189911, incorporated herein by reference, or other similar hydrocarbons or mixtures or combinations thereof. The hydrocarbon fluids for use in the present invention have viscosities ranging from about $0.5\times10^{-6}$ to about $600\times10^{-6}$ $m^2/s$ (0.5 to about 600 centistokes). Exemplary examples of such hydrocarbon fluids include, without limitation, polyalphaolefins, polybutenes, polyolesters, biodiesels, simple low molecular weight fatty esters of vegetable or vegetable oil fractions, simple esters of alcohols such as Exxate from Exxon Chemicals, vegetable oils, animal oils or esters, other essential oil, diesel having a low or high sulfur content, kerosene, jet-fuel, white oils, mineral oils, mineral seal oils, hydrogenated oil such as PetroCanada HT-40N or IA-35 or similar oils produced by Shell Oil Company, internal olefins (IO) having between about 12 and 20 carbon atoms, linear alpha olefins having between about 14 and 20 carbon atoms, polyalpha olefins having between about 12 and about 20 carbon atoms, isomerized alpha olefins (IAO) having between about 12 and about 20 carbon atoms, VM&P Naptha, Linpar, Parafins having between 13 and about 16 carbon atoms, and mixtures or combinations thereof.

Suitable polyalphaolefins (PAOs) include, without limitation, polyethylenes, polypropylenes, polybutenes, polypentenes, polyhexenes, polyheptenes, higher PAOs, copolymers thereof, and mixtures thereof. Exemplary examples of PAOs include PAOs sold by Mobil Chemical Company as SHF fluids and PAOs sold formerly by Ethyl Corporation under the name ETHYLFLO and currently by Albemarle Corporation under the trade name Durasyn. Such fluids include those specified as ETYHLFLO 162, 164, 166, 168, 170, 174, and 180. Well suited PAOs for use in this invention include bends of about 56% of ETHYLFLO now Durasyn 174 and about 44% of ETHYLFLO now Durasyn 168.

Exemplary examples of polybutenes include, without limitation, those sold by Amoco Chemical Company and Exxon Chemical Company under the trade names INDOPOL and PARAPOL, respectively. Well suited polybutenes for use in this invention include Amoco's INDOPOL 100.

Exemplary examples of polyolester include, without limitation, neopentyl glycols, trimethylolpropanes, pentaerythriols, dipentaerythritols, and diesters such as dioctylsebacate (DOS), diactylazelate (DOZ), and dioctyladipate.

Exemplary examples of petroleum based fluids include, without limitation, mineral spirits, white mineral oils, paraffinic oils, and medium-viscosity-index (MVI) naphthenic oils having viscosities ranging from about $0.5\times10^{-6}$ to about $600\times10^{-6}$ $m^2/s$ (0.5 to about 600 centistokes) at 40° C. Exemplary examples of mineral spirits include those sold by SynOil Fluids under trade names SF-840, SF-800, SF-770 and TG-740, BPAmoco under trade names Buck Creek and C2000, and Enerchem under trade name Fracsol. Exemplary examples of white mineral oils include those sold by Witco Corporation, Arco Chemical Company, PSI, and Penreco. Exemplary examples of paraffinic oils include solvent neutral oils available from Exxon Chemical Company, high-viscosity-index (HVI) neutral oils available from Shell Chemical Company, and solvent treated neutral oils available from Arco Chemical Company. Exemplary examples of MVI naphthenic oils include solvent extracted coastal pale oils available from Exxon Chemical Company, MVI extracted/acid treated oils available from Shell Chemical Company, and naphthenic oils sold under the names Hydro-Cal and Calsol by Calumet and hydrogenated oils such as HT-40N and IA-35 from PetroCanada or Shell Oil Company or other similar hydrogenated oils.

Exemplary examples of vegetable oils include, without limitation, castor oils, corn oil, olive oil, sunflower oil, sesame oil, peanut oil, palm oil, palm kernel oil, coconut oil, butter fat, canola oil, rape seed oil, flax seed oil, cottonseed oil, linseed oil, other vegetable oils, modified vegetable oils such as crosslinked castor oils and the like, and mixtures thereof. Exemplary examples of animal oils include, without limitation, tallow, mink oil, lard, other animal oils, and mixtures thereof. Other essential oils will work as well. Of course, mixtures of all the above identified oils can be used as well. Crude oils, Gas Condensates, Liquified Petroleum Gasses, and blends or mixtures of all the above will work with present invention in the presence of Nitrogen gas, and or Carbon Dioxide gas or liquid.

Polymeric Gelling Agents

Suitable other gelling agents for use in this invention include, without limitation, any gelling agent. Exemplary gelling agents includes ethylene-acrylic acid copolymer, ethylene-methacrylic acid copolymers, ethylene-vinyl acetate copolymers, ethylene-maleic anhydride copolymers, butadiene-methacrylic acid copolymers, ethylene-methacrylic acid copolymers, styrene-butadiene-acrylic acid copolymers, styrene-butadiene-methacrylic acid copolymers, or other copolymer including monomers having acid moieties or mixtures or combinations thereof. Exemplary examples phosphate ester gelling agents of this invention include, without limitation, variants of the phosphate esters WEC HGA 37, WEC HGA 70, WEC HGA 71, WEC HGA 72, WEC HGA 702 or mixtures or combinations thereof using tri-alkyl-phosphates in place of tri-ethyl-phosphate, available from Weatherford International iso-octyl, 2-ethylhexyl, phosphate esters or other phosphate esters from P-2, and similar phosphonate esters of high molecular weight alcohols available from Halliburton or mixtures or combinations thereof. Other suitable gelling agents include, without limitation, Geltone II available from Baroid, Ken-Gel available from Imco or the like.

Crosslinking Agents

Suitable cross-linking agent for use in this invention include, without limitation, any suitable cross-linking agent for use with the gelling agents. Exemplary cross-linking agents include, without limitation, di-, tri or tetra-valent metal salts such as calcium salts, magnesium salts, cerium salts, barium salts, copper (copprous and cupric) salts, cobalt salts, chromium salts, manganese salts, titanium salts, iron salts (ferrous and ferric), zinc salts, zirconium salts, aluminum salts, any other transition metal, actinide metal or lanthanide metal salt capable of acting as a phosphate ester cross-linking agent or mixtures or combinations thereof. Exemplary examples cross-linking agent for use with phosphate esters include, without limitation, WEC HGA 44, WEC HGA 44AX, WEC HGA 48, WEC HGA 55se, WEC HGA 55s, WEC HGA 61, WEC HGA Super 61, WEC HGA 65 or mixtures or combinations thereof available from Weatherford International.

Anionic Surfactants

The preferred anionic surfactant to be used with the cationic polymer is sodium lauryl sulfate, but any alkali metal alkyl sulfate or sulfonate having 8-22 carbon atoms may be used, and alkyl ether sulfates and sulfonates having 8-22 carbon atoms are included within our term "counterionic surfactant". Commercial forms of sodium lauryl sulfate including minor or even significant amounts of other similar surfactants may be used. Other common anionic surfactants may also be useful.

Alcohols

The alkyl alcohol is preferably a linear alkyl one having from 8 to 22 carbon atoms or, more preferably, 8-15 carbon atoms. Commercial forms of lauryl alcohol having other alcohols as a minor ingredient are satisfactory. We have found that some commercial forms of sodium lauryl sulfate contain lauryl alcohol in amounts sufficient to satisfy the lauryl alcohol requirements of our invention, and accordingly such sodium lauryl sulfates may sometimes be used as the anionic surfactant of our invention together with a cationic polymer, but without additional moieties of lauryl alcohol or other hydrophobic alcohol as described herein. We may substitute sodium lauryl ether sulfate for the sodium lauryl sulfate; lauryl alcohol should be added separately where this substitution is made.

Amine Oxides

When used, the amine oxide promoter is preferably lauryl amine oxide, but we may use any amine oxide of the formula $R^1R^2R^3NO$, preferably $R^1N(CH_3)_2O$, where $R^1$ is an alkyl group of 8-22 carbon atoms, and $R^1$ and $R^2$ are independently alkyl groups having from 1 to 4 carbon atoms. We may use any amine oxide of the formula $R^1R^2R^3N\rightarrow O$ as defined by Dahayanake et al in U.S. Pat. No. 6,258,859, which is hereby incorporated by reference in its entirety. See also Tillotson U.S. Pat. No. 3,303,896 and Thompson U.S. Pat. No. 4,108,782, which are also incorporated by reference in their entirety for their descriptions of amine oxides. Generally, up to 1% by weight may be used.

Amphoteric Surfactants

When used, the amphoteric surfactant is preferably a betaine such as cocamidopropyl betaine, but we may use other types of amphoteric surfactants, including aminopropionate and sultaines. We may use any of the surfactant betaines listed or described by Sake et al in U.S. Pat. No. 6,284,230, which is hereby incorporated by reference in its entirety.

The weight ratio of cationic polymer to alkyl sulfate is generally 10:1 to 1.1:1, but the ratio may also be based on the molar ratio of cationic moieties on the polymer and the anionic sites on the surfactant.

Where an anionic polymer is used, we prefer to use a homopolymer of "AMPSA"—acrylamidomethylpropyl sulfonic acid—together with a common quaternery surfactant generally in the same ratios as recited above for cationic polymers and anionic surfactants, provided the absolute value of the Zeta Potential is at least 20. This may be done with or without gel promoters, but where there are no gel promoters, the concentration of anionic polymer will be significantly higher than where a gel promoter is used.

Choline Compounds

Suitable choline compounds for use in this invention include, without limitation, any choline salt. Exemplary examples include, without limitation, choline halides, choline sulfate, choline sulfite, choline phosphate, choline phosphite, choline carboxylates, or mixtures or combinations thereof. Exemplary examples of choline halides including choline fluoride, choline chloride, choline bromide, choline iodide, or mixtures or combinations thereof. Exemplary examples of choline carboxylates including, without limitation, choline formate, choline citrate, choline salicylate, choline propanate, similar choline carboxylates or mixtures or combinations thereof.

Amines

Suitable amines for use in the clay control compositions of this invention include, without limitation, di- and tri-alkyl substituted amines and mixtures or combinations thereof, where the alkyl groups include from 3 to 20 carbon atoms and/or hetero atoms. In certain embodiments, the clay control compounds can also include di-alkyl sulfides and di- and tri-alkyl phosphines where the alkyl groups include from 3 to 20 carbon atoms and/or hetero atoms.

Ammonium and Phosphonium Salts

Suitable ammonium salts for use in the clay control compositions of this invention include, without limitation, three general types of cationic materials: single-site cationic ammonium compounds, oligocationic ammonium compounds, and polycationic ammonium compounds and mixtures or combinations thereof. In certain embodiments, the clay control compound can also include phosphonium compounds and sulfonium compounds and mixtures or combinations thereof. Together the ammonium, phosphonium, and sulfonium compounds are sometimes referred to herein as "cationic formation control additives."

The single site amine and quaternaries useful as cationic formation control additives in my invention include di-, tri, and tetra-alkyl substituted amine and ammonium compounds wherein the alkyl groups include from 3 to 8 carbon atoms (Brown U.S. Pat. No. 2,761,835, incorporated herein by reference); substituted pyridine, pyridinium, morpholine and morphilinium compounds having from 1 to 6 carbon atoms in one or more substituent groups (Brown U.S. Pat. No. 2,761,840, incorporated herein by reference), additional heterocyclic nitrogen compounds such as histamine, imidazoles and substituted imidazoles, piperazines, piperidines, vinyl pyridines, and the like as described in Brown U.S. Pat. No. 2,761,836, incorporated herein by reference, the trialkylphenylammonium halides, dialkylmorpholinium halides and epihalohydrin derivatives described by Himes et al in the U.S. Pat. No. 4,842,073, incorporated herein by reference, and the allyl ammonium compounds of the formula $(CH_2{=}{-}CHCH_2)_nN^+(CH_3)_{4-n}X^-$; where $X^-$ is any anion which does not adversely react with the formation or the treatment fluid, described by Thomas and Smith in U.S. Pat. No. 5,211,239, incorporated herein by reference. In certain embodiments, the single site quaternaries are diallyl dimethyl ammonium chloride (DADMAC) (that is, the above formula where n=2 and $X^-$ is $Cl^-$), and tetramethyl ammonium chloride, sometimes referred to as TMAC.

Oligocations

Oligocationics useful as cationic formation control additives in my invention include di- and polyamines (up to 100 nitrogens) substituted with alkyl groups having up to 12 carbon atoms (one or more of the nitrogens may be quaternized) as described by Brown in U.S. Pat. No. 2,761,843, incorporated herein by reference, and polyquaternaries described by Krieg in U.S. Pat. No. 3,349,032, incorporated herein by reference, namely alkyl aryl, and alkaryl bis- and polyquaternaries wherein two quaternary ammonium nitrogens are connected by various connecting groups having from 2-10 carbon atoms. In certain embodiments, the poly site quanternaries are polyDADMAC reagents as described in U.S. Pat. No. 6,921,742 to Smith, incorporated herein by reference.

Polyquanternary Compounds

Polyquaternary (cationic) formation control additives useful in my invention include those described by McLaughlin in the U.S. Pat. Nos. 4,366,071 and 4,374,739, incorporated herein by reference, namely polymers containing repeating groups having pendant quaternary nitrogen atoms wherein the quaternizing moieties are usually alkyl groups but which can include other groups capable of combining with the nitrogen and resulting in the quaternized state. I may also use any of the numerous polymers including quaternized nitrogen atoms which are integral to the polymer backbone, and other polymers having repeating quaternized units, as described in U.S. Pat. No. 4,447,342. Nitrogen-based cationic moieties may be interspersed with and/or copolymerized with up to 65% by weight (in certain embodiments, 1% to 65% by weight) nonionics such as acrylamide and even some anionics such as acrylic acid or hydrolyzed acrylamide. Molecular weights of the polymers may be quite high-up to a million or more. Such copolymers are included in my definition of polycationic formation control additives useful in my invention.

Suitable metal ion formate salts for use in this invention include, without limitation, a compound of the general formula $(HCOO^-)_nM^{n+}$ and mixtures or combinations thereof, where M is a metal ion as set forth above and n is the valency of the metal ion.

Suitable metal ions for use in this invention include, without limitation, alkali metal ions, alkaline metal ions, transition metal ions, lanthanide metal ions, and mixtures or combinations thereof. The alkali metal ions are selected from the group consisting of $Li^+$, $Na^+$, $K^+$, $Rd^+$, $Cs^+$, and mixtures or combinations thereof. The alkaline metal ions are selected from the group consisting of $Mg^{2+}$, $Ca^{2+}$, $Sr^{2+}$, $Ba^{2+}$ and mixtures or combinations thereof. In certain embodiments, the transition metal ions are selected from the group consisting of $Ti^{4+}$, $Zr^{4+}$, $Hf^{4+}$, $Zn^{2+}$ and mixtures or combinations thereof. In certain embodiments, the lanthanide metal ions are selected from the group consisting of $La^{3+}$, $Ce^{4+}$, $Nd^{3+}$, $Pr^{2+}$, $Pr^{3+}$, $Pr^{4+}$, $Sm^{2+}$, $Sm^{3+}$, $Gd^{3+}$, $Dy^{2+}$, $Dy^{3+}$, and mixtures or combinations thereof.

Suitable polymers for use in the present invention to gel a formate solution includes, without limitation, hydratable polymers. Exemplary examples includes polysaccharide polymers, high-molecular weight polysaccharides composed of mannose and galactose sugars, or guar derivatives such as hydropropyl guar (HPG), hydroxypropylcellulose (HPC), carboxymethyl guar (CMG), carboxymethylhydropropyl guar (CMHPG), hydroxyethylcellulose (HEC) or hydroxypropylcellulose (HPC), carboxymethylhydroxyethylcellulose (CMHEC), Xanthan, scleroglucan, polyacrylamide, polyacrylate polymers and copolymers or mixtures thereof.

Compositional Ranges

For dewatering or the prevention of seawater ingress applications, the general concentration range of metal ion formate salt in water is between about 40% w/w and supersaturation. In certain embodiments, the concentration range of metal ion formate salt in water is between about 45% w/w and supersaturation. In other embodiments, the concentration range of metal ion formate salt in water is between about 50% w/w and supersaturation. In other embodiments, the concentration range of metal ion formate salt in water is between about 55% w/w and supersaturation. In other embodiments, the concentration range of metal ion formate salt in water is between about 60% w/w and supersaturation. In other embodiments, the concentration range of metal ion formate salt in water is between about 65% w/w and supersaturation. In other embodiments, the concentration range of metal ion formate salt in water is between about 70% w/w and supersaturation. In other embodiments, the concentration range of metal ion formate salt in water is sufficient to prepare a supersaturated solution. Of course one of ordinary art would understand that the concentration will depend on the required reduction in the amount of bulk and/or residual water left in the pipeline. In certain embodiments, the amount of metal ion formate salt in water can result in a supersaturated solution, where residual water in the pipeline will dilute the solution form supersaturated to saturated or below during the dewatering operation.

Crosslinking Delay Agents

Suitable polyhydroxy or polyol compounds for use in this invention include, without limitation, mono-saccharides, di-saccharides, low molecular weight poly-saccharides, polyol oligomers and/or low molecular weight polyol polymers. Exemplary examples include, without limitation, glycols, saccharides or sugars, oligosaccharides, low molecular weight polysaccharides, low molecular weight carbohydrates, low molecular starches, low molecular weight hydroxypolymers, or the like or mixtures or combinations thereof. Exemplary example of saccharides or sugar include, without limitation, monosaccharide including a single carbohydrate unit, disaccharide including two carbohydrate units, oligosaccharides including 3 to 10 carbohydrate units, and low molecular weight polysaccharide including 11-20 carbohydrate units, and mixtures and combinations thereof. Monosaccharides include, without limitation, trioses having 3 carbon atoms, tetrose including 4 carbon atoms, pentose including 5 carbon atoms, hexose including 6 carbon atoms, heptose including 7 carbon atoms, octose including 8 carbon atoms, nonose are monosaccharides including 9 carbon atoms, and monosaccharides with a larger carbon atom count, and mixture or combinations thereof. Trioses include, without limitation: aldotriose such as glyceraldehyde and ketotriose such as dihydroxyacetone and mixture or combinations thereof. Tetroses include, without limitation: aldotetrose such as erythrose or threose; and ketotetrose such as erythrulose and mixture or combinations thereof. Pentoses include, without limitation: aldopentoses such as arabinose, lyxose, ribose and xylose; and ketopentoses such as ribulose and xylulose and mixture or combinations thereof. Hexoses include, without limitation: Aldohexoses such as allose, altrose, galactose, glucose, gulose, idose, mannose and talose; Ketohexoses such as fructose, psicose, sorbose and tagatose and mixture or combinations thereof. Heptoses include, without limitation: Keto-heptoses such as mannoheptulose, sedoheptulose and mixture or combinations thereof. Octoses include, without limitation: octolose, 2-keto-3-deoxy-manno-octonate and mixture or combinations thereof. Nonoses include, without limitation: sialose. Exemplary example of delay agents include, without limitation, Cellobiose, β-D-Glucopyranosyl-(4)-D-glucose, 4-O-β-D-Glucopyranosyl-D-glucose, Gentiobiose, β-D-Glucopyranosyl-(6)-D-glucose, 6-O-β-D-Glucopyranosyl-D-glucose, Isomaltose, α-D-Glucopyranosyl-(6)-D-glucose, 6-O-α-D-Glucopyranosyl-D-glucose, Melibiose, α-D-Galactopyranosyl-(6)-D-glucose, 6-O-α-D-Galactopyranosyl-D-glucose, Primeverose, β-D-Xylopyranosyl-(6)-D-glucose, 6-O-β-D-Xylopyranosyl-D-glucose, Rutinose,α-L-Rhamnopyranosyl-(6)-D-glucose, 6-O-α-L-Rhamnopyranosyl-D-glucose, Sucrose, Lactose, Amylose, Amylopectin, Glycogen, Sorbitol, Maltodextrin, a lightly hydrolyzed (DE 10-20) starch product used as a bland-tasting filler and thickener, various corn syrups (DE 30-70), viscous solutions used as sweeteners and thickeners in many kinds of processed foods. Dextrose (DE 100), commercial glucose, prepared by the complete hydrolysis of starch, high fructose syrup, made by treating dextrose solutions to the enzyme glucose isomerase, until a substantial fraction of the glucose has been converted to fructose, and mixtures or combinations thereof. Exemplary examples of polyol oligomers include oligomers of vinyl alcohol, oligomers of 2-hydroxyethylhexylmethacrylate or other oligomers or low molecular weight polymers having at least one hydroxy unit per monomer unit in the oligomer or polymer.

For acylamide systems, the gelation delaying system, which includes a buffering subsystem having a pKa value between about a 3.5 to about 6.8, functions: (1) to buffer a pH of the gel compositions of this invention so that ammonia generated by the initial hydrolysis reaction of the crosslinkable polymer system does not increase the solution pH, and (2) to compete with the polymer carboxylate groups for sites on the crosslinking agents in the cross-linking system so that the small amount of hydrolysis that occur before the buffer capacity is exceeded (e.g., due to formation temperatures) is not sufficient to cause gelation of the composition. These two functions inhibit gelation until the composition has propagated into the matrix. Gelation time delays are dependent on the molecular weight and polymer concentration in the composition, on the buffer type and concentration, and on the temperature of the subterranean formation.

The present process enables the practitioner to control gelation rate. Gelation rate is defined as the degree of gel formation as a function of time or, synonymously, the rate of crosslinking of the polyacrylamide in the gelation solution. The degree of crosslinking may be quantified in terms of gel fluidity and/or rigidity. Generally, gel fluidity decreases and gel rigidity increases as the number of crosslinks within a gel increases. The gelation delaying agent and buffer inhibit hydrolysis of the polyacrylamide and increase the time until significant gelation occurs. Gelation is delayed by the buffer subsystem which competes with the crosslinking subsystem for the polymer carboxylate for sites, thereby slowing the crosslinking reaction and because the hydrolysis of polyacrylamide is severely retarded in the pH range of about 3.5 to about 6.8. After the gel composition has been placed within the area to be treated, hydrolysis of the crosslinkable polymer system occurs. When the amount of ammonia released from the hydrolysis of the amide group on the polyacrylamide to form a carboxylate group exceeds the buffer capacity of the crosslink delay system, the pH of the composition will increase in situ, the composition will begin to gel.

DETAILED DESCRIPTION OF THE DRAWINGS

Referring now to FIGS. 1A-G, an embodiment of a method for removing accumulated liquids from a horizontal section of a horizontal well borehole 100. Looking at FIGS. 1A, a horizontal well is shown to include a vertical section 102, a heal section 104, a horizontal run section 106, and a toe section 108. The vertical section 102 is that part of the borehole 100 extending from a surface 110 to the heal section 104. The horizontal sections 106 and 108 include perforated or screened regions 112 through which formation gas and liquids enter the borehole 100. The horizontal run section 106 is that portion of the borehole 100 in which accumulated liquids 114 can obstruct gas flow and adversely affect gas production from the well 100 or create section of slug flow or cause unacceptable foaming within the horizontal sections 106 and 108 of the well 100. The toe section 108 of the well borehole 100 is that section of the well 100 having a sufficient length so that once a gelled pill has been formed in the borehole at a start of the toe section 108, gas produced in the toe section 108 will be sufficient to push the gelled pill through the horizontal run section 106 to the heal section 104 for uplift to the surface 110.

Figure 1B:
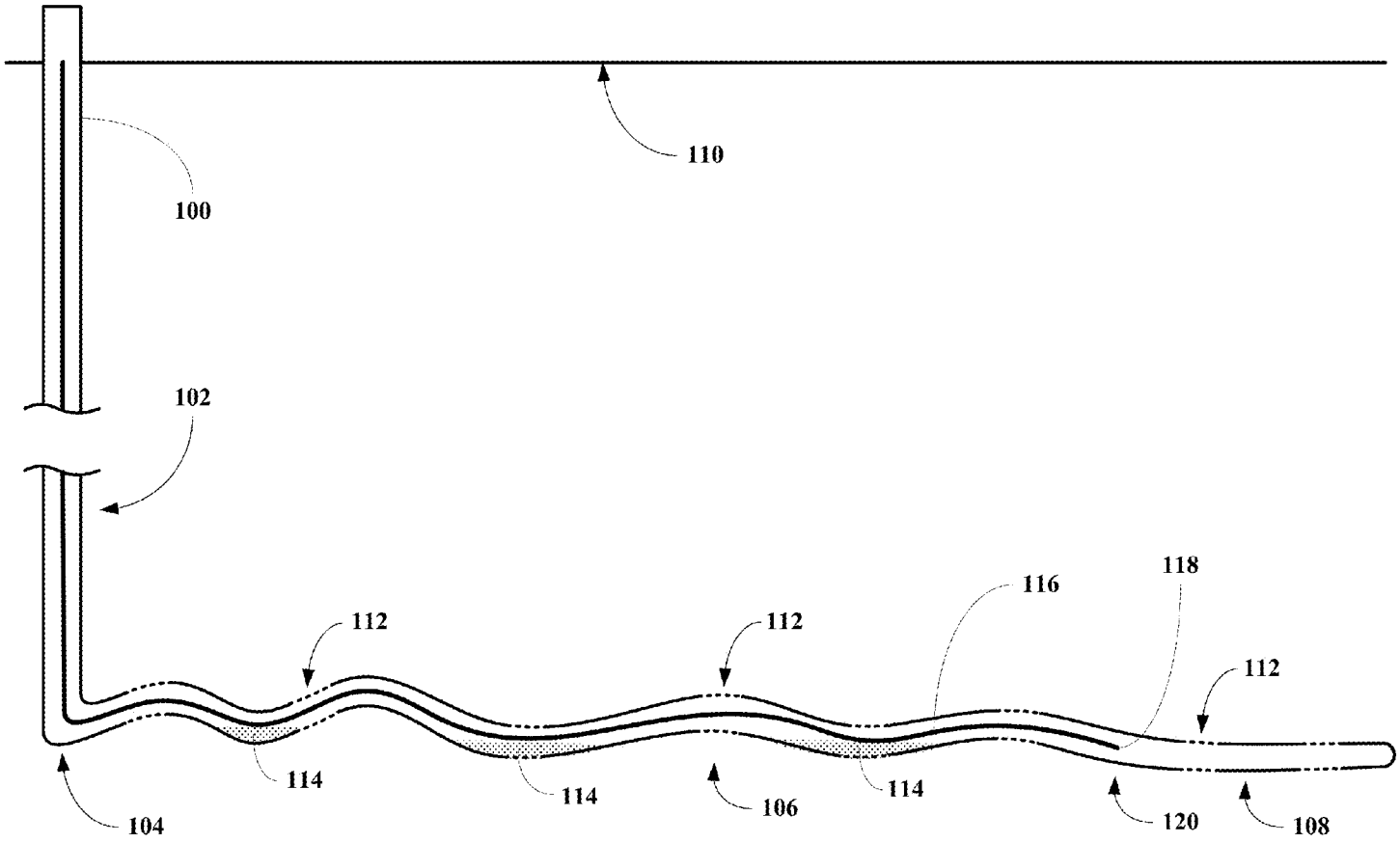
Figure 1C:
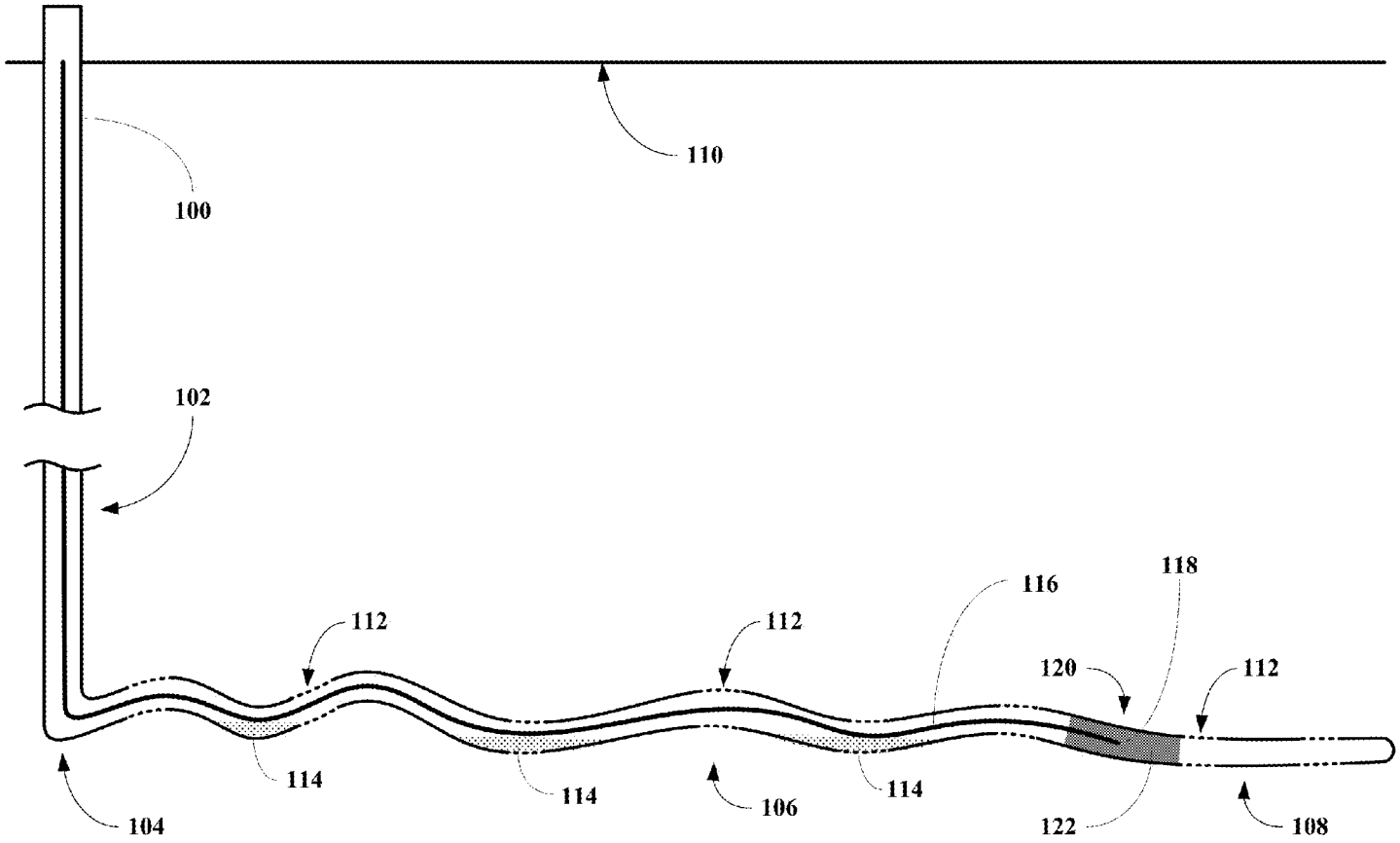
Figure 1D:
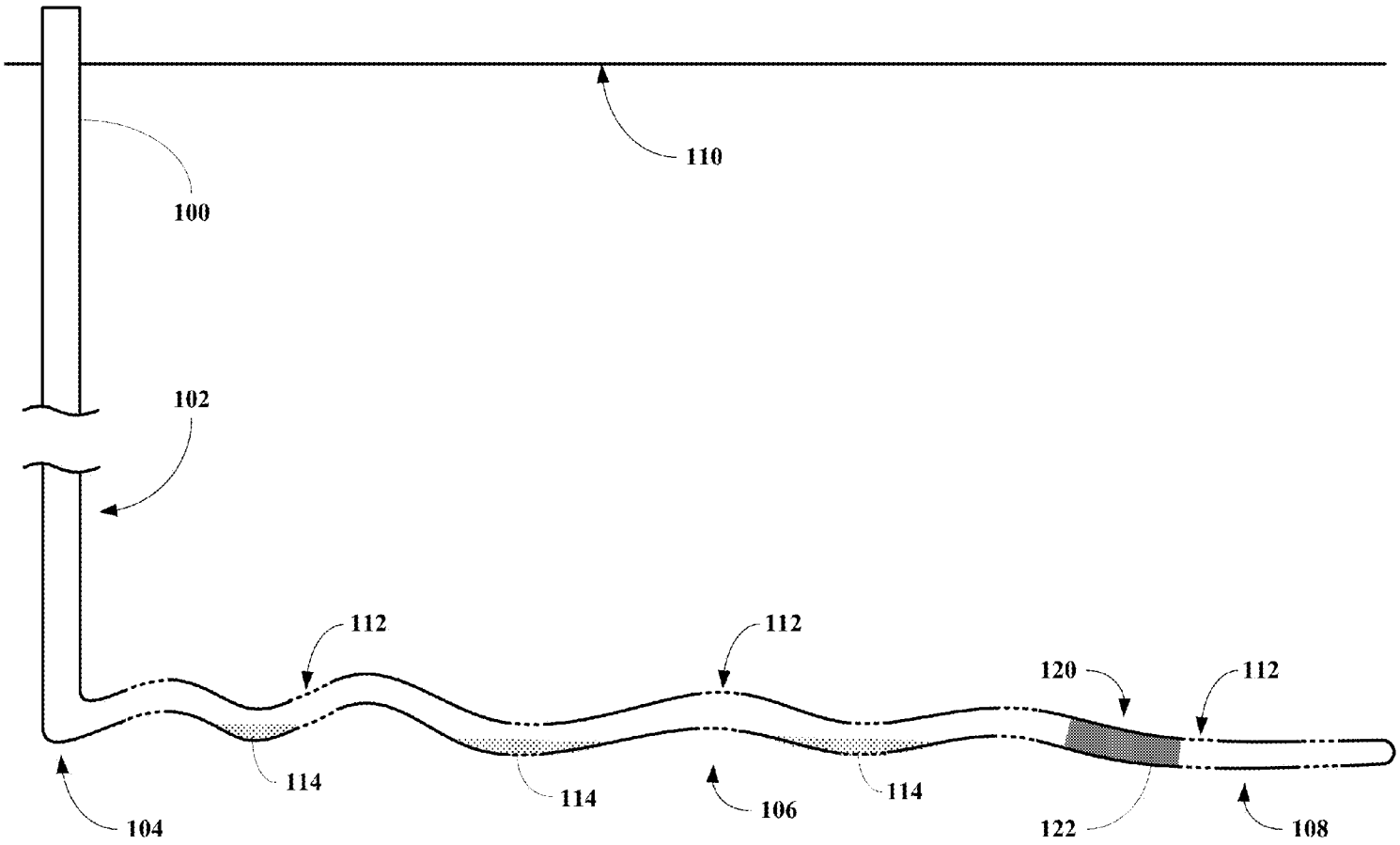
Figure 1E:
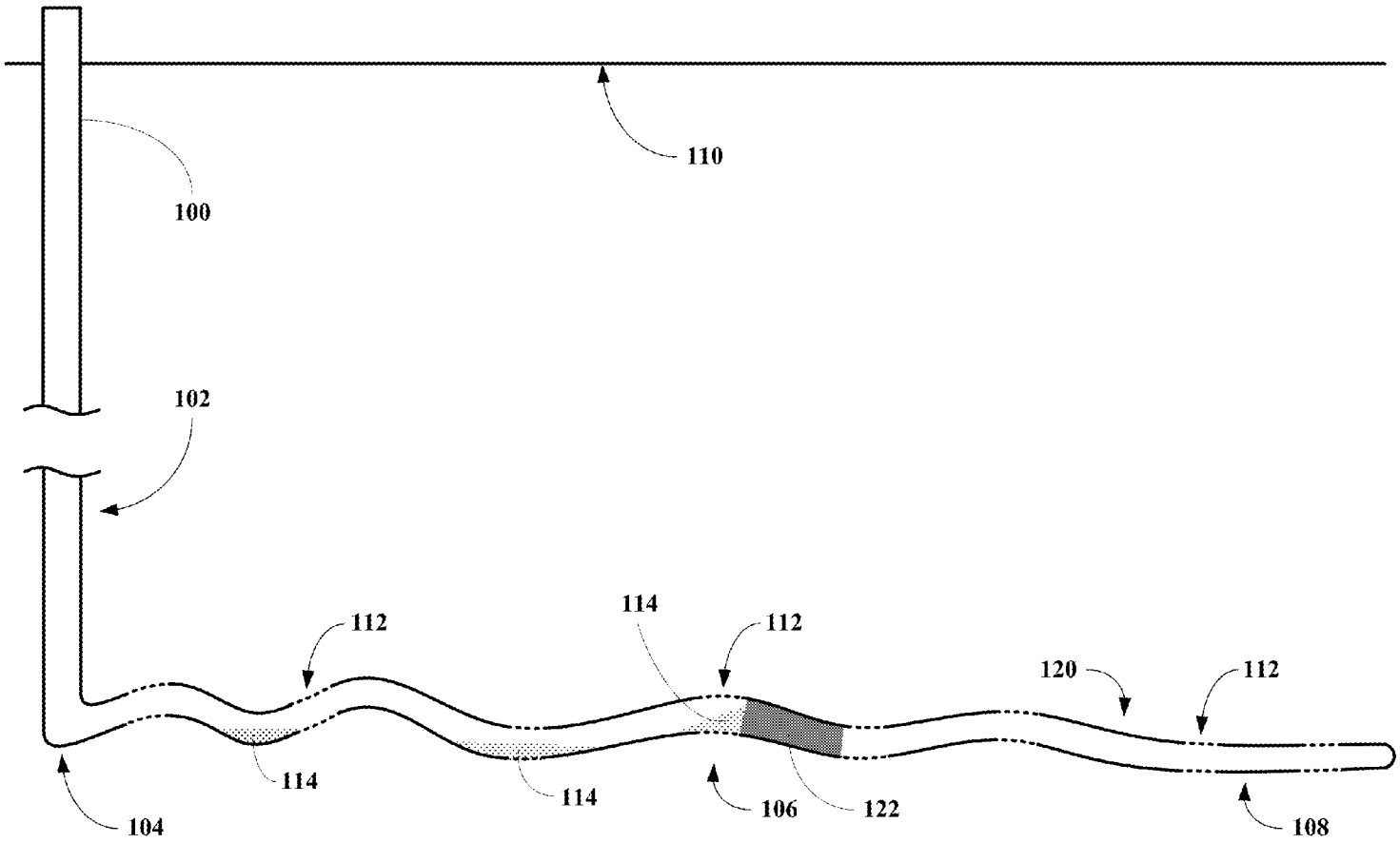
Figure 1F:
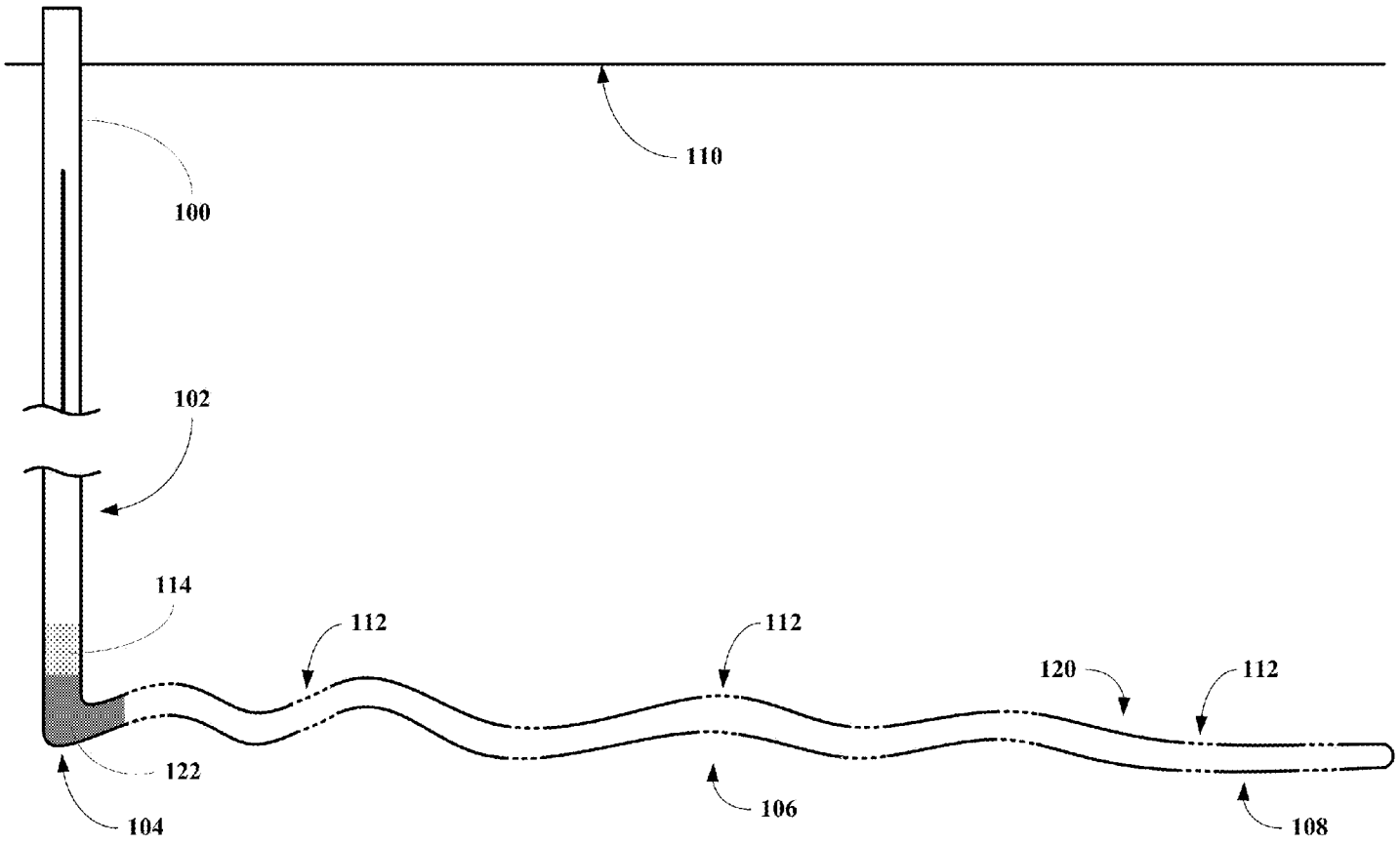
Figure 1G:
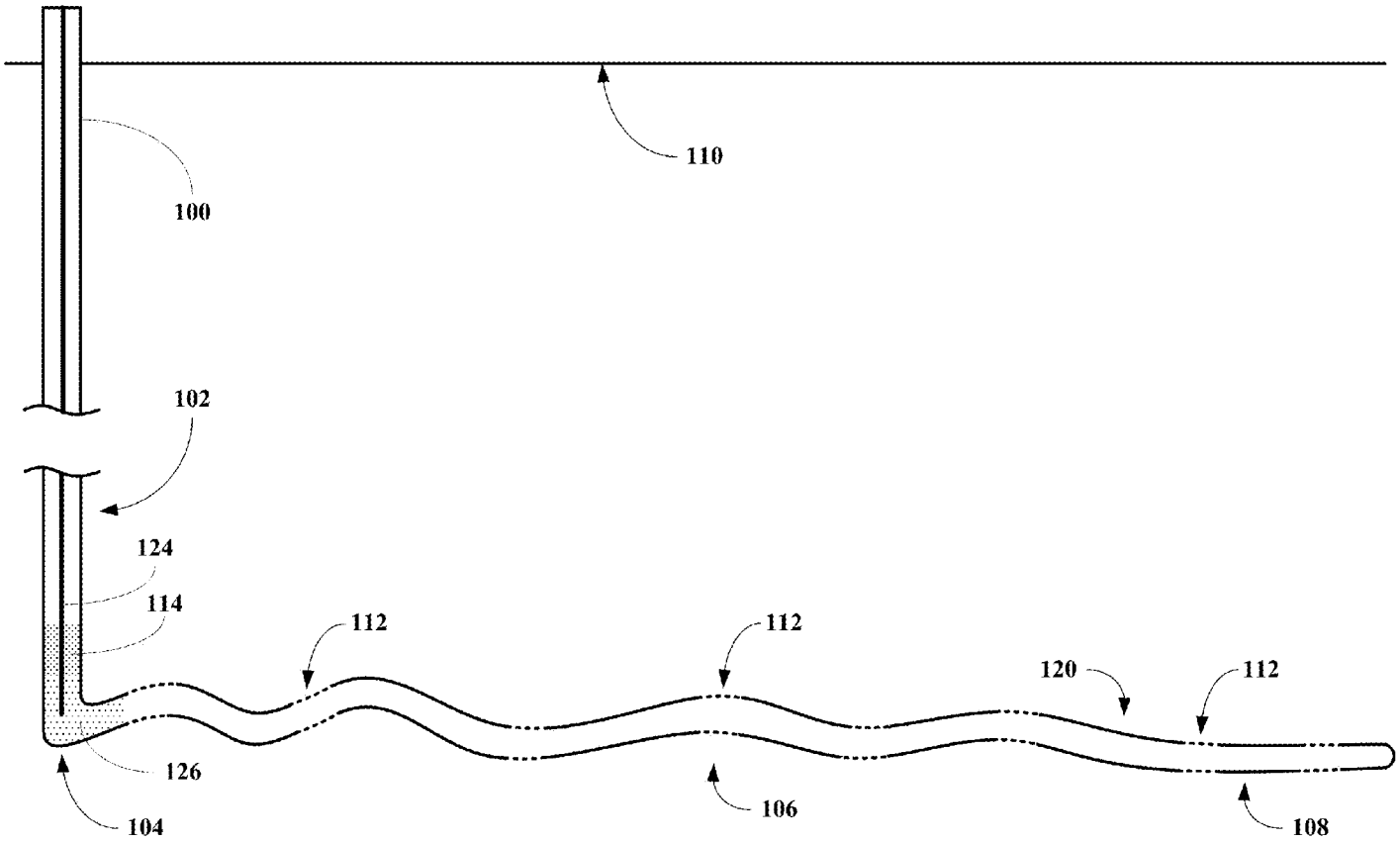
Figure 1H:
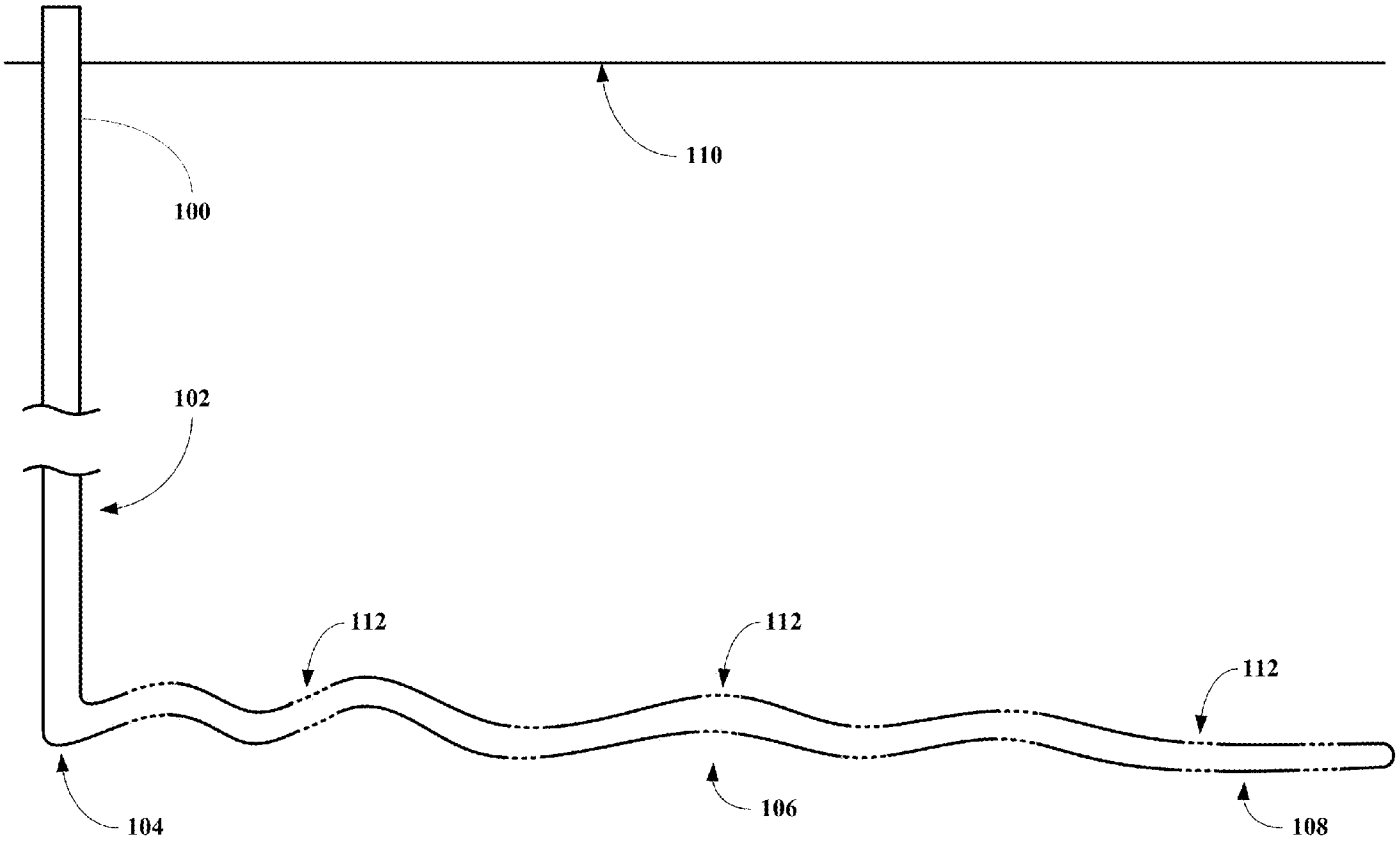

Looking at FIG. 1B, an injection tube 116 is run into the borehole 100 until its distal end 118 is at or near a start location 120 of the toe section 108. Looking at FIG. 1C, a gellable fluid is injected into the borehole 100 at the location 120 to form a gelled pill 122. Looking at FIG. 1D, the injection tube 116 has been removed from the well 100. Looking at FIG. 1E, the pill 122 have been moved along the horizontal section 106 of the well 100 pushing the accumulated liquids 114 in front of the pill 122. Looking at FIG. 1F, the pill 122 has been moved into the heal section 104 of the well 100 with the accumulated liquids 114 pushed into the vertical section 102 of the well 100. At this point, the pill and the accumulated liquids 114 may be directly lifted to the surface of the well 100. Alternatively, as shown in FIG. 1G, an injection tube 124 is inserted into the gelled pill 122 and a breaker composition is injected into the gelled pill 122 to produce a broken pill 126. Alternately, a breaker compound maybe injected into the borehole annulus, where the breaker would naturally fall into and accumulates in the heel section 104, thus breaking any pills entering the heel section 104. The broken pill 126 and the accumulated liquids 114 are then lifted to the surface 110 producing a well cleared of accumulated liquids as shown in FIG. 1H. Of course, it should be recognized that the composition of the gelled pill may include one or a plurality of breaking agents in the composition timed so that the pill is fully broken at it arrives in the heal section of the well. Alternatively, the gelled pill may undergo viscosity breaking overtime after peak viscosity, where the break time is designed to permit the pill to traverse the horizontal run section so that when the pill arrives at the heal section, the pill will be fully broken. Alternatively, a breaker injection tubing may be inserted into the well so that one or a plurality breaker agents may be injected into the pill as it passes outlets in the tube so that when the pill arrives at the heal section, the pill will be fully broken.

Referring now to FIGS. 2A-G an embodiment of a method for removing accumulated liquids from a horizontal section of a horizontal well borehole 200. Looking at FIGS. 2A, a horizontal well is shown to include a vertical section 202, a heal section 204, a horizontal run section 206, and a toe section 208. The vertical section 202 is that part of the borehole 200 extending from a surface 210 to the heal section 204. The horizontal sections 206 and 208 include perforated or screened regions 212 through which formation gas and liquids enter the borehole 200. The horizontal run section 206 is that portion of the borehole 200 in which accumulated liquids 214 can obstruct gas flow and adversely affect gas production from the well or create section of slug flow or cause unacceptable foaming within the horizontal sections 206 and 208 of the well 200. The toe section 208 of the well borehole 200 is that section of the well having a sufficient length so that once a gelled pill has been formed in the borehole at a start of the toe section 208, gas produced in the toe section 208 will be sufficient to push the gelled pill through the horizontal run section 206 to the heal section 204 for uplift to the surface 210. The borehole 200 is shown here with an injection tube 216 run into it until its distal end 218 is at or near a start location 220 of the toe section 208.

Figure 2A:
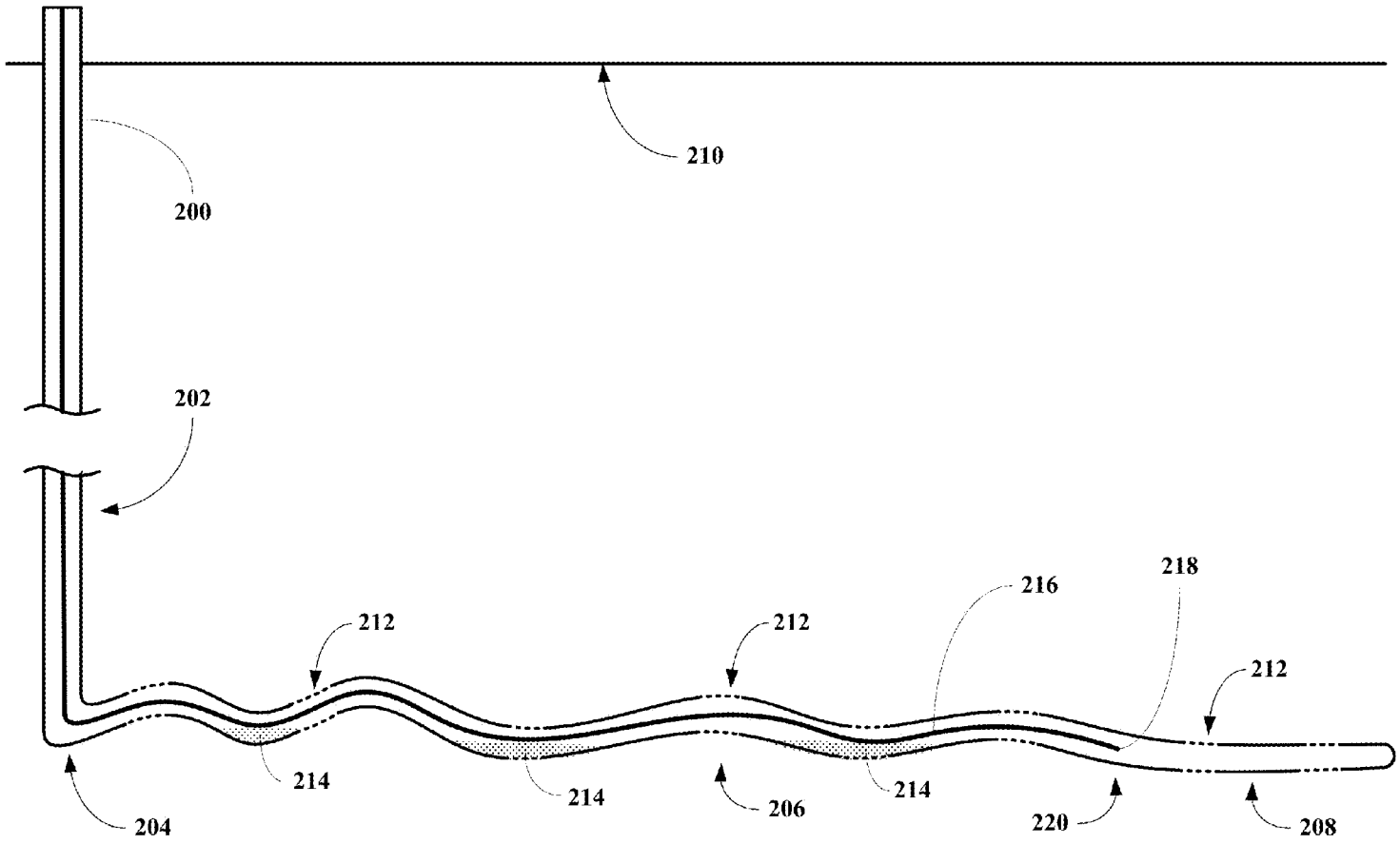
FIGS. 2A-G depict another embodiment of a method for clearing a horizontal section of a well of accumulated liquids using a gelled pill of this invention.
Figure 2B:
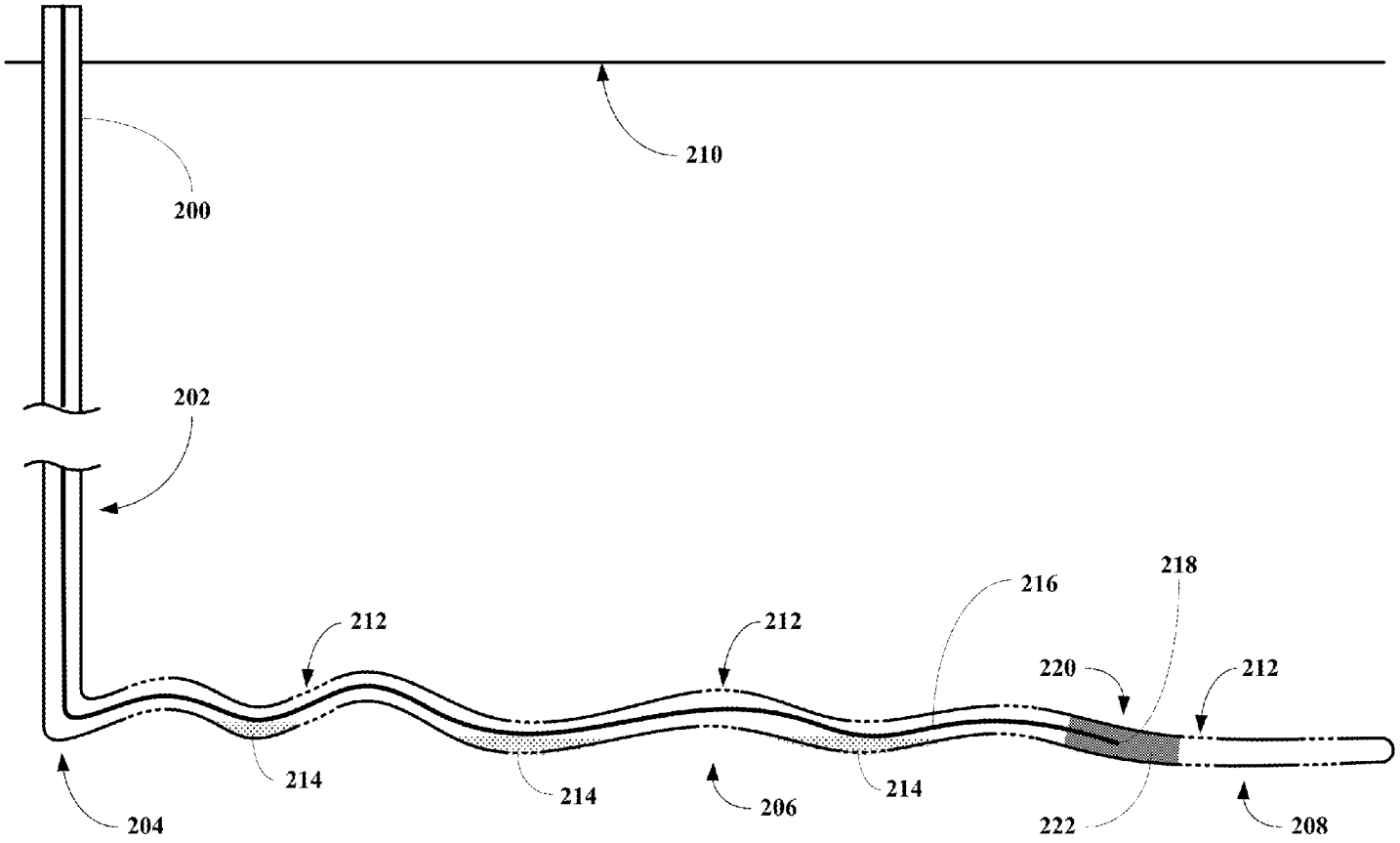
Figure 2C:
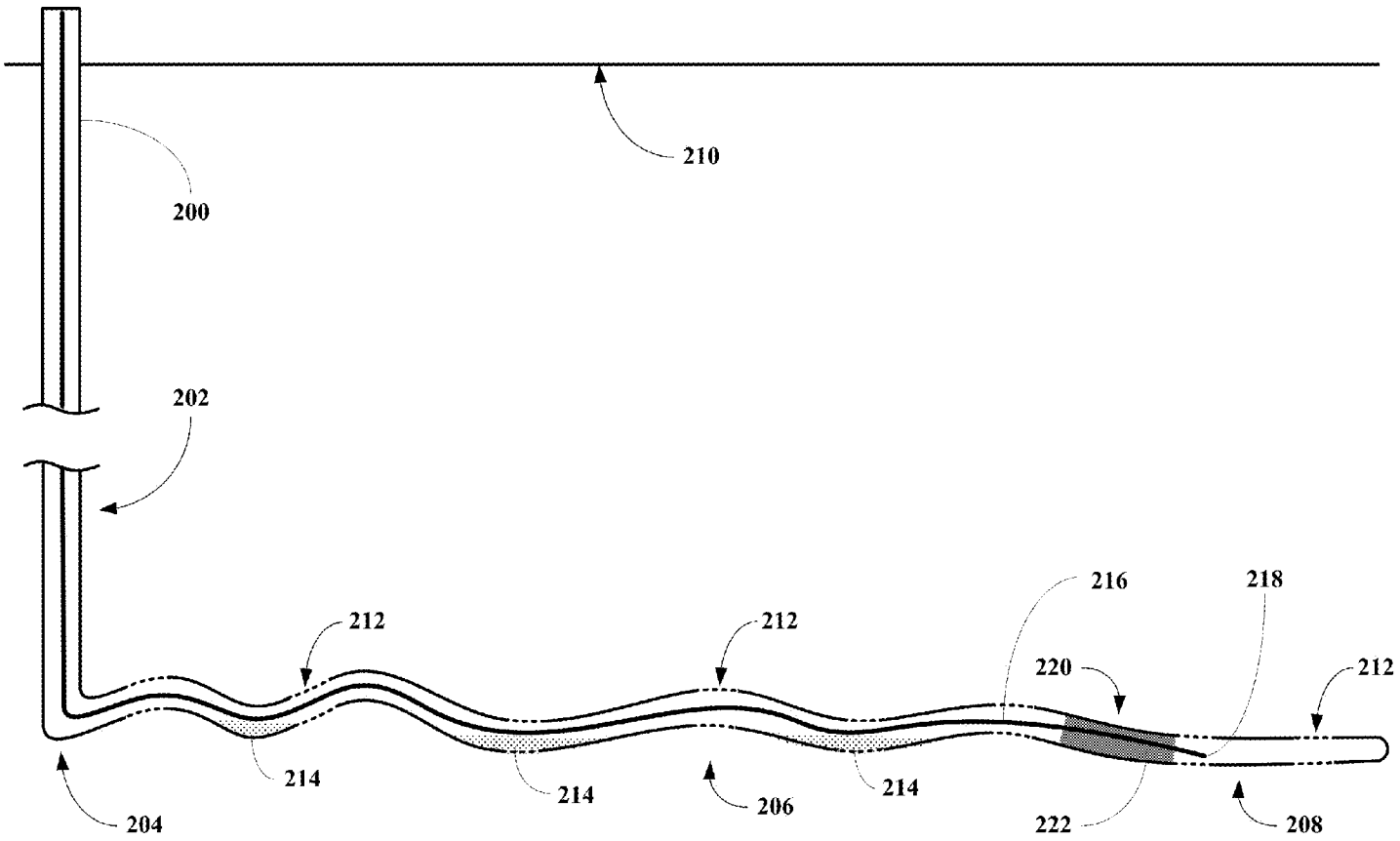
Figure 2D:
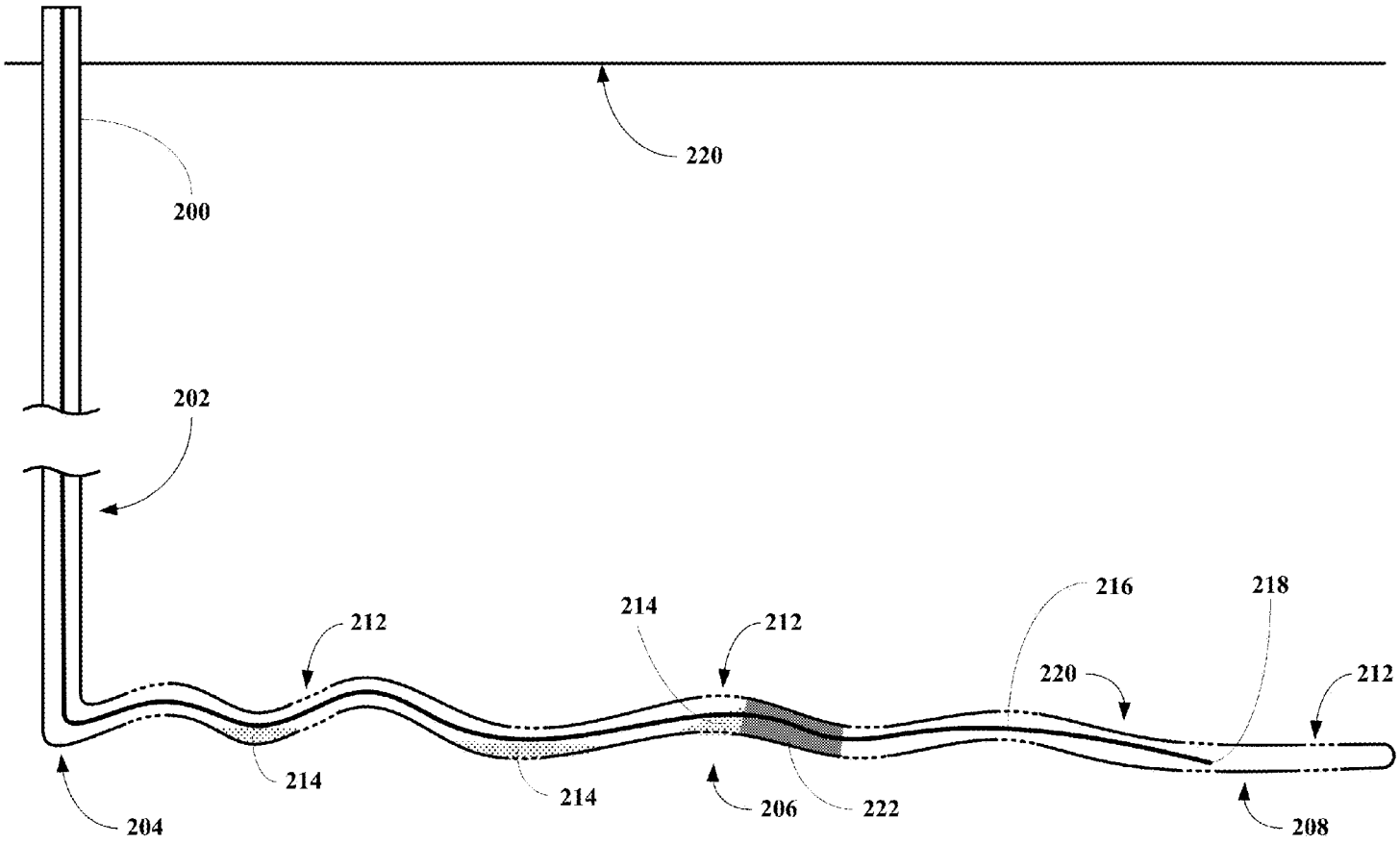
Figure 2E:
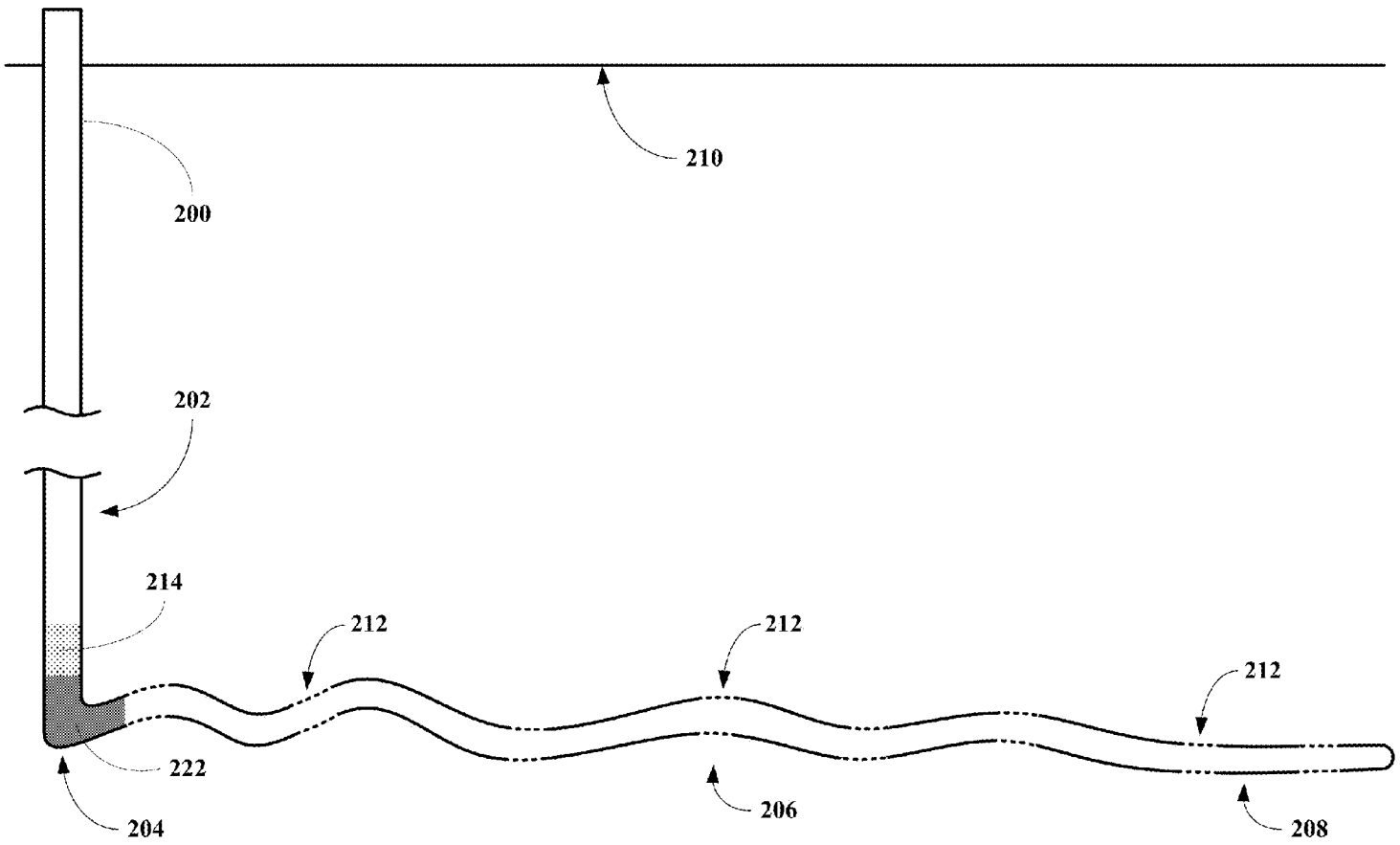
Figure 2F:
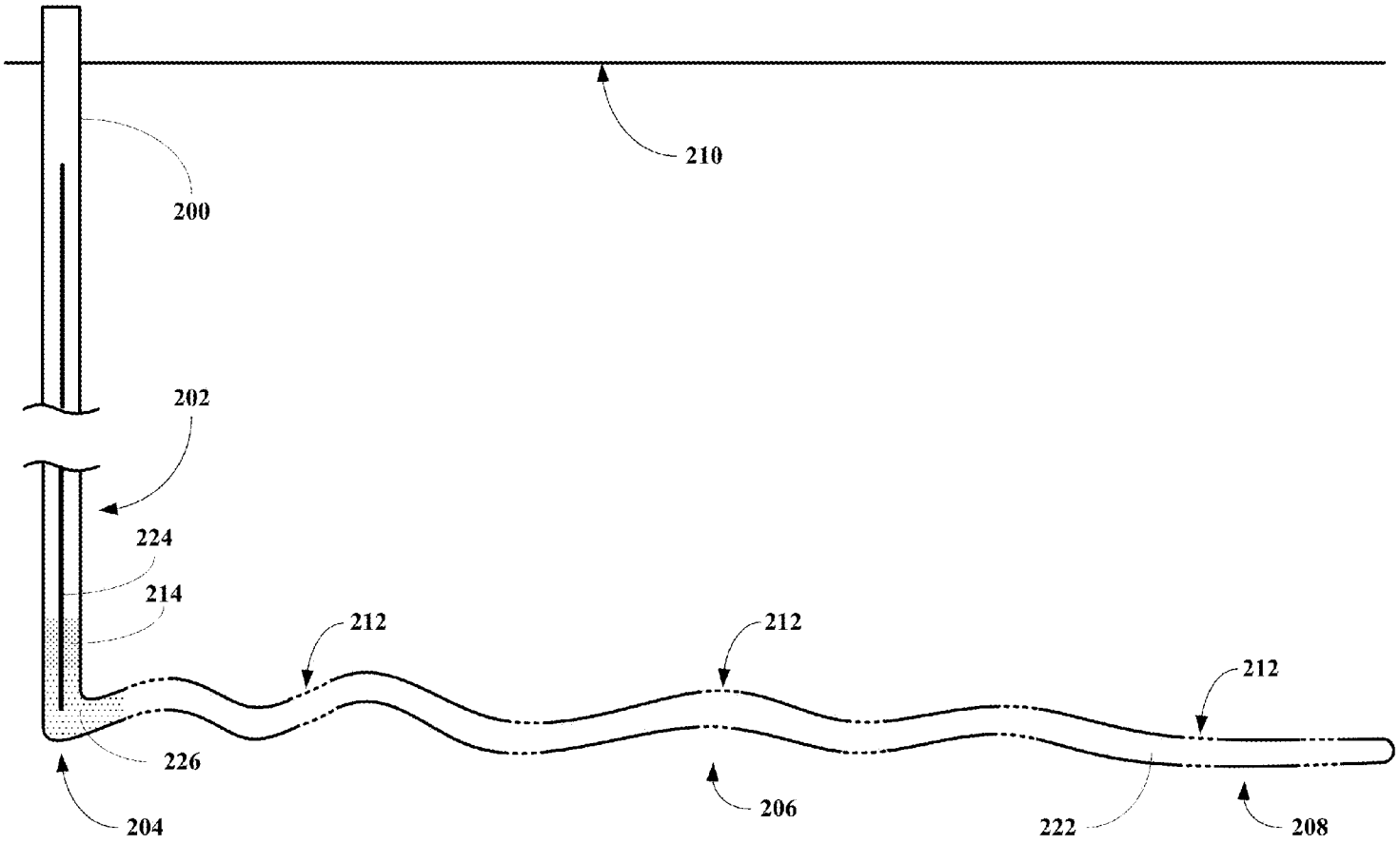
Figure 2G:
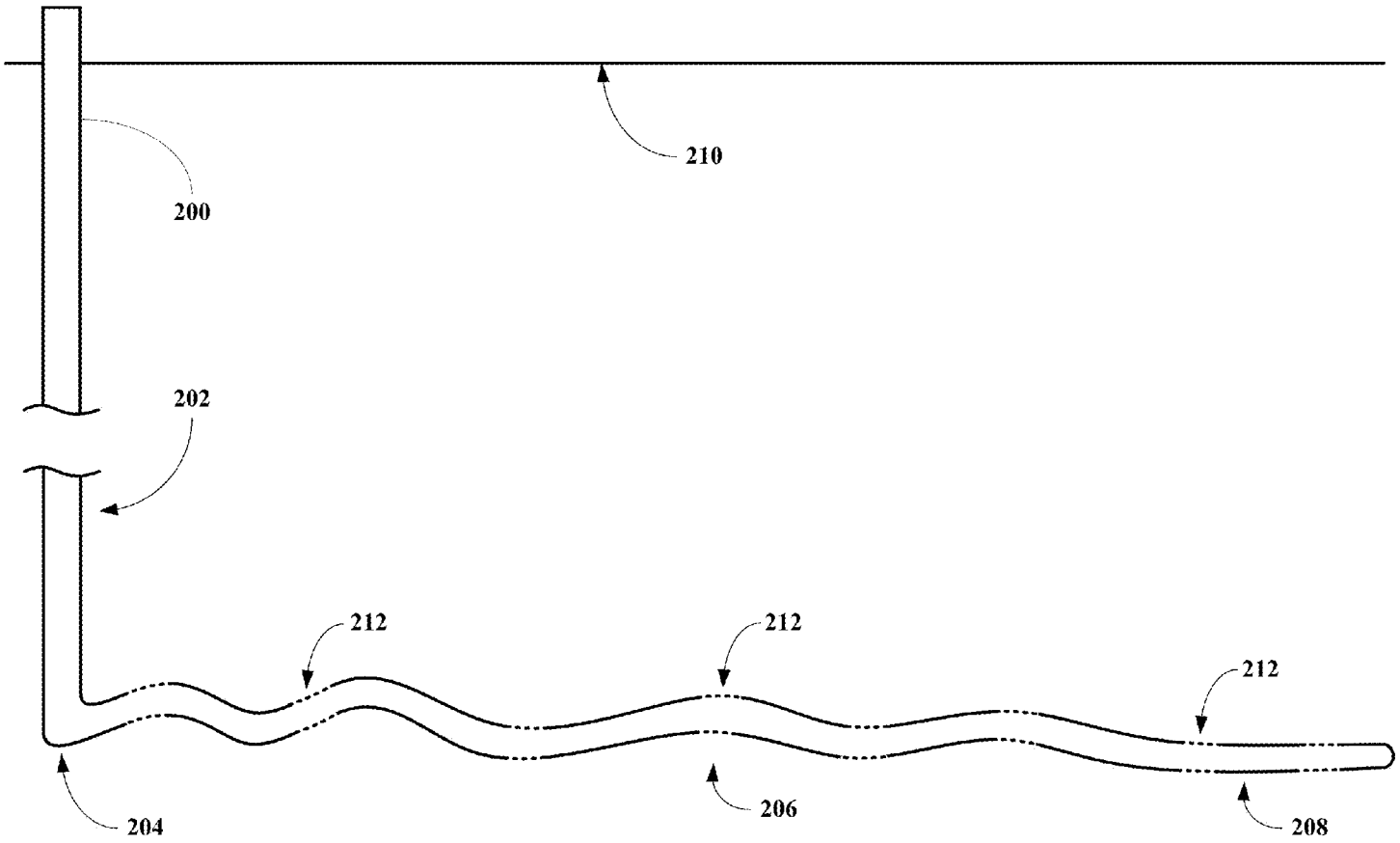

Looking at FIG. 2B, a gellable fluid is injected into the borehole 200 at the location 220 to form a gelled pill 222. Looking at FIG. 2C, the injection tube 216 remains in the well 200 so that gas from the surface may be injected into the toe section to assist in pushing the gelled pill 222 through the horizontal section 206. Looking at FIG. 2D, the pill 222 have been moved along the horizontal section 206 of the well pushing the accumulated liquids 214 in front of the pill 222. Looking at FIG. 2E, the pill 222 has been moved into the heal section 204 of the well 200 with the accumulated liquids 214 pushed into the vertical section 202 of the well 200. At this point, the pill and the accumulated liquids 214 may be directly lifted to the surface of the well 200. Alternatively, as shown in FIG. 2F, an injection tube 224 is inserted into the gelled pill 222 and a breaker composition is injected into the gelled pill 222 to produce a broken pill 226. The broken pill 226 and the accumulated liquids 214 are then lifted to the surface producing a well cleared of accumulated liquids as shown in FIG. 2G. Alternatively, a breaker agent may be injected into the borehole annulus, where it falls and accumulates in the heel section 204 breaking any pill or pig that enters the heel section 204. Of course, it should be recognized that the composition of the gelled pill may include one or a plurality of breaking agents in the composition timed so that the pill is fully broken at it arrives in the heal section of the well. Alternatively, the gelled pill may undergo viscosity breaking overtime after peak viscosity, where the break time is designed to permit the pill to traverse the horizontal run section so that when the pill arrives at the heal section, the pill will be fully broken. Alternatively, a breaker injection tubing may be inserted into the well so that one or a plurality breaker agents may be injected into the pill as it passes outlets in the tube so that when the pill arrives at the heal section, the pill will be fully broken.

Referring now to FIGS. 3A-F an embodiment of a method for removing accumulated liquids from a horizontal section of a horizontal well borehole 300. Looking at FIG. 3A, a horizontal well is shown to include a vertical section 302, a heal section 304, a horizontal run section 306, and a toe section 308. The vertical section 302 is that part of the borehole 300 extending from a surface 310 to the heal section 304. The horizontal sections 306 and 308 include perforated or screened regions 312 through which formation gas and liquids enter the borehole 300. The horizontal run section 306 is that portion of the borehole 300 in which accumulated liquids 314 can obstruct gas flow and adversely affect gas production from the well or create section of slug flow or cause unacceptable foaming within the horizontal sections 306 and 308 of the well 300. The toe section 308 of the well borehole 300 is that section of the well having a sufficient length so that once a gelled pill has been formed in the borehole at a start of the toe section 308, gas produced in the toe section 308 will be sufficient to push the gelled pill through the horizontal run section 306 to the heal section 304 for uplift to the surface 310. The borehole 300 also includes production tubing 316 extending from the surface 310 to the toe section 308. The production tubing 316 may include a single tube or a plurality of tubes. The production tubing 316 may also includes a plurality of outlets so that material may be injected into the well at different locations along the length of the vertical section 302, the heal section 304, and the horizontal sections 306 and 308.

Figure 3A:
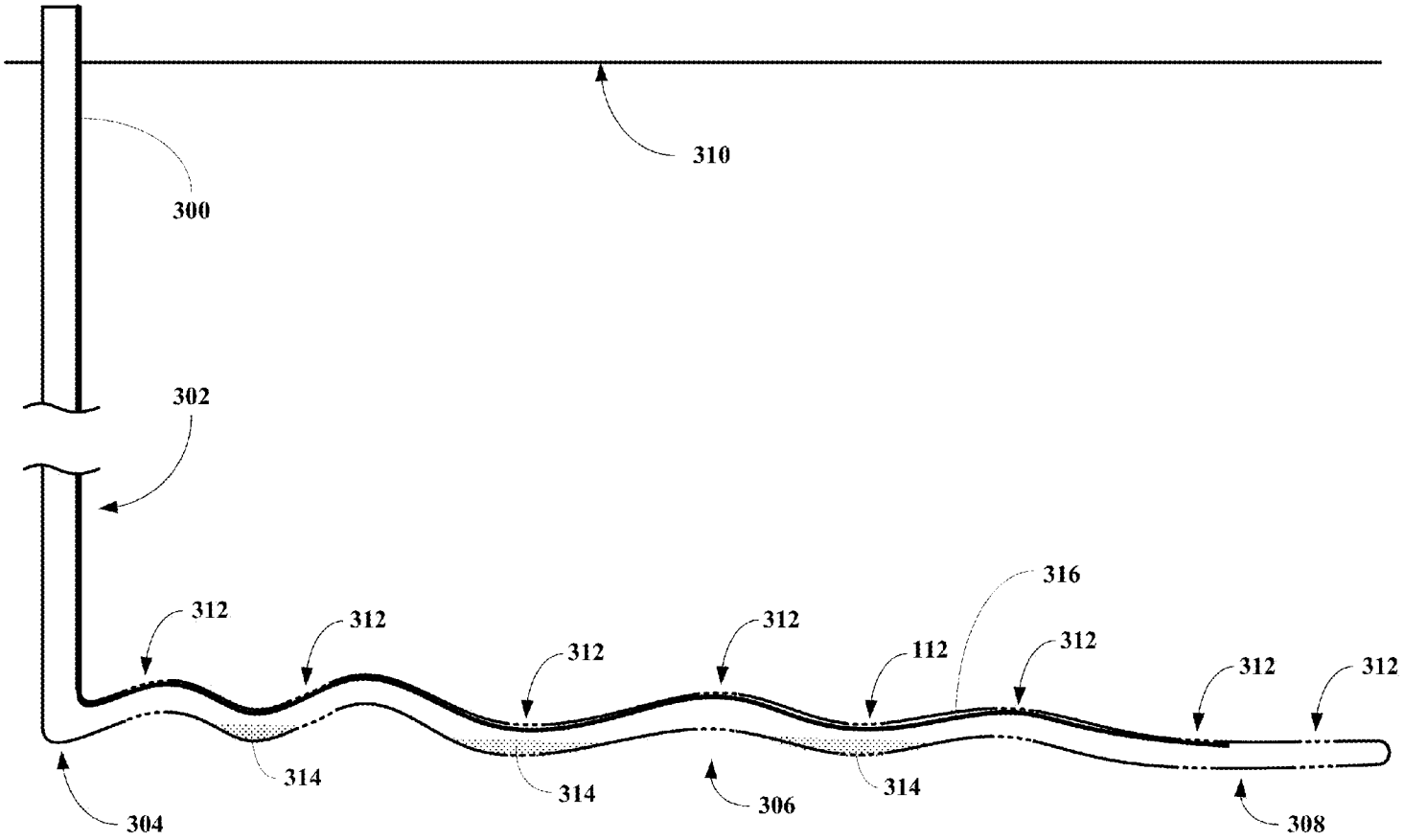
FIGS. 3A-F depict another embodiment of a method for clearing a horizontal section of a well of accumulated liquids using a gelled pill of this invention.
Figure 3B:
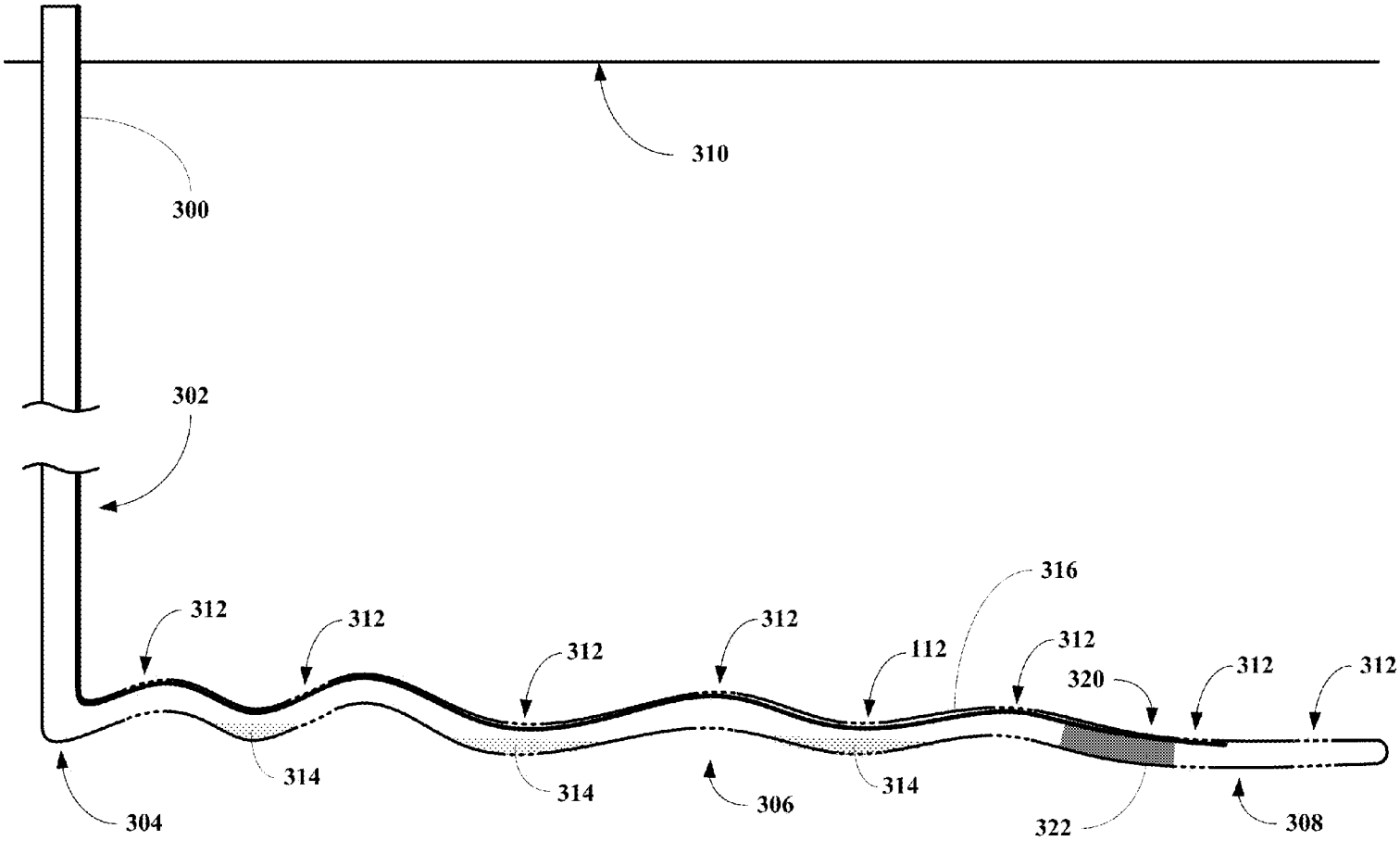
Figure 3C:
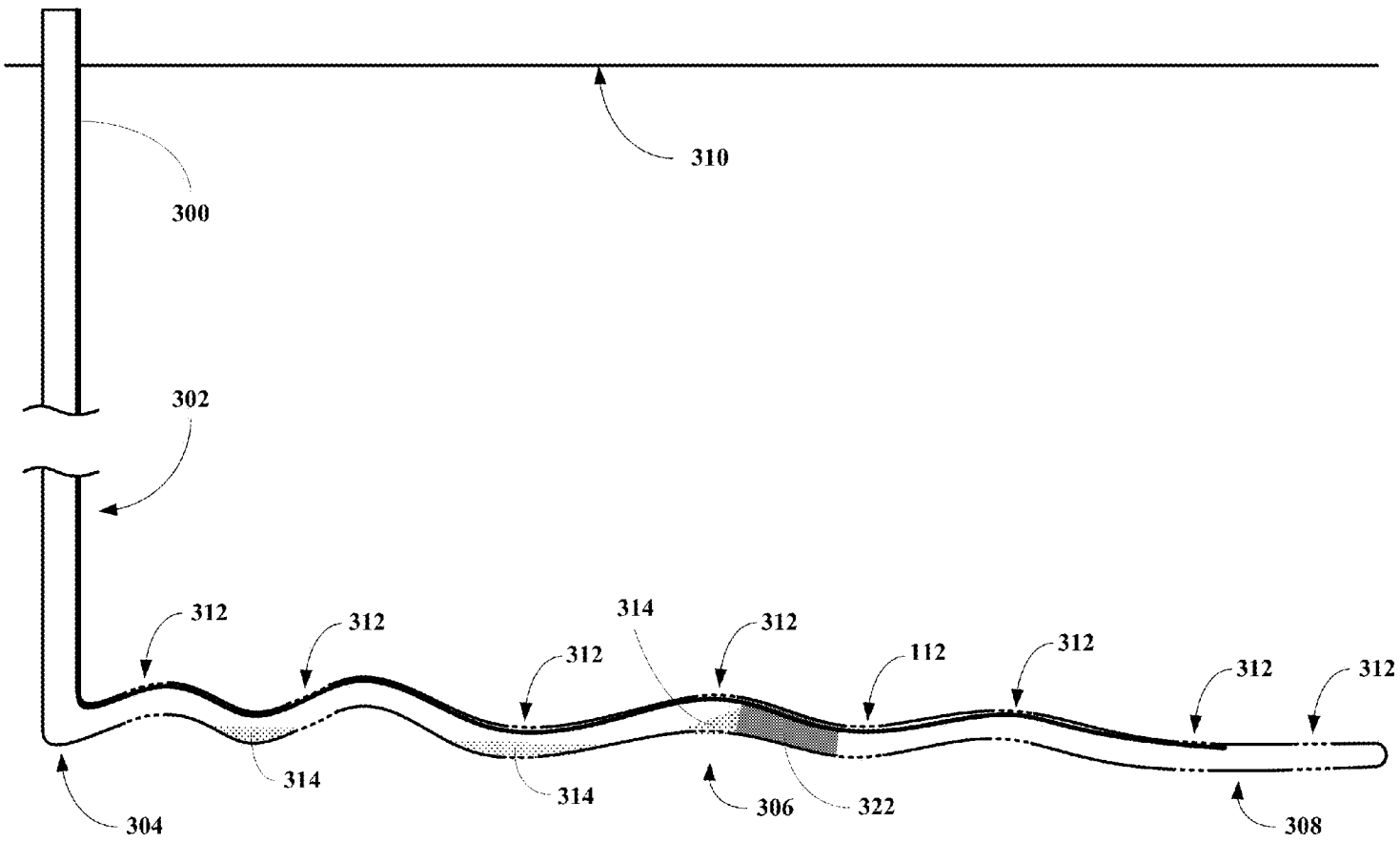
Figure 3D:
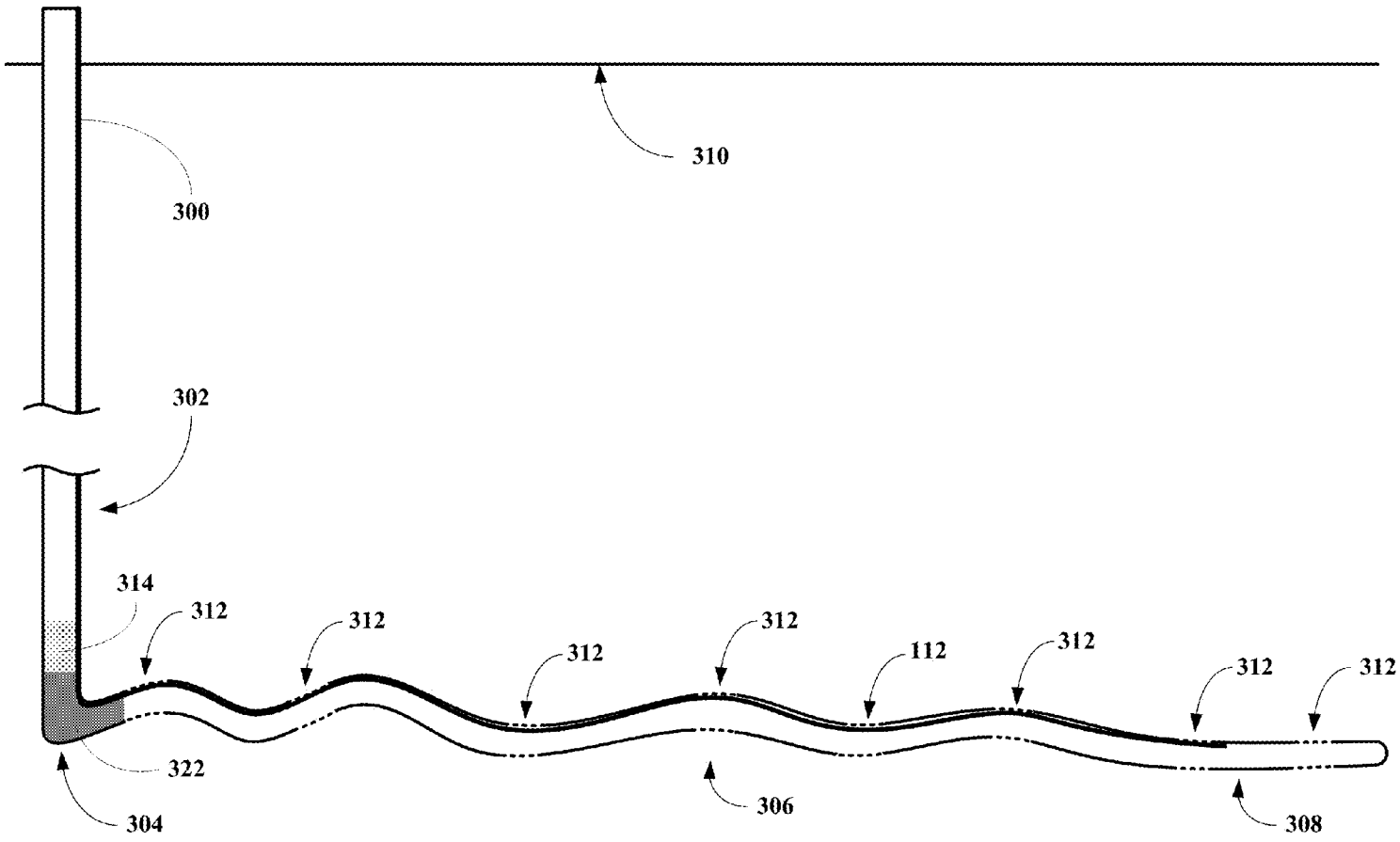
Figure 3E:
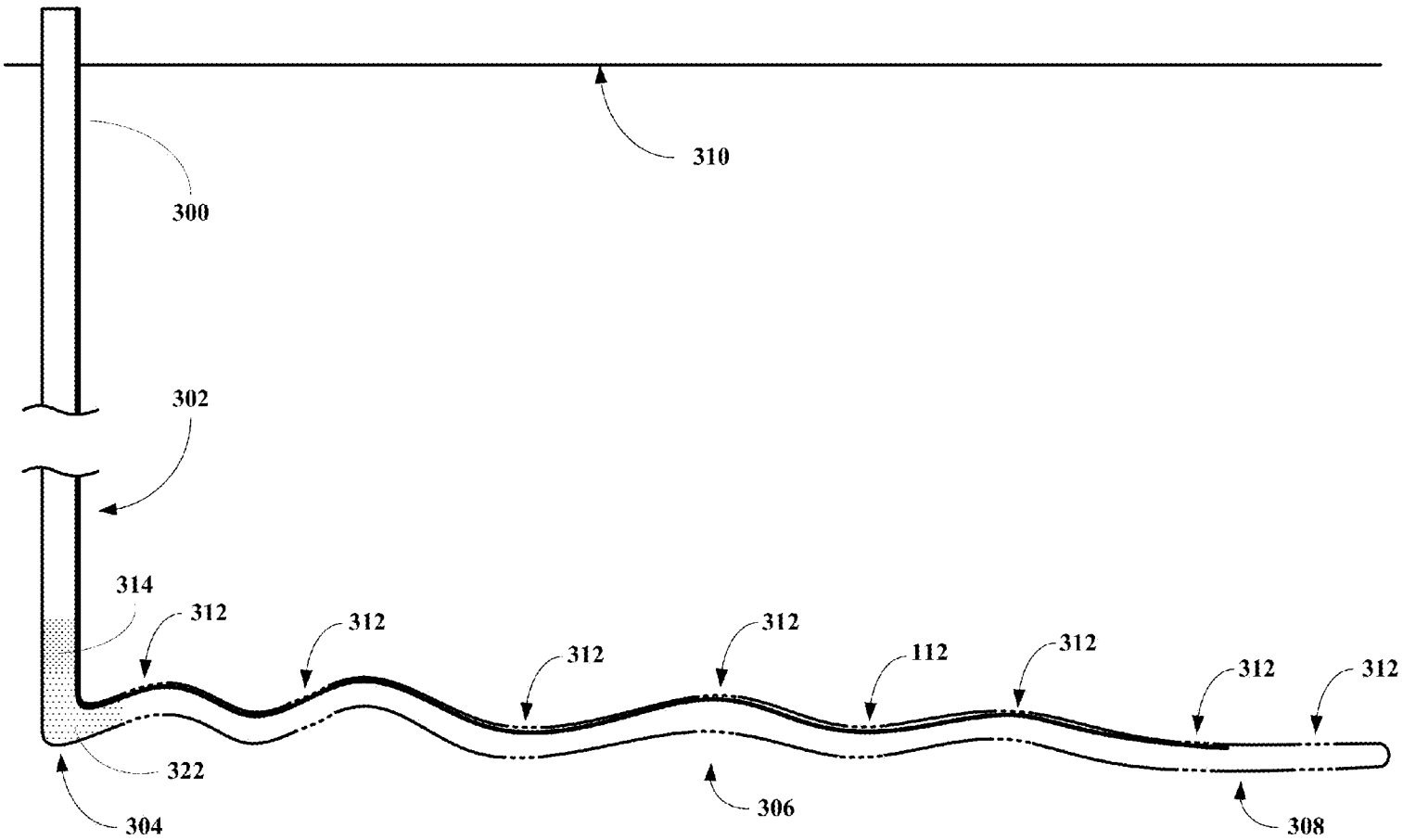
Figure 3F:
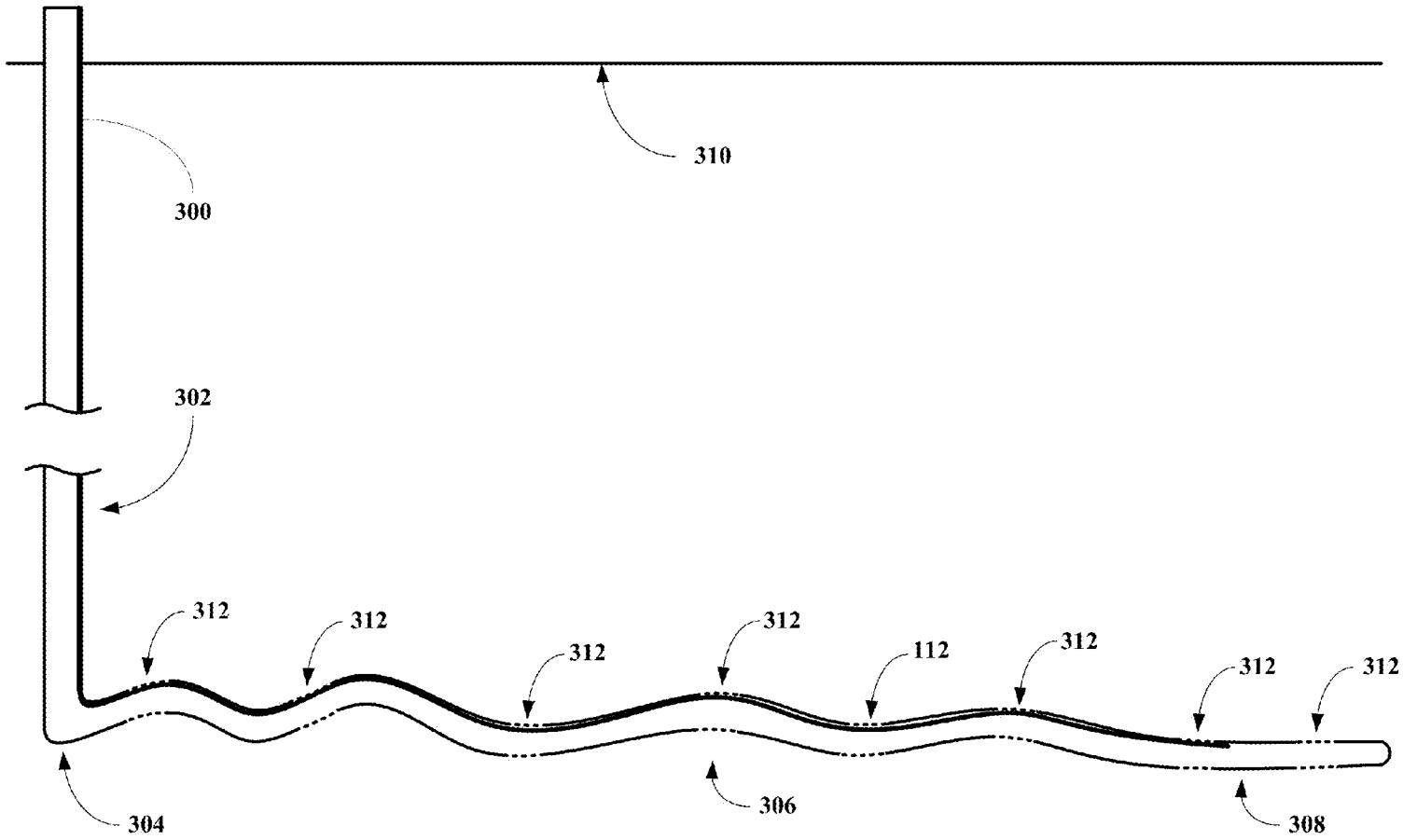

Looking at FIG. 3B, a gellable fluid is injected into the borehole 300 at the location 320 to form a gelled pill 322. As the production tubing 316 is a permanent part of the well 300, gas from the surface may be injected into the toe section to assist in pushing the gelled pill 322 through the horizontal section 306. Looking at FIG. 3C, the pill 322 have been moved along the horizontal section 306 of the well 300 pushing the accumulated liquids 314 in front of the pill 322. Looking at FIG. 3D, the pill 322 has been moved into the heal section 304 of the well 300 with the accumulated liquids 314 pushed into the vertical section 302 of the well 300. At this point, the pill 322 and the accumulated liquids 314 may be directly lifted to the surface of the well 300. Alternatively, as shown in FIG. 3E, a breaker composition is injected via the production tubing 316 into the gelled pill 322 to produce a broken pill 324. The broken pill 326 and the accumulated liquids 314 are then lifted to the surface producing a well cleared of accumulated liquids as shown in FIG. 3F. Alternatively, the breaker agent may be injected into the borehole annulus, where it falls and accumulates in the heel section 304 breaking any pill or pig that enters the heel section 304. Of course, it should be recognized that the composition of the gelled pill may include one or a plurality of breaking agents in the composition timed so that the pill is fully broken at it arrives in the heal section of the well. Alternatively, the gelled pill may undergo viscosity breaking overtime after peak viscosity, where the break time is designed to permit the pill to traverse the horizontal run section so that when the pill arrives at the heal section, the pill will be fully broken. Alternatively, a breaker injection tubing may be inserted into the well so that one or a plurality breaker agents may be injected into the pill as it passes outlets in the tube so that when the pill arrives at the heal section, the pill will be fully broken.

Figure 4A:
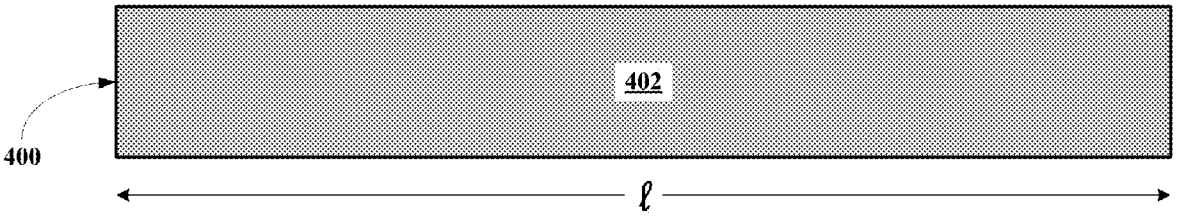
FIGS. 4A-C depict three different single component pill crosslinking profiles for use in the present invention.
Figure 4B:
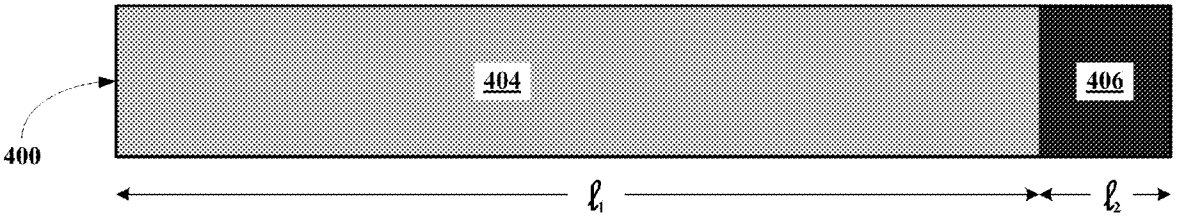
Figure 4C:
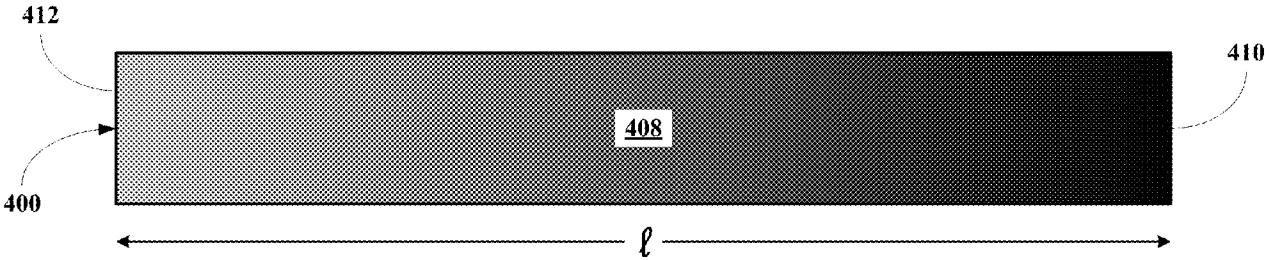

Referring now to FIGS. 4A-C, embodiment of gelled pills 400 are shown. Looking at FIG. 4A, the pill 400 is shown as a uniform gel 402 of length l, where l ranges from less than 1 foot to 50 feet or more as needed to clean the horizontal section 106, 206 or 306 of the well 100, 200, and 300. Looking at FIG. 4B, the pill 400 is shown as to include two uniform gel sections 404 and 406 of lengths $l_1$, where $l_2$, respectively. The sum of $l_1$ and $l_2$, again ranges from 1 foot to 50 feet or more as needed to clean the horizontal section 106, 206 or 306 of the well 100, 200, and 300. The lengths $l_1$ and $l_2$ may be varied as desired. The first section 404 is shown here as not as heavily crosslinked as the section 406. This arrangement is to improve gas impermeability of the pill 400. Looking at FIG. 4C, the pill 400 is shown as a non-uniform gel 408 of length l, where l ranges from 1 foot to 50 feet or more as needed to clean the horizontal section 106, 206 or 306 of the well 100, 200, and 300. The non-uniform gel 408 is shown as having greater crosslink density or higher viscosity from its distal end 410 to its proximal end 412.

Figure 4D:
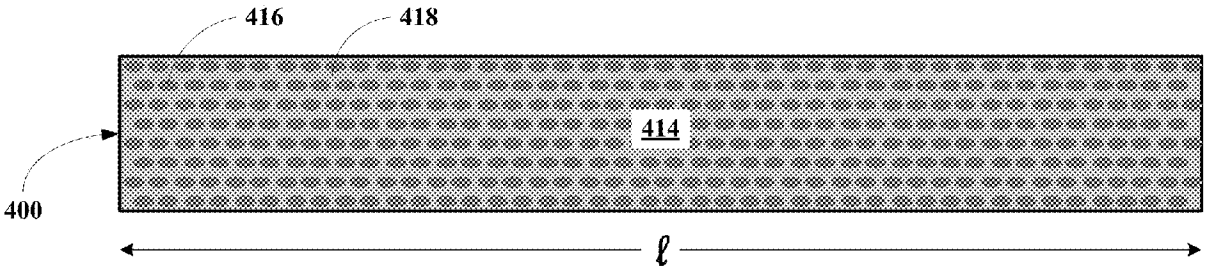
FIGS. 4D-F depict three different oil-in-water or water-in-oil pill crosslinking profiles for use in the present invention.
Figure 4E:
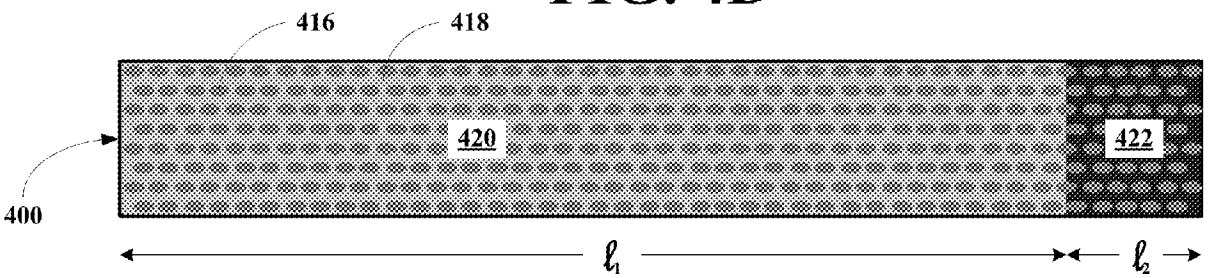
Figure 4F:
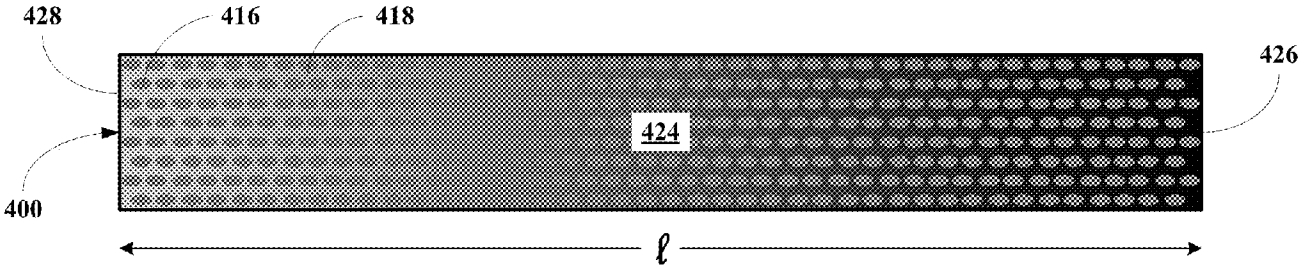

Referring now to FIGS. 4D-F, embodiment of gelled emulsion or microemulsion pills 400 are shown. Looking at FIG. 4A, the pill 400 is shown as a uniform emulsion or microemulsion gel 414 comprising a continuous phase 416 and a discontinuous phase 418 of length l, where l ranges from 1 foot to 50 feet or more as needed to clean the horizontal section 106, 206 or 306 of the well 100, 200, and 300. The gel 414 may be a water-in-oil gel or a oil-in-water gel. Looking at FIG. 4B, the pill 400 is shown as to include two gel sections 420 and 422 of lengths $l_1$, where $l_2$, respectively. The sum of $l_1$ and $l_2$, again ranges from 1 foot to 50 feet or more as needed to clean the horizontal section 106, 206 or 306 of the well 100, 200, and 300. The lengths $l_1$ and $l_2$ may be varied as desired. The first section 420 is shown here as not as heavily crosslinked as the section 422. This arrangement is to improve gas impermeability of the pill 400. Looking at FIG. 4C, the pill 400 is shown as a non-uniform gel 424 of length l, where l ranges from 1 foot to 50 feet or more as needed to clean the horizontal section 106, 206 or 306 of the well 100, 200, and 300. The non-uniform gel 424 is shown as having greater crosslink density or higher viscosity from its distal end 426 to its proximal end 428. In the two heterogenous cases, the discontinuous phase is shown as having the same crosslink density as the uniform case. However, discontinuous phase may also vary in crosslink density or viscosity depending on whether the crosslink agents are uniformly introduced into the pill as the pill is injected into the well.

All references cited herein are incorporated by reference. Although the invention has been disclosed with reference to its preferred embodiments, from reading this description those of skill in the art may appreciate changes and modification that may be made which do not depart from the scope and spirit of the invention as described above and claimed hereafter.

We claim:

1. A method for cleaning horizontal section of wells comprising the steps of:

injecting a composition into a horizontal section of a well extending through a producing formation of a producing gas well at a location a distance d from a toe end of the well, the toe section, after liquids have accumulated in the horizontal section of the well during gas production, where the composition comprises one crosslinkable polymer or a plurality of crosslinkable polymers and an effective amount of one crosslinking agent or a plurality of crosslinking agents, where the effective amount is sufficient to gel the composition, where the crosslinking agents comprise metal ions selected from the group consisting of boron, zirconium, and titanium containing compounds, and mixtures thereof, and where crosslinkable polymers are selected from the group consisting of polysaccharide polymers, high-molecular weight polysaccharides composed of mannose and galactose sugars, hydropropyl guar (HPG), hydroxypropylcellulose (HPC), carboxymethyl guar (CMG), carboxymethylhydropropyl guar (CMHPG), hydroxyethylcellulose (HEC) or hydroxypropylcellulose (HPC), carboxymethylhydroxyethylcellulose (CMHEC), Xanthan, scleroglucan, polyacrylamide, polyacrylate polymers and copolymers and mixtures thereof, forming a gelled pill at the location, where the gelled pill has a viscosity of at least 200 cP at 40 $sec^{-1}$ and a length between 1 foot and 50 feet, and pushing the gelled pill through the horizontal section of the well into a heal section of the well using gas pressure acting on a toe end side of the gelled pill so that the accumulated liquids move with the gelled pill into the heal section to improve the gas production, reduce slugging, and reduce accumulated liquids in the horizontal section of the well.

2. The method of claim 1, further comprising the step:

uplifting the gelled pill and the accumulated liquids from the heal section to the surface leaving a cleaned well.

3. The method of claim 2, further comprising:

injecting gas from the surface at a toe end side of the gelled pill to assist in pushing the gelled pill and accumulated liquids into the heal section of the well and to assist in lifting the gelled pill and accumulated liquids from the heal section to the surface.

4. The method of claim 1, further comprising the step:

breaking the gelled pill to form a broken pill, where the breaking occurs (a) naturally based on the composition, (b) in that the composition further comprises one breaking agent or a plurality of breaking agents, (c) in that the composition further comprises one breaking agent or a plurality of breaking agents in combination with one delay agent or a plurality of delay agents, or (d) injecting one breaking agent or a plurality of breaking agents at the toe end side of the gelled pill at the heal section of the well and/or at the toe end side of the gelled pill as the gelled pill traverses the well, and uplifting the broken pill and the accumulated liquids from the heal section to the surface leaving a cleaned well.

5. The method of claim 1, wherein the distance d is sufficient for the gas pressure generated by the production gas entering the well from the producing formation between the toe end of the well and the toe end side of the gelled pill to push the gelled pill and the accumulated liquids into the heal section of the well.

6. The method of claim 1, further comprising:

injecting gas from the surface into the well at the toe end side of the gelled pill to assist in the pushing of the gelled pill and the accumulated liquids into the heal section of the well.

7. The method of claim 6, wherein the distance d is sufficient for the gas pressure generated by the production gas entering the well from the producing formation between the toe end of the well and the toe end side of the gelled pill and generated by the injected gas to push the gelled pill and the accumulated liquids into the heal section of the well.

8. The method of claim 7, wherein the injected gas contributes less than 25% of the gas pressure or contributes greater than 50% of the gas pressure.

9. The method of claim 6, wherein the distance d is smaller than a distance in the absence of the injected gas.

10. The method of claim 6, wherein the distance d is zero and the composition and the injected gas are injected at the toe of the well.

11. The method of claim 6, wherein the injected gas is selected from the group consisting of production gas, natural gas, an inert gas or other gases that would not adversely affect the well or production tubing.

12. The method of claim 1, wherein the composition is selected from the group consisting of an aqueous composition, a non-aqueous composition, a water-in-oil emulsion or microemulsion, and an oil-in-water emulsion or microemulsion.

13. The method of claim 12, wherein composition is an aqueous composition and the one crosslinkable polymer or the plurality of crosslinkable polymers are hydratable polymers.

14. The method of claim 13, wherein the composition further comprises one or a plurality of metal ion formate salts of the formula $(HCOO^-)_nM^{n+}$ and mixtures thereof, where M is a metal ion and n is the valency of the metal ion and wherein the metal ion is selected from the group consisting of (1) an alkali metal ion, (2) an alkaline metal ion, (3) a transition metal ion, (4) a lanthanide metal ion, and mixtures thereof.

15. The method of claim 14, wherein: (1) the alkali metal ion is selected from the group consisting of $Li^+$, $Na^+$, $K^+$, $Rd^+$, $Cs^+$, and mixtures thereof; (2) the alkaline metal ion is selected from the group consisting of $Mg^{2+}$, $Ca^{2+}$, $Sr^{2+}$, $Ba^{2+}$ and mixtures thereof; (3) the transition metal ion is selected from the group consisting of $Ti^{4+}$, $Zr^{4+}$, $Hf^{4+}$, $Zn^{2+}$ and mixtures thereof; and (4) the lanthanide metal ion is selected from the group consisting of $La^{3+}$, $Ce^{4+}$, $Nd^{3+}$, $Pr^{2+}$, $Pr^{3+}$, $Pr^{4+}$, $Sm^{2+}$, $Sm^{3+}$, $Gd^{3+}$, $Dy^{2+}$, $Dy^{3+}$, and mixtures thereof.

16. The method of claim 1, wherein the composition comprises a plurality of crosslinkable polymers.

17. The method of claim 1, wherein the gelled pill is homogeneously crosslinked or is heterogeneously crosslinked so that the toe end side of the gelled pill has a greater crosslink density than a heal end side of the gelled pill.

18. The method of claim 1, wherein the viscosity is at least 250 cP at 40 $sec^{-1}$, at least 300 cP at 40 $sec^{-1}$, at least 350 cP at 40 $sec^{-1}$, at least 450 cP at 40 $sec^{-1}$, at least 500 cP at 40 $sec^{-1}$, at least 550 cP at 40 $sec^{-1}$, or at least 600 cP at 40 $sec^{-1}$.

19. A system for removing accumulated liquids from horizontal portions of a well comprising:

an injection system capable of injecting a composition into a horizontal portion of a well extending through a producing formation of a producing gas well at a location a distance d from a toe end of the well, the toe section, after liquids have accumulated in the horizontal section of the well, where the composition comprises one crosslinkable polymer or a plurality of crosslinkable polymers and an effective amount of one crosslinking agent or a plurality of crosslinking agents, and where the effective amount is sufficient to gel the composition to a desired viscosity to form a gelled pill at the location having a viscosity of at least 200 cP at 40 $sec^{-1}$ and a length between 1 foot and 50 feet, where the crosslinking agents comprise metal ions selected from the group consisting of boron, zirconium, and titanium containing compounds, and mixtures thereof, and where crosslinkable polymers are selected from the group consisting of polysaccharide polymers, high-molecular weight polysaccharides composed of mannose and galactose sugars, hydropropyl guar (HPG), hydroxypropylcellulose (HPC), carboxymethyl guar (CMG), carboxymethylhydropropyl guar (CMHPG), hydroxyethylcellulose (HEC) or hydroxypropylcellulose (HPC), carboxymethylhydroxyethylcellulose (CMHEC), Xanthan, scleroglucan, polyacrylamide, polyacrylate polymers and copolymers and mixtures thereof, where the distance d from the toe end of the well is sufficient for produced gas to push the gelled compositions from the toe section along a horizontal section to a heal section for uplift to the surface along with any accumulated liquids from the horizontal section.

20. The system of claim 19, further comprising:

a single tube capable of injecting a gelled, gelling or gellable composition into the well at the location under controlled conditions.

21. The system of claim 20, wherein the tube includes ports that are mechanically or electrically opened to permit materials to be injected anywhere along a length of the tube.

22. The system of claim 20, wherein the tube is permanent.

23. The system of claim 22, wherein the permanent tube is capillary tubing.

24. The system of claim 19, further comprising:

a plurality of tubes, where one tube is used to inject the composition absent the crosslinking agents and one tube is used to inject the crosslinking agent or the plurality of crosslinking agents into the well at the location under controlled conditions to form the gelled pill at the location.

25. The system of claim 24, wherein the plurality of tubes further includes a tube used to inject a gas into the toe end side of the gilled pill to assist in pushing the gelled pill through the horizontal section into the heal section of the well for uplift.

26. The system of claim 24, wherein the plurality of tubes further includes a tube used to inject a breaking agent or a plurality of breaking agents into the gelled pill.

27. The system of claim 26, wherein the breaker tube is configured to inject the breaking agent or breaking agents into the well as the gelled pill traverses the horizontal section or the breaker tube is configured to inject the breaking agent or the breaking agents into the well when the gelled pill enters or approaches the heal section of the well.

28. The system of claim 19, wherein, if the tube is run into and tripped out of the well, the tube is either capillary tubing or coiled tubing.

29. The system of claim 19, wherein the composition is selected from the group consisting of an aqueous composition, a non-aqueous composition, a water-in-oil emulsion or microemulsion, and an oil-in-water emulsion or microemulsion.

30. The system of claim 29, wherein the composition is an aqueous composition and the crosslinkable polymer or the crosslinkable polymers are hydratable polymers.

31. The system of claim 30, wherein the composition further comprises one or a plurality of metal ion formate salts of the formula $(HCOO^-)_nM^{n+}$ and mixtures thereof, where M is a metal ion and n is the valency of the metal ion and wherein the metal ion is selected from the group consisting of (1) an alkali metal ion, (2) an alkaline metal ion, (3) a transition metal ion, (4) a lanthanide metal ion, and mixtures thereof.

32. The system of claim 31, wherein: (1) the alkali metal ion is selected from the group consisting of $Li^+$, $Na^+$, $K^+$, $Rd^+$, $Cs^+$, and mixtures thereof; (2) the alkaline metal ion is selected from the group consisting of $Mg^{2+}$, $Ca^{2+}$, $Sr^{2+}$, $Ba^{2+}$ and mixtures thereof; (3) the transition metal ion is selected from the group consisting of $Ti^{4+}$, $Zr^{4+}$, $Hf^{4+}$, $Zn^{2+}$ and mixtures thereof; and (4) the lanthanide metal ion is selected from the group consisting of $La^{3+}$, $Ce^{4+}$, $Nd^{3+}$, $Pr^{2+}$, $Pr^{3+}$, $Pr^{4+}$, $Sm^{2+}$, $Sm^{3+}$, $Gd^{3+}$, $Dy^{2+}$, $Dy^{3+}$, and mixtures thereof.

33. The system of claim 19, wherein the composition further comprises a plurality of crosslinkable polymers.

34. The system of claim 19, wherein the gelled pill is homogeneously crosslinked or is heterogeneously crosslinked so that a toe end side of the gelled pill has a greater crosslink density than a heal end side of the gelled pill.

35. The system of claim 19, wherein the viscosity is at least 250 cP at 40 $sec^{-1}$, at least 300 cP at 40 $sec^{-1}$, at least 350 cP at 40 $sec^{-1}$, at least 450 cP at 40 $sec^{-1}$, at least 500 cP at 40 $sec^{-1}$, at least 550 cP at 40 $sec^{-1}$, or at least 600 cP at 40 $sec^{-1}$.

* * * * *